US007352350B2

(12) United States Patent
Nitta et al.

(10) Patent No.: US 7,352,350 B2
(45) Date of Patent: Apr. 1, 2008

(54) DISPLAY DEVICE

(75) Inventors: Hiroyuki Nitta, Fujisawa (JP); Tsutomu Furuhashi, Yokohama (JP); Junichi Hirakata, Chiba (JP); Yoshinori Tanaka, Mobara (JP); Kazuyoshi Kawabe, Fukuoka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/385,828

(22) Filed: Mar. 22, 2006

(65) Prior Publication Data

US 2006/0176261 A1 Aug. 10, 2006

Related U.S. Application Data

(63) Continuation of application No. 10/391,775, filed on Mar. 20, 2003, now Pat. No. 7,038,651.

(30) Foreign Application Priority Data

Mar. 20, 2002 (JP) ..... 2002-077498

(51) Int. Cl.
*G09G 3/36* (2006.01)

(52) U.S. Cl. ..... 345/94; 345/89; 345/90; 345/98; 315/169.3

(58) Field of Classification Search .. 315/169.1–169.3; 345/87, 89, 90, 94, 98, 99, 100, 204, 690
See application file for complete search history.

(56) References Cited

U.S. PATENT DOCUMENTS 6,771,243 B2 * 8/2004 Hirohata ..... 345/89
6,937,224 B1 8/2005 Miyachi ..... 345/102
7,006,069 B2 * 2/2006 Tanaka et al. ..... 345/98
7,027,018 B2 * 4/2006 Nitta et al. ..... 345/87
7,057,597 B2 * 6/2006 Ikeda ..... 345/95
7,170,233 B2 * 1/2007 Adachi et al. ..... 315/169.3
2002/0024481 A1 * 2/2002 Kawabe et al. ..... 345/87
2002/0033789 A1 * 3/2002 Miyata et al. ..... 345/89
2002/0158857 A1 * 10/2002 Iisaka ..... 345/204
2003/0090449 A1 * 5/2003 Arimoto et al. ..... 345/87
2004/0080480 A1 * 4/2004 Zhang et al. ..... 345/90
2006/0139289 A1 * 6/2006 Yoshida et al. ..... 345/98

* cited by examiner

*Primary Examiner*—Haissa Philogene
*Assistant Examiner*—Tung X Le
(74) *Attorney, Agent, or Firm*—Antonelli, Terry, Stout & Kraus, LLP.

(57) ABSTRACT

In a hold-type display device, such as a liquid crystal display device, so-called blurring which appears on a profile of a displayed animated image can be suppressed without degrading the brightness of the image. An image based on video data to be inputted to a display device is displayed for every frame period and, thereafter, the image is masked with a blanking image. Here, the ratio between an image display period of the video data and a blanking image display period in one frame period is adjusted, based on the number of pixel rows selected in a pixel array in response to a scanning clock for respective periods, the frequency of the scanning clock, and shortening of a horizontal period of display signal inputting to every pixel row with respect to a horizontal scanning period of the video data, whereby the image can be efficiently cancelled using the blanking image.

3 Claims, 15 Drawing Sheets

DISPLAY DEVICE

CROSS-REFERENCE TO RELATED APPLICATION

This application is a continuation application of application Ser. No. 10/391,775, filed Mar. 20, 2003, now U.S. Pat. No. 7,038,651 the disclosure of which is hereby incorporated by reference.

BACKGROUND OF THE INVENTION

The present invention relates to an active matrix-type display device, such as represented by a liquid crystal display device and an electro luminescence-type display device, provided with a plurality of pixels respectively provided with switching elements, and to a display device provided with a plurality of pixels respectively having light emitting elements such as light emitting diodes; and, more particularly, the present invention relates to a process for blanking a display image in a hold-type display device.

As a display device which holds light emitted from a plurality of respective pixels at a desired quantity for a given period (for example, a period corresponding to one frame) based on image data inputted for every frame period, a liquid crystal display device has seen increased use.

In the liquid crystal display device of the active matrix type, as shown in FIG. 27, each of a plurality of pixels PIX, which are arranged two-dimensionally or in a matrix array, includes a pixel electrode PX and a switching element SW (for example, a thin film transistor), which supplies video signals to the pixel electrode PX. In this manner, an element in which a plurality of these pixels PIX are arranged in the form of a matrix is also referred to as a pixel array 101. The pixel array 101 in a liquid crystal display device is also referred to as a liquid crystal display panel. In this pixel array 101, the plurality of pixels PIX constitute a so-called display screen which displays an image.

In the pixel array 101 shown in FIG. 27, a plurality of gate lines 10 (also referred to as scanning signal lines) extending in the lateral direction and a plurality of data lines 12 (also referred to as video signal lines) extending in the longitudinal direction (direction which crosses the gate lines 10) are respectively juxtaposed. As shown in FIG. 27, along respective gate lines 10, which are identified by addresses G1, G2, G3, . . . Gn, so-called pixel rows are formed in which a plurality of pixels PIX are arranged in the lateral direction, while along respective gate lines 12, which are identified by addresses D1R, D1G, D1B, . . . DmB, so-called pixel columns are formed in which a plurality of pixels PIX are arranged in the longitudinal direction. The gate lines 10 apply voltage signals from a scanning driver 103 (also referred to as a scanning driving circuit) to the switching elements SW, which are respectively formed on the pixels PIX constituting the pixel rows (lower sides of the respective gate lines in the case shown in FIG. 27) respectively corresponding to the gate lines 10, so as to open or close the electrical connection between the pixel electrodes PX formed on respective pixels PIX and one of the data lines 12. An operation to control a group of switching elements SW formed in a specified pixel row by applying a voltage signal from the gate lines 10 corresponding to the switching elements SW is also referred to as the selection of lines or "scanning", and the above-mentioned voltage signal that is applied to the gate lines 10 from the scanning driver 103 is also referred to as a scanning signal.

On the other hand, to each data line 12, a voltage signal, which is referred to as a gray scale voltage or a tone voltage, is applied from a data driver 102 (also referred to as a video signal driving circuit), wherein the above-mentioned gray scale voltage is applied to respective pixel electrodes PX of the pixels PIX which constitute the pixel column (at right side of each data line 12 in FIG. 27) corresponding to each data line 12 and which are selected in response to the scanning signal.

When such a liquid crystal display device is incorporated into a television set, with respect to the period of one field of the image data (video signal) that is received, based on an interlace mode, or one frame period of video data received in a progressive mode, the above-mentioned scanning signal is sequentially applied from G1 to Gn of the gate line 10, and the gray scale voltage, which is generated based on video data received during one field period or one frame period, is sequentially applied to a group of pixels which constitute each pixel row. In each pixel, a so-called capacitive element is formed by sandwiching a liquid crystal layer LC between the above-mentioned pixel electrode PX and the counter electrode CT, to which a reference voltage or a common voltage is applied through a signal line 11, and the optical transmissivity of the liquid crystal layer LC is controlled in response to an electric field generated between the pixel electrode PX and the counter electrode CT. As mentioned above, during the operation to sequentially select the gate lines G1 to Gn one time for every field period or every frame period of the video data, the gray scale voltage applied to the pixel electrode PX of a certain pixel in a certain field period, for example, is theoretically held in the pixel electrode PX until the next gray scale voltage is received in the next field period which follows the current field period. Accordingly, the optical transmissivity of the liquid crystal layer LC, which is sandwiched by the pixel electrodes PX and the above-mentioned counter electrodes CT (that is, the brightness of the pixels having these pixel electrodes PX), is held in a given state for every one field period. A liquid crystal display device, which displays an image while holding the brightness of the pixel for every field period or every frame period in this manner, is referred to as a hold-type display device and is discriminated from a so-called impulse-type display device, such as a cathode ray tube, which causes a phosphor dot provided for each pixel perform light emission by irradiating electrons at a time when the video signal is inputted.

The video data transmitted from a television receiver set, a computer or the like has a format which corresponds to an impulse-type display device. To compare the above-mentioned driving method of the liquid crystal display device with television broadcasting, within a time which corresponds to an inverse number of the horizontal scanning frequency of the television broadcasting, the scanning signal is applied to every gate line 10, and application of the scanning signal to all gate lines G1 to Gn is completed within a time which corresponds to an inverse number of the vertical frequency. Although the impulse-type display device makes the pixels juxtaposed in the lateral direction of the screen emit light sequentially like an impulse for every horizontal scanning period in response to a horizontal synchronous pulse, in the hold-type display device, the pixel row is selected for every scanning period, as mentioned previously, a voltage signal is supplied to a plurality of pixels included in the pixel row at the same time, and, when the horizontal scanning period is finished, the voltage signal is held in these pixels.

Although the operation of the hold-type display device has been explained by taking a liquid crystal display device as an example in conjunction with FIG. 27, an electroluminescence type (EL type) display element in which the liquid crystal layer LC is replaced by an electroluminescence material, and a light emitting diode array type display device in which the liquid crystal layer LC is replaced by capacitive elements or light emitting diodes sandwiched between pixel electrodes PX and counter electrodes CT, can be operated as the hold-type display device, although they differ in operational principles (an image is displayed by controlling the injection quantity of carriers to light emitting materials in these devices).

Here, for example, a hold-type display device displays an image by holding the brightness of respective pixels for the above-mentioned frame period. Accordingly, there may be a case such that, when a display image is replaced with a different display image between a pair of continuous frame periods, the brightness of the pixels does not sufficiently respond.

This phenomenon is due to the fact that the pixel which is set to given brightness in a certain frame period (for example, a first frame period) holds the brightness corresponding to the first frame period until the pixel is scanned in the next frame period (for example, a second frame period) which follows the first frame period. This phenomenon is also based on a so-called hysteresis of the video signal in each pixel, wherein a portion of the voltage signal (or a quantity of charge corresponding to the voltage signal) which is transmitted to the pixel during the first frame period interferes with the voltage signal (or a quantity of charge corresponding to the voltage signal) which is to be transmitted to the pixel during the second frame. Techniques which solve these problems related to the responsiveness of the image display in the display device using the hold-type light emission, for example, are disclosed in JP-B-06-016223, JP-B-07-044 670, JP-A-05-073005, and JP-A-11-109921, respectively.

Of these publications, JP-A-11-109921 discusses a so-called blurring phenomenon which occurs at the time of reproducing an animated image by a liquid crystal display device (an example of a display device using the hold-type light emission). Here, the blurring phenomenon is a phenomenon which makes a profile of an object obscure, compared to a cathode ray tube, which makes pixels emit light like an impulse. To solve this blurring phenomenon, JP-A-11-109921 discloses a liquid crystal display device in which one pixel array (a group consisting of a plurality of pixels arranged two-dimensionally) of a liquid crystal display panel is divided into two divided pixel arrays at upper and lower portions of the screen (image forming region) and data line driving circuits are respectively provided for these divided pixel arrays. The liquid crystal display device performs a so-called dual scanning operation in which, by selecting one gate line from each of the upper and lower pixel array, that is, by selecting two gate lines in total, a video signal is supplied from the data line driving circuits formed in respective pixel arrays. While performing this dual scanning operation in one frame period, the vertical phase is shifted so as to input a signal corresponding to a display image (a so-called video signal) to one pixel array from the data line driving circuit and a signal of a blanking image (a black image, for example) to another pixel array from the data line driving circuit, respectively. Accordingly, it is possible to provide a period for performing an image display and a period for performing a blanking display at both upper and lower pixel arrays during one frame period, and, hence, the period that the video is held as a whole can be shortened. Due to such a constitution, even in a liquid crystal display device, it is possible to obtain an animated image display performance that is comparable to that of a cathode ray tube.

JP-A-11-109921 discloses a technique in which one liquid crystal display panel is divided into upper and lower pixel arrays, the data line driving circuits are respectively provided for the divided pixel arrays, one gate line for each of upper and lower pixel arrays, that is, two gate lines in total, are selected, the display region, which is divided into upper and lower regions, is subjected to dual scanning by respective driving circuits, and the blanking image (the black image) is inserted by shifting the vertical phase during one frame period. That is, by enabling one frame period to assume the video display period and the blanking period therein, it is possible to shorten the image holding period. Accordingly, with the use of a liquid crystal display, it is possible to obtain animated image display characteristics of the impulse-type light emission, as in the case of a cathode ray tube.

BRIEF SUMMARY OF THE INVENTION

As described above, although the invention described in JP-A-11-109921 has been proposed as a technique related to a liquid crystal panel which can display an animated image of high quality comparable to that of an impulse-type display device, there still remain some problems in putting the invention into practical use.

First of all, according to this technique, it is necessary to divide the pixel array in the liquid crystal display panel into two regions in the vertical direction of the screen and to provide individual data line driving circuits for the respective regions. Accordingly, the number of parts to be mounted on the liquid crystal display panel is increased; and, at the same time, the number of manufacturing steps and the manufacturing cost are also increased. Even taking the present situation that demands a large-sizing of the screen and high definition into account, the size of the liquid crystal display panel to which this technique is applied is large, exceeding a necessary size, and the structure of the panel also has to be complicated more than necessary. Accordingly, the manufacturing cost of such a liquid crystal display panel is further increased compared to a usual liquid crystal display panel.

Further, it is also difficult to ignore the problem that the blanking process, which is applied to every display image by the liquid crystal display panel adopting this technique, lowers the brightness of the whole screen. Even when the lowering of the brightness is taken into account, the animated image display characteristics of the liquid crystal display panel to which this technique is applied can be remarkably enhanced. However, in displaying a still image typically represented by a desk-top image of a personal computer on this liquid crystal display panel, there exists no difference between the quality of the still image and the quality of a corresponding image of an existing liquid crystal display panel. what is, the liquid crystal display panel described in the above-mentioned publication JP-A-11-109921 has too sophisticated a specification to be popularly used as a monitor, such as a for notebook-type personal computer; and, hence, the application of the liquid crystal display panel is limited to high-class devices applicable to multi-media. Accordingly, such a liquid crystal display panel is not suitable for mass production and is not appropriate as a display device for the next generation, which will take the place of a cathode ray tube.

Accordingly, it is an object of the present invention to provide a display device which can overcome problems concerning downsizing and simplification, which still remain with respect to the liquid crystal display panel which has been considered optimum, which can suppress the degradation of the image quality attributed to blurring of an animated image more effectively than a liquid crystal display panel, and which can also improve the brightness of the display image.

According to a first aspect of the present invention, there is provided a display device which includes a pixel array having a plurality of pixels which are arranged two-dimensionally along a first direction (for example, the horizontal direction of a display screen) and a second direction which crosses the first direction (for example, the vertical direction of the display screen), a plurality of first signal lines (for example, scanning signal lines or gate lines) which are juxtaposed along the second direction of the pixel array and transmit scanning signals which select a plurality of pixel rows consisting of respective groups formed of a plurality of pixels along the first direction, a plurality of second signal lines (for example, video signal lines or data lines) which are juxtaposed along the first direction of the pixel array and supply display signals (for example, gray scale voltages) for determining respective display states (for example, display gray scales) to the pixels included in pixel rows which are selected from a plurality of pixel rows in response to scanning signals, a first driving circuit which outputs the scanning signals to a plurality of respective first signal lines, a second driving circuit which outputs the display signals to a plurality of respective second signal lines, and a display control circuit which receives video data (for example, video signals in the television broadcasting) and control signals thereof (vertical synchronizing signals, horizontal synchronizing signals, dot clock signals and the like) for every frame period and transmits a first clock signal (described later as a scanning clock) which controls an outputting interval of the scanning signals from the above-mentioned first driving circuit and a scanning start signal which instructs starting of a selection step of pixel rows (scanning step for one screen of the pixel array) in response to the first clock signal to the first driving circuit and, transmits display data which serve for outputting display signals generated by the second driving circuit based on the above-mentioned video data and a second clock signal (described later as a horizontal data clock) which controls an outputting interval of the display signals from the second driving circuit to the second driving circuit.

The display control circuit makes the first driving circuit perform, at least twice, the above-mentioned pixel row selection step in the pixel array for every frame period in which the display device receives video data from an external circuit (for every vertical scanning period of the video data). The second driving circuit outputs the display signals based on the display data in response to the selection of respective pixel rows in the first pixel row selection step which is performed for every frame period and outputs display signals which display the pixel array darker than the first selection step to respective selected pixel rows in the second selection step. The operation of the pixel array in the second pixel row selection step is described later as a blanking image display.

According to another aspect of the present application, there is provided a display device which includes, in the same manner as the above-mentioned display device, a pixel array, a plurality of first signal lines (scanning signals or the like) and a plurality of second signal lines (video signal lines) which are juxtaposed to the pixel array, and a first driving circuit and a second driving circuit. Further, the display device which is exemplified as the second display device includes a display control circuit which transmits a first clock signal (a scanning clock) which controls an outputting interval of the scanning signals from the first driving circuit to the first signal lines and a scanning start signal which starts the pixel row selection over the pixel array (scanning of one screen of the pixel array) in response to the first clock signal to the first driving circuit and also transmits a second clock signal (a horizontal data clock) which controls an outputting interval of display signals outputted from the second driving circuit to the second driving circuit, and a clock generating circuit which generates display clock signals having frequency higher than that of dot clock signals contained in video control signals. The display control circuit makes the first drive circuit perform, at least twice, the pixel row selection step over the pixel array (for one screen) for every frame period of the video data inputted to the display control circuit in response to the scanning start signal. The display control circuit reads out the display data from the video data in response to the above-mentioned display clock in the first pixel row selection step and transfers the display data to the second driving circuit. Further, the second driving circuit supplies the first display signal based on the display data to the pixel array in response to the second clock signal in the first pixel row selection step, and supplies the second display signal which displays the pixel array darker after the first display signal is supplied to the pixel array in response to the second clock signal in the second pixel row selection step. The operation of the pixel array performed in response to the second display signal is also referred to as a blanking image display.

In any one of the above-mentioned display devices according to the present invention, the above-mentioned display signals are also, depending on the structure of the pixel array, referred to as gray scale signals, voltage signals (when the pixel array is that of a liquid crystal panel, for example) or current signals (when the pixel array is that of an electro luminescence element or a light emitting element array, for example).

In any one of the above-mentioned display devices according to the present invention, the first driving circuit may sequentially output the scanning signal which selects N lines (N being a natural number of 2 or more) which are arranged close to each other out of a plurality of first signal lines in response to the first clock signal for every N other lines of the first signal lines. Further, the first driving circuit may sequentially output the scanning signal which selects a plurality of first signal lines for every one line in response to the first clock signal having frequency which is N times (N being a natural number of 2 or more) larger than the frequency of the second clock signal.

Further, in any one of the above-mentioned display devices according to the present invention, the second driving circuit may output the display signal at an interval shorter than a horizontal scanning period of the video data which the display control circuit receives, and the frequency of the second clock signal may be set higher than the frequency of the horizontal synchronizing signal which is contained in the video control signal and inputs the video data to the display control circuit of the display device.

It may be possible to allocate a time longer than a time for the second selection step of the pixel rows during the frame period to the first selection step of the pixel rows during the above mentioned frame period. Further, an interval between a first pulse and a second pulse of scanning starting signals which respectively correspond to first and second selections of pixel rows for every frame period may be changed alternately every other one.

Further, in anyone of the above-mentioned display devices according to the present invention, a time which is allocated to neither the first selection step nor the second selection step is included in the frame period, and this time may be allocated as a time for holding the display signal supplied in the preceding step in the pixel array.

In the display device according to the second aspect of the present invention, the frequency of the display clock signal maybe set higher than the frequency of the dot clock signal contained in the video control signal.

Further, in a display device which uses a liquid crystal panel as the pixel array and includes a lighting device for irradiating light to the liquid crystal panel, a lighting operation of the lighting device may be controlled by the above-mentioned display control circuit such that the lighting operation is started during the first selection period of pixel rows and is finished during the second selection period of pixel rows for every frame period.

Further, in performing the generation of the display data outside the display device, the display device according to the present invention which includes the pixel array in which a plurality of pixel rows each including a plurality of pixels juxtaposed in a first direction are juxtaposed in a second direction which crosses the first direction and a display control circuit which controls the display operation of the pixel array is driven as follows. That is, the driving method of the display device includes a step of intermittently inputting the display data generated outside the display device to the display device for every frame period, and a step of respectively outputting a scanning clock signal which determines an inputting interval of scanning signals for respectively selecting a plurality of pixel rows to the pixel array for every frame period, a scanning starting signal which starts an operation to select the pixel rows over the pixel array in response to the scanning clock signal (scanning of one screen of pixel array) and a timing signal which determines an interval for supplying display signals which determine display states to the pixel rows (a group of pixels constituting the pixel rows) selected by the scanning signals from the display control circuit. The scanning starting signal is generated such that the scanning starting signal includes a first scanning starting signal which is outputted in response to inputting of the display data to the display device for every frame period and a second scanning starting signal which is outputted after the inputting of the display data to the display device is finished. The display signal is generated such that the display signal includes a first display signal which is inputted to the pixel array in response to the first scanning starting signal and a second display signal which is inputted to the pixel array in response to the second scanning signal voltage. The first display signal is generated in the inside of the display device based on the display data. The second display signal is also generated in the inside of the display device as a signal which makes the display brightness of the pixel array darker after the first display signal is supplied to the pixel array.

In such a driving method of the display device, the number of the pixel rows selected by respective scanning signals during the period in which the second display signal is inputted to the pixel array may be set larger than the number of the pixel rows selected by respective scanning signals during the period in which the first display signal is inputted to the pixel array. Further, the frequency of the scanning clock signal during the period in which the second display signal is inputted to the pixel array may be set higher than the frequency of the scanning clock signal during the period in which the first display signal is inputted to the pixel array.

Further, the frequency of the scanning clock signal may be set higher than the frequency of the timing signal.

The manner of operation and advantageous effects of the present invention, which have been described heretofore, and the details of preferred embodiments thereof will become apparent from the description to follow.

DETAILED DESCRIPTION OF THE INVENTION

Figure 1:
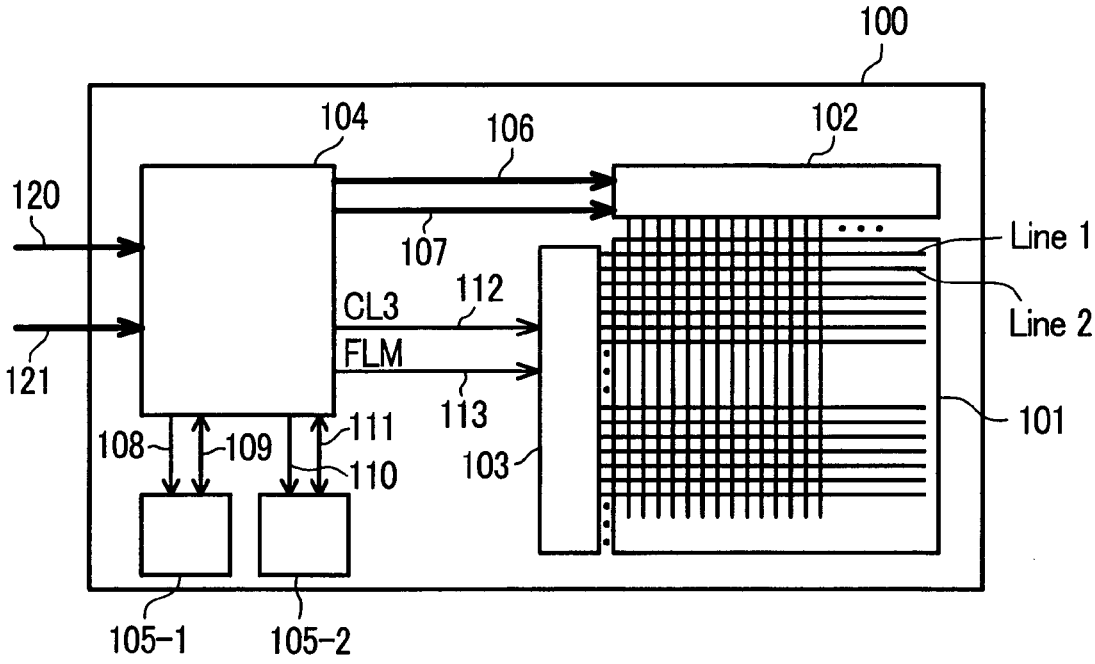
FIG. 1 is a block diagram showing the basic structural features of a display device according to the present invention.

Hereinafter, a display device and a manner of operation of the display device will be explained in detail in conjunction with first to sixth embodiments of the present invention and related drawings. In the drawings, which will be referred to in the explanation of the respective embodiments, parts having the same function are indicated by the same symbol, and their repeated explanation is omitted. Further, although the display device according to the present invention is described as a liquid crystal display device which displays images in a normally black mode in the respective embodiments, it is needless to say that an electroluminescence type display device and a light emitting element array type display device, which adopt the present invention, can be embodied by modifying the pixel structure as mentioned previously.

First Embodiment

Figure 2:
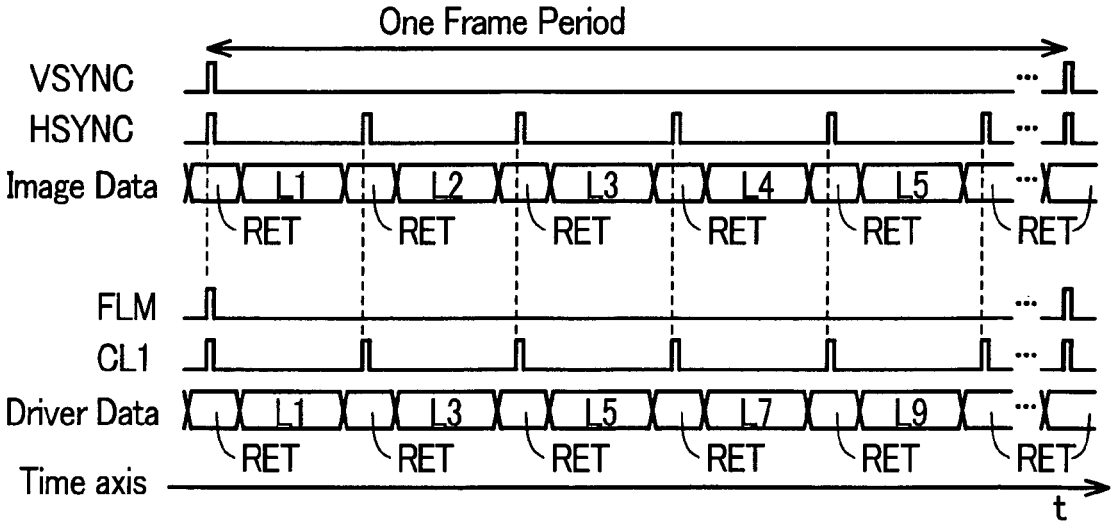
FIG. 2 is a diagram showing one example of the timing of video data inputs to the display device of the present invention and display data outputs from the display device in the first embodiment and the third embodiment.
Figure 27:
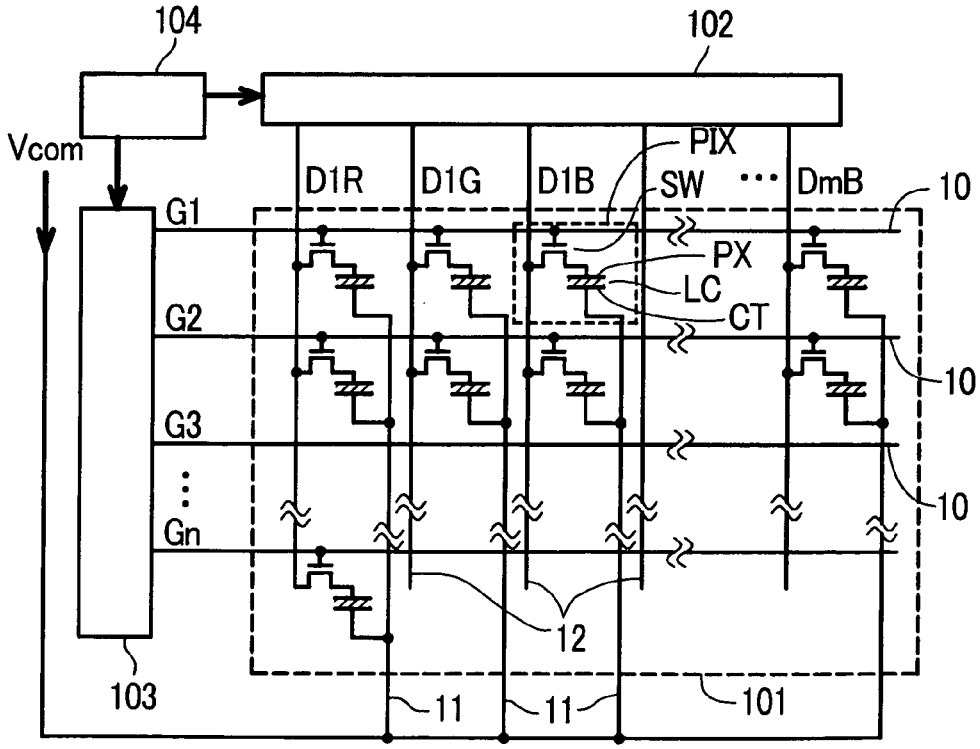
FIG. 27 is a schematic diagram showing one example of a pixel array provided to an active matrix-type display device.

The display device and the driving method thereof according to the first embodiment of the present invention will be explained in conjunction with FIG. 1 to FIG. 6. FIG. 1 is a system block diagram of the display device (liquid crystal display device) according to the present invention, and FIG. 2 is a timing chart showing the waveforms of input signals to a display control circuit provided in the display device and waveforms of output signals from such a display control circuit. The display control circuit is also referred to as a timing controller and is shown as a timing controller 104 in FIG. 1 in the display device of this embodiment, which is provided with a liquid crystal display panel. The pixel array 101, as shown in FIG. 1 (hereinafter referred to as "a TFT-type liquid crystal panel"), as has already been explained in conjunction with FIG. 27, has a plurality of gate lines, which extend in the lateral direction and are juxtaposed in the longitudinal direction (the direction which crosses the lateral direction), a plurality of pixel rows, which are arranged along respective gate lines as well as a plurality of signal lines (also referred to as data lines), which extend in the longitudinal direction and are juxtaposed in the lateral direction, and a plurality of pixel columns, which are arranged along respective signal lines. A pair of gate lines out of a plurality of gate lines which are arranged at an upper end of the pixel array (constituting a screen of the liquid crystal display panel) 101 are denoted as a line 1 and a line 2, respectively.

<Summary of Display Device>

The display device of this embodiment, as shown in FIG. 1, is a liquid crystal display device 100 which is provided with a TFT-type liquid crystal display panel 101 having a resolution of the XGA class. In this display device, video signals 120 that are supplied from a video signal source, such as a television receiver set, a personal computer, a DVD player (Digital Versatile Disc Player) or the like (hereinafter referred to as "video data") to the display device, and control signals 121 which are provided for reproducing images from the video data (hereinafter referred to as "video control signals) are inputted to a timing controller 104 provided in the liquid crystal display device 100. The video control signals 121 include, for example, a vertical synchronizing signal VSYNC, which contains a voltage pulse column responsive to the previously-mentioned vertical frequency, a horizontal synchronizing signal HSYNC, which contains a horizontal synchronizing pulse responsive to the horizontal frequency, a display timing signal DTMG which prevents the display device to recognize horizontal retracing periods and vertical retracing periods which are provided for every horizontal scanning period and every vertical scanning period, and a dot clock signal, which permits the display device to identify individual video information inputted to the display device for every horizontal scanning period.

The timing controller 104 is provided with two memory circuits (also referred to as "frame memories") 105-1, 105-2, wherein the video data 120, which is inputted to the display device, is written in and read out from either one of the two memory circuits 105-1, 105-2 alternately for every frame period (in case of inputting the video data in a progressive method) or for every field period (in case of inputting the video data in accordance with accordance with an interlace method). In this embodiment, for example, the video data 120 that is inputted to the liquid crystal display device 100 during the first frame period is written in the memory circuit 105-1, and, thereafter, the video data 120 inputted to the liquid crystal display device 100 during the second frame period, which follows the first frame period, is written in the memory circuit 105-2. Further, the video data 120 that has been written in the memory circuit 105-1 is read out in a mode suitable for reproduction of images in the liquid crystal display device 100. Then, in the third frame period, which follows the second frame period, the video data 120, that has been inputted to the liquid crystal display device 100 is written in the memory circuit 105-1 and the video data written in the memory circuit 105-2 is read out in a mode suitable for reproduction of images in the liquid crystal display device 100. Such writing of the video data into the memory circuit 105 and the reading out of the video data from the memory circuit 105 are repeated for every frame period. In this embodiment, although two memory circuits 105 are provided for processing the video data, the number of the memory circuits can be suitably changed in response to the functions which the display device is required to have. Here, suffixes -1, -2, which are applied to the reference number 105 indicating the memory circuit, also serve to distinguish between the two memory circuits connected to the timing controller 104 provided in the liquid crystal display device 100 of this embodiment. It will be appreciated that the reference number 105, from which these suffixes are omitted, indicates the memory circuit in general. Further, although the period for inputting the video data 120 to the liquid crystal display device (the above-mentioned vertical scanning period) is referred to as a "frame period" in general, this frame period is to be read as the "field period" when the video data 120 is inputted to the liquid crystal display device 100 in accordance with an interlace method.

The video data 120, which is inputted to the liquid crystal display device 100, is written in or read out from the memory circuit 105-1 through a first port 109 of the timing controller 104 in response to a control signal 108 received in the memory circuit 105-1 for every frame period; or, the video data 120 is written in or read out from the memory circuit 105-2 through a second port 111 of the timing controller 104 in response to a control signal 110 received in the memory circuit 105-2 for every frame period. The writing of the video data into the memory circuits 105-1, 105-2 and the reading out of the video data from the memory circuits 105-1, 105-2 are alternately performed for every other frame, as described above. Accordingly, the control signals 108, 110 are also referred to as frame memory control signals. Further, the writing in and reading out of the video data to and from the memory circuit 105-1 through the first port 109 in response to the control signal 108 and the writing in and reading out of the video data to and from the memory circuit 105-2 through the second port ill in response to the control signal 110 can be performed independently.

<Video Data Processing in Display Control Circuit>

In this embodiment, as shown in FIG. 2, the video data 120 is divided into groups of data L1, L2, L3, . . . in response to a pulse of the horizontal synchronizing signal HSYNC for every horizontal synchronizing signal, and the data is sequentially inputted to the timing controller 104 of the liquid crystal display device 100 (see waveforms of the video data). The data groups L1, L2, L3, . . . are partitioned in the direction of the time axis by the retracing periods (also referred to as the horizontal retracing periods) RET, which are transferred between respective horizontal scanning periods, and they are recognized by the display device for every horizontal scanning period. However, with respect to the so-called driver data, which is transferred from the timing controller 104 to the data driver 102, the data groups in every horizontal scanning period are sequentially outputted from the timing controller 104 for every other horizontal scanning period, such as data groups L1, L3, L5, . . . , for example, for the odd-numbered horizontal scanning periods. The reason why the outputting of the data groups from the timing controller 104 is performed using only a portion of the data groups of the video data inputted to the timing controller 104 will be explained later. However, since the video data which is inputted to the timing controller 104 undergoes a change in the outputting mode thereof in conformity with the reproduction of images in the liquid crystal display device 100, the above-mentioned separate data groups in the horizontal scanning direction which are outputted from the timing controller 104 in response to the frame periods of the video data are collected, and the collected data is hereinafter referred to as display data.

Accordingly, in this embodiment, for example, in the above-mentioned first frame period, only the data group corresponding to the odd-numbered horizontal scanning period of the video data written in the memory circuit 105-1 through the first port 109 is read out from the memory circuit 105-1 through the first port 109 in response to the control signal 108 in the former half of the above-mentioned second frame period, and this data is transferred to the data driver 102 as the driver data for the display data) 106. Further, in the second frame period, only the data group corresponding to the even-numbered horizontal scanning period of the video data written in the memory circuit 105-2 through the second port 111 is read out from the memory circuit 105-2 through the first port 111 in response to the control signal 110 in the former half of the above-mentioned third frame period, and this data is transferred to the data driver 102 as the driver data 106. In this embodiment, the writing of video data to the memory circuit 105-1 through the first port 109 is not performed during reading out of the driver data from the first port 109 in the second frame period. In the same manner, the writing of video data to the memory circuit 105-2 through the second port 111 is also not performed during reading out of the driver data from the first port 110 in the third frame period. In this embodiment, the first-half time zone obtained by dividing the second frame period or the third frame period into halves for every frame period, like the front halves of the second frame period and the third frame period, is referred to as the first field and the latter-half time zone for every frame period is referred to as the second field for the sake of convenience.

The TFT-type pixel array (or the liquid crystal panel) 101 that is provided in the liquid crystal display device 100 according to this embodiment, includes a resolution (definition) of the XGA class in which there are 768 pixel rows, each of which includes a pixel group of 1024 dots in the horizontal direction (the lateral direction in FIG. 1), and these pixel rows are juxtaposed in the vertical direction (the longitudinal direction in FIG. 1). In the type of device which can produce a color video display, each pixel is divided into 3 pixels in the horizontal direction of the liquid crystal panel 101 corresponding to three primary colors of light, for example (the pixels of 3072 dots being arranged in the lateral direction in FIG. 1). In this liquid crystal panel 101, 3072 signal lines (in the case of a liquid crystal panel capable of producing a color video display), which extend in the vertical direction, are juxtaposed in the horizontal direction with respect to respective pixels arranged in the horizontal direction, while 768 gate lines, which extend in the horizontal direction, are juxtaposed in the vertical direction with respect to respective pixel rows arranged in the vertical direction. The liquid crystal panel 101 is provided with a data driver (video signal driving circuit) 102 which supplies voltages corresponding to the display data to respective signal lines, and a scanning driver (scanning signal driving circuit) 103 which supplies voltages corresponding to the scanning signals to respective gate lines. To the data driver 102, in addition to the above-mentioned driver data 106, a data driver driving signal group 107, which generates gray scale voltages to be supplied to respective signal lines based on the driver data 106 in the data driver 102, is transferred from the timing controller 104. The data driver driving signal group 107 includes a horizontal data clock CL1, which allows the data driver 102 to recognize the relationship between the data group contained in the driver data 106 and the horizontal scanning periods corresponding to the respective data group, and a dot clock CL2, which allows the data driver 102 to recognize the relationship between respective data contained in the data group corresponding to respective horizontal scanning periods and the signal lines of the liquid crystal panel 101. Further, a scanning start signal FLM, which instructs the starting and finishing of a series of steps for scanning one screen of the pixel array in response to the data group transmitted from the timing controller 104 for every horizontal scanning period, is also transferred to the data driver 102 when necessary. On the other hand, the scanning clock 112, which selects the pixel row to which the gray scale voltages are supplied in response to the horizontal scanning period, that is, which controls the timing for applying the scanning signals to the gate lines corresponding to respective pixel rows and the scanning start signal 113, are transferred to the scanning driver 103 from the timing controller 104.

As understood from the waveforms of the input data shown in FIG. 2, the video data 120 that is transmitted from the video signal source, such as a television receiver set, a personal computer and a DVD player, are inputted sequentially to the liquid crystal display device 100 together with data L1, L2, L3, . . . for every horizontal scanning period in response to pulses of the horizontal synchronizing signal HSYNC transmitted from the video signal source, and the data is stored in either one of the memory circuits 105-1, 105-2 mounted in the liquid crystal display device 100. The video data 120, that is inputted to the liquid crystal display device 100 for every horizontal scanning period, is conventionally handled as the display data for one line corresponding to every gate line of the liquid crystal display device 100, and the data is used for generation of gray scale voltages supplied to the pixel rows corresponding to respective gate lines. For example, the video data L1, L3, L5, . . . in FIG. 2 are displayed on the pixel rows corresponding to respective pixel arrays of the liquid crystal display device 100 as data of odd-numbered lines, while video data L2, L4, . . . are displayed on the pixel rows corresponding to respective pixel arrays of the liquid crystal display device 100 as data of even-numbered lines. Upon completion of the inputting of a series of data transferred from the video signal line to the liquid crystal display device 100 for every horizontal period, all information for reproducing the image of one screen in the liquid crystal display device 100 is provided. In other words, the inputting of the video data of one frame period to the liquid crystal display device 100 is completed. The inputting of the video data of one frame period to the liquid crystal display device is started in response to the pulse of the vertical synchronizing signal VSYNC transmitted from the video signal source along with the video data and is finished in response to the next pulse of the vertical synchronizing signal VSYNC, which follows the current pulse of this vertical synchronizing signal VSYNC. Further, in response to the next pulse of the vertical synchronizing signal VSYNC, the inputting of the video data of the next one frame period to the liquid crystal display device, which follows this one frame period, is started. Accordingly, one frame period in which the video data of one screen is inputted to the liquid crystal display device substantially corresponds to an interval of the pulse of the vertical synchronizing signal VSYNC, as shown in FIG. 2.

In this embodiment, in place of reading out the video data inputted to the liquid crystal display device for every horizontal scanning period, that is, for every line, as shown in the waveforms of the driver data in FIG. 2, the video data is read out for every odd-numbered or every even-numbered horizontal scanning period (line) so as to generate the driver data (display data). The step for reading out the video data for every odd-numbered or even-numbered horizontal scanning period (line) is performed in response to the pulse of the waveform CL1 of the above-mentioned horizontal data clock. Accordingly, the video data for one frame period that is inputted to the liquid crystal display device is read out as the driver data with the horizontal data clock (CL1) pulse, which is one half of the horizontal synchronizing signal (HSYNC) pulse necessary for writing the video data into the memory circuit 105. Accordingly, when the frequency of the horizontal data clock CL1 is set to a value equal to the frequency of the horizontal synchronizing signal HSYNC, in every frame period, the video data for odd-numbered lines or even-numbered lines in one screen is read out as the driver data (display data used for driving the display device) in the first field period, which is ½ of the frame period.

On the other hand, a series of steps for reading out the video data for odd-numbered lines or even-numbered lines in one screen as the driver data is started in response to the pulse of the scanning start signal FLM and is finished in response to the next pulse of the scanning start signal FLM. Further, in response to the next pulse of the scanning start signal FLM, a series of steps for reading out the next driver data is started. Accordingly, by setting the horizontal data clock CL? and the horizontal synchronizing signal HSYNC to the same frequency (waveforms which generate pulses at the same interval), and by setting the pulse interval of the scanning start signal FLM to ½ of the pulse interval of the vertical synchronizing signal VSYNC, the driver data for one screen is read out twice within one frame period of the video data, and the pixel array is scanned twice with such video information.

In this embodiment, in the state wherein the frequencies of the horizontal data clock CL1 and the scanning start signal FLM are respectively set, the pixel array is not scanned twice using the same video information (based on the driver data read out in the above-mentioned one frame period). That is, the pixel array 101 is scanned once in the beginning of one frame using the video information; and, thereafter, the pixel array 101 is scanned once based on the data which displays the pixel array 101 darker, that is, using the blanking data (or the masking data) based on the video information. Respective display control signals for controlling the video display operation of the pixel array 101, which includes the above-mentioned horizontal data clock CL1, dot clock CL2, scanning start signal FLM and scanning clock (having the waveform CL3 described later) are generated in the timing controller 104, or in the timing controller 104 and circuits arranged in the periphery of the timing controller 104. In this embodiment, these display control signals are generated by making the video control signals which are inputted to the display device (the above-mentioned vertical synchronizing signal VSYNC and the like) pass through a frequency divider or the like together with the video data. However, a portion of the video control signals may be used as the display control signals, and the video control signals may be generated by a pulse oscillator provided inside of the display control circuit or in the periphery of the display control circuit.

As described above, the liquid crystal display device 100 of this embodiment generates the driver data by reading out one half of the video data inputted therein, and, hence, the number of lines becomes smaller than the number of pixel rows of the pixel array 101. However, by inputting respective driver data generated by reading out the video data for one line to a pair of pixel rows which are arranged close to each other in the vertical direction in the pixel array 101, the difference between the number of lines of the driver data and the number of pixel rows (the number of gate lines) of the pixel array 101 can be eliminated. Further, in generating the driver data by reading out an odd-numbered line group and an even-numbered line group of the video data alternately for every other frame period, the quality of the display image can be ensured. Further, by masking the image written in the pixel array 101 for every one frame period using the blanking data, which displays the pixel array darker than the image (black or a color similar to black, for example), the problem of blurring of the profile of an object displayed as an animated image is particularly resolved.

The driver data (the display data which arrange the above-mentioned video data to conform with the operation of the display data) read out as shown in the timing chart of FIG. 2 is converted into gray scale voltages by the data driver 102 in the pixel array 101 and is sequentially outputted to respective signal lines in response to the horizontal data clock CL1. Corresponding to the horizontal scanning period of the pixel array 101 defined between a pair of neighboring pulses of the horizontal data clock CL1, the scanning signal is applied to the gate lines to be selected during respective horizontal scanning periods from the scanning driver 103, and the above-mentioned gray scale voltages are supplied to respective pixels included in the corresponding pixel row. The scanning driver 103 outputs the scanning signals to respective gate lines in response to the pulse of the scanning clock CL3 that is supplied to the scanning driver CL3 from the timing controller 104. As described above, in this embodiment, the video data is read out for every other line and the driver data is generated every horizontal scanning period, and the gray scale voltage which is generated based on the driver data is applied to a pair of neighboring pixels of the pixel row. Accordingly, the liquid crystal display device 100 is driven by a method which is different from the conventional method, in which gate lines are selected one by one for every horizontal scanning period of the pixel array 101. Two examples of a method of driving the liquid crystal display device 100 according to this embodiment are respectively shown in the timing charts in FIG. 3 and FIG. 4. Here, the horizontal scanning period and the vertical scanning period in the display operation of the pixel array 101 are referred to as the horizontal period (the former period) and the vertical period (the latter period) hereinafter to clearly distinguish the horizontal scanning period and the vertical scanning period inputted to the liquid crystal display device 100 together with the above-mentioned video data.

<Driving Example of Pixel Array: First Example>

Figure 3:
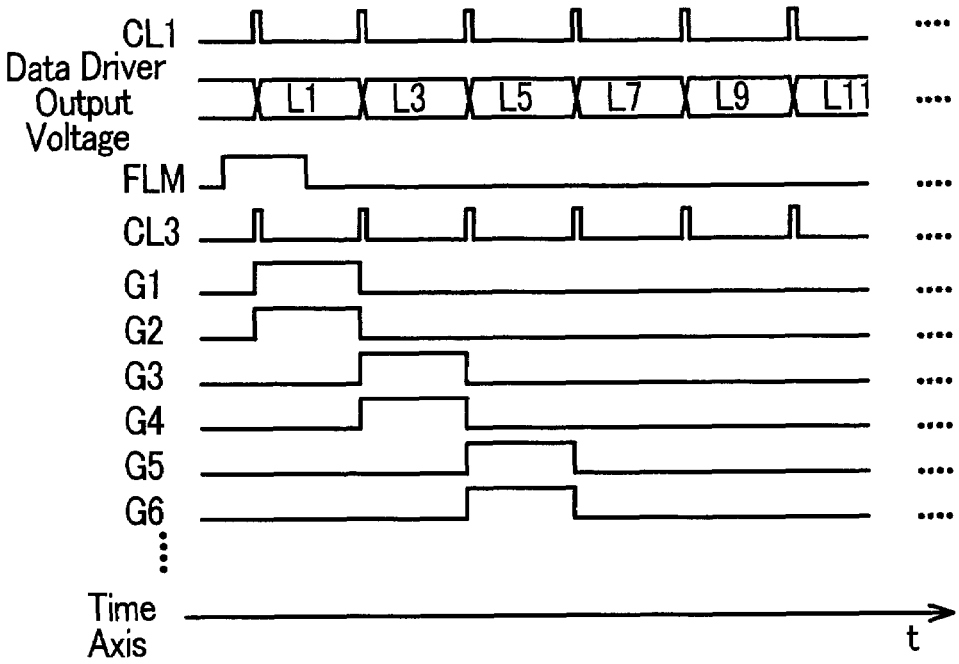
FIG. 3 is a timing chart for selecting scanning lines of a pixel array of the present invention for every two lines.

FIG. 3 shows one example of a method of driving the pixel array (liquid crystal panel) 101 provided with the scanning driver 103, in which the scanning signal (gate selection pulse described later) is applied to a plurality of gate lines in response to one pulse of the scanning clock CL3. A pair of neighboring gate lines, out of the plurality of gate lines (the pixel row corresponding to respective gate lines) which are juxtaposed in the pixel array 101, are sequentially selected along the vertical direction for every pulse of the scanning clock CL3. Such a driving method of the pixel array 101 is also referred to as the scanning of the pixel array due to simultaneous selection of two lines. In the driving method shown in FIG. 3, the frequency of the scanning clock CL3 and the phase of the voltage pulse are made to match those of the horizontal data clock CL1. The interval between a pair of neighboring voltage pulses of the horizontal data clock CL1 corresponds to one horizontal period in the operation of the pixel array. The data driver output voltage shown in FIG. 3 corresponds to a gray scale voltage group generated by the data driver 102 based on the driver data transferred to the data driver 102 from the timing controller 104 for every horizontal period. This gray scale voltage group allows the data driver 102 to recognize elements corresponding to respective signal lines in response to the dot clock CL2 from the driver data for one horizontal period and causes the data driver 102 to set the voltage signal to be applied to the pixels corresponding to respective signal lines for every horizontal period based on the recognition.

The timing charts in FIG. 2 and FIG. 3 partially show the former half (previously mentioned first field) in which, out of data groups for respective lines corresponding to the pulse of the horizontal synchronizing signal HSYNC which constitutes the video data for one frame period inputted to the timing controller 104 in response to the pulse of the vertical synchronizing signal VSYNC, only the data groups corresponding to the odd-numbered lines (the odd-numbered horizontal scanning periods) are read out as the driver data. As described above, since the video data inputted to the liquid crystal display device 100 according to this embodiment is temporarily stored in either one of the memory circuits 105-1, 105-2 provided in the liquid crystal display device 100, the waveforms of the drive data shown in FIG. 2 correspond to other input data which is displayed at least one frame period earlier than the input data shown in FIG. 2. However, the arrangement of the data groups L1, L2, L3, L4, L5, . . . in response to pulses of the horizontal synchronizing signal HSYNC of the video data inputted every frame period and the length of the horizontal retracing periods RET inserted among these data groups are substantially equal.

On the other hand, the data groups L1, L3, L5, L7, L9, of the odd-numbered lines, that are read out as the driver data (display data) in response to the pulse of the horizontal data clock CL1 in the first field of the frame period shown in FIG. 2, are transferred to the data driver 102 so that the waveforms L1, L3, L5, L7, L9, . . . of the data driver output voltages shown in FIG. 3 are generated every horizontal period of the pixel array 101. In FIG. 3, among the data groups L1, L3, L5, L7, L9, . . . which constitute the driver data, the horizontal retracing periods RET are inserted in the same manner as the video data. However, as shown in FIG. 3, these horizontal retracing periods RET are not inserted among the waveforms L1, L3, L5, L7, L9, . . . of the data driver output voltages. In contrast to a cathode ray tube, which sweeps electron beams in the horizontal direction of a screen for every horizontal period, in the hold-type display device, such as a liquid crystal display device which can simultaneously supply gray scale voltages to a plurality of pixels selected for every horizontal period, it is possible to start the outputting of gray scale voltages for the next horizontal period as soon as the outputting of gray scale voltages at one horizontal period is finished, and, hence, it is unnecessary to insert the horizontal retracing periods or the vertical retracing periods among the waveforms of the data driver output voltages.

With respect to the respective data driver output voltages L1, L3, L5, L7, L9, L11, . . . for every horizontal period, the high-level scanning signal is applied to the gate lines within the pixel array sequentially for every two lines, such that the scanning signal is applied to a pair of gate lines G1, G2 that are positioned at the uppermost end (respectively correspond to the line 1, the line 2 in FIG. 1), the scanning line is applied to a next pair of gate lines G3, G4, and the scanning signal is applied to a further next pair of gate lines G5, G6. The waveforms of the scanning signals applied to respective gate lines are indicated at the right side of addresses G1, G2, G3, G4, G5, G6, . . . of respective gate lines, and only the gate lines whose level is High are selected, while the gate lines whose level is Low are not selected. Such pulse-like waveforms (period in which the scanning signal assumes the High-level in FIG. 3) that are generated with respect to respective scanning signals of the gate lines n are also referred to as gate selection pulses and are generated by the scanning driver 103 in response to the pulse of the scanning clock CL3 transmitted from the timing controller 104. Although the usual scanning driver 103 outputs the gate selection pulse to one gate line for every pulse of the scanning clock CL3, the scanning driver 103 that is used in the driving method shown in FIG. 3 can output the gate selection pulse to a plurality of gate lines for every pulse of the scanning clock CL3 depending on the setting of an operation mode thereof. Further, a series of steps for sequentially selecting respective pairs of gate lines from a pair of gate lines G1, G2 is started in response to the pulse of the scanning starting signal FLM (the period in which the waveform assumes the High-level in FIG. 3). As described above, since the pixel array 101, having a resolution of the XGA class, is mounted on the liquid crystal display device 100 of this embodiment, the selection of 768 gate lines (768 rows of pixels) which are juxtaposed in the vertical direction of the display screen is completed with 384 pulses, which are generated in the scanning clocks CL3. Further, the driver data L1, L3, L5, L7, L9, . . . shown in FIG. 2 is read out. Further, in the next frame period (the first field), which follows the frame period in which the data driver output voltages L1, L3, L5, L7, L9, . . . are applied to respective signal lines, as shown in FIG. 3, the driver data L2, L4, L6, L8, . . . , which correspond only to video data of even-numbered lines, are read out and the data driver output voltages L2, L4, L6, L8, . . . are applied to respective signal lines.

<Driving Example of Pixel Array: Second Example>

Figure 4:
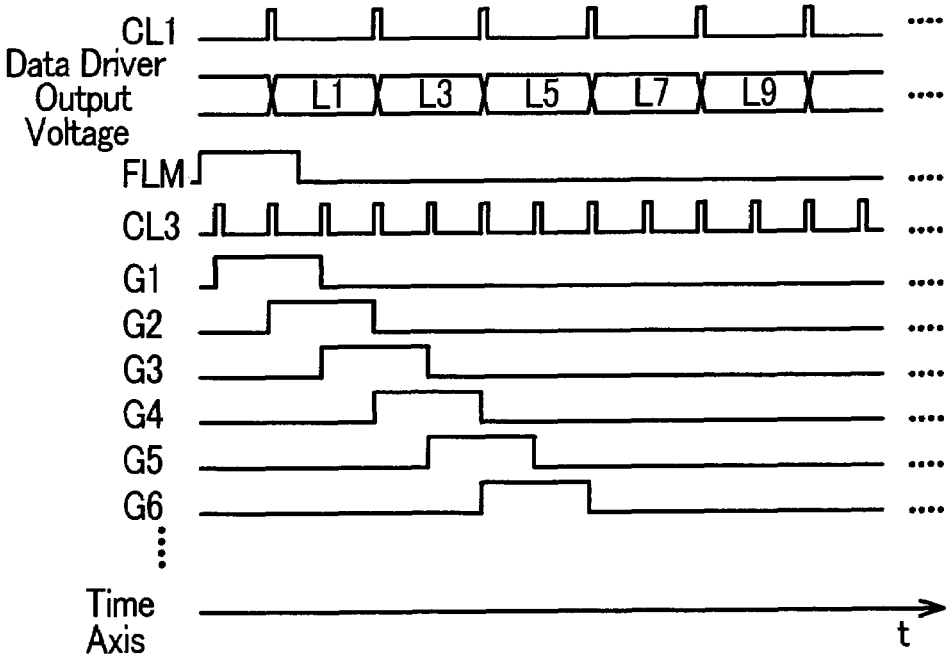
FIG. 4 is a timing chart for selecting two scanning lines of a pixel array for every outputting of a display signal to the pixel array of the present invention.

On the other hand, FIG. 4 shows an example of a method of driving the pixel array (liquid crystal panel) 101 provided with a scanning driver 103 that is capable of performing a shift register operation which has no two-line simultaneous selection Function. In this driving example, the frequency of the scanning clock CL3 is set to a value twice as large as the frequency of the horizontal data clock CL1, and a pulse thereof is generated twice for every horizontal period of the pixel array. Also, in this driving example, in the first field of the frame period shown in FIG. 2, the data groups of the odd-numbered lines of the video data L1, L3, L5, L7, L9, . . . are read out as the driver data in response to the pulse of the horizontal data clock C11 and are transferred to the data driver 102, and the waveforms L1, L3, L5, L7, L9 . . . of the data driver output voltages shown in FIG. 4 are generated for every horizontal period of the pixel array. Further, in the next frame period (the first field thereof) which follows the frame period in which the driver data L1, L3, L5, L7, L9, . . . shown in FIG. 2 are read out, the driver data L2, L4, L6, L8, . . . , which correspond only to the video data for even-numbered lines, are transferred to the scanning driver 103, and the data driver output voltages shown in FIG. 4 are also converted into voltages corresponding to the driver data L2, L4, L6, L8 . . . .

In the driving example shown in FIG. 4, the frequency of the horizontal data clock CL1 is set to a value equal to the frequency of the horizontal synchronizing signal HSYNC of the video data 120 inputted to the liquid crystal display device 100 and the gray scale voltage groups, which are applied to respective pixel rows, are outputted from the data driver 102 during the horizontal period equal to the horizontal scanning period of the video data (input data in FIG. 2). Respective data driver output voltages L1, L3, L5, L7, L9, . . . , which are outputted to respective signal lines from the data driver 102 for every horizontal period defined by the pulse interval of the horizontal data clock signal CL1, are inputted to the pixel group (constituting two pixel rows) corresponding to two gate lines. However, in contrast to the driving example shown in FIG. 3, to the pixel rows which are arranged as every other row (for example, the odd-numbered pixel rows), two data driver output voltages, which are outputted during a pair of continuous horizontal periods, are inputted. Since the scanning driver 103 used in the driving example shown in FIG. 4 cannot output the gate selection pulse to a plurality of the gate lines in response to one pulse of the scanning clock CL3, the output interval of the gate selection pulses applied to every one gate line is made short. Accordingly, by setting the frequency of the scanning clock CL3 higher than the frequency of the horizontal data clock CL1, the scanning of one screen of the pixel array is arranged to follow the outputting of a series of gray scale voltages (for example, the data driver output voltages L1, L3, L5, L7, L9 . . . ) from the data driver 102, which is completed within the first fields of respective frame periods. However, when the frequency of the scanning clock CL3 is set to a value that is twice as large as the frequency of the horizontal data clock CL1, and the gate selection pulses applied to respective gate lines are generated in response to the (N)th (N being a natural number) pulse of the scanning clock CL3 and are cancelled in response to the (N+1)th pulse of the scanning clock CL3, the time during which the data driver output voltage is supplied to respective pixel rows is also shortened, and, hence, the brightness of the image displayed on the screen for every frame period becomes short.

In contrast, in the driving example shown in FIG. 4, the gate selection pulse for every gate line is generated in response to the (N)th pulse of the scanning clock CL3 and is cancelled corresponding to the (N+2)th pulse of the scanning clock CL3; and, hence, the period in which this gate selection pulse is applied to the gate lines is prolonged to a length equal to one horizontal period of the pixel array in the same manner as the driving example shown in FIG. 3. Accordingly, the gate selection pulse is applied to one group of gate lines in response to one horizontal period (pulse of the horizontal data clock CL1), and the gate selection pulse is applied to another group of gate lines by shifting the phase from the pulse of the horizontal data clock CL1. In the driving example shown in FIG. 4, the gate selection pulse is sequentially applied to the even-numbered gate line groups G2, G4, G6, . . . in synchronism with the pulse of the horizontal data clock CL1, and the gate selection pulse is sequentially applied to the odd-numbered gate line groups G1, G3, G5, . . . at a timing earlier than the pulse of the horizontal data clock CL? by ½ of one horizontal period. Accordingly, in the latter case, for example, the data driver output voltages L1 and L3 are applied to the pixel row corresponding to the gate line G3, and the data driver output voltages L3 and L5 are applied to the pixel row corresponding to the gate line G5. The gate selection pulse is not limited to the driving example shown in the timing chart of FIG. 4. For example, the gate selection pulse may be sequentially applied to the odd-numbered gate line groups G1, G3, G5, . . . in synchronism with the pulse of the horizontal data clock CL1, and the gate selection pulse is sequentially applied to the even-numbered gate line groups G2, G4, G6, . . . at a timing later than the pulse of the horizontal data clock CL1 by ½ of one horizontal period.

In this manner, by inputting the data driver output voltages (gray scale voltages) respectively corresponding to a pair of continuous horizontal periods to the pixel rows which are arranged at every other row, it is possible to enhance the apparent resolution in the vertical direction of the screen compared to a case in which the same data driver output voltage is applied to every pixel row of two rows, as in the case of the driving example shown in FIG. 3. In the driving example shown in FIG. 4, of the data driver output voltages, for example, the output voltage L3 is supplied to the pixel rows corresponding to two lines G3, C4 out of the gate lines in the former half of the horizontal period corresponding to the output voltage L3, and it is supplied to the pixel rows corresponding to two lines C4, G5 out of gate lines in the latter half of such a horizontal period. Accordingly, although the driving example shown in FIG. 4 differs from the driving example shown in FIG. 3, the image is formed on the screen based on a pseudo 2-line simultaneous selection. Further, to the pixel row corresponding to the gate line G1, only the data driver output voltage L1 is supplied within the time corresponding to ½ of the horizontal period, and, hence, the shortage of brightness must be considered. However, since this pixel row is arranged at an end portion of the pixel array, the shortage of brightness is hardly recognized by a user of the display device.

<Image Display Timing>

Figure 5:
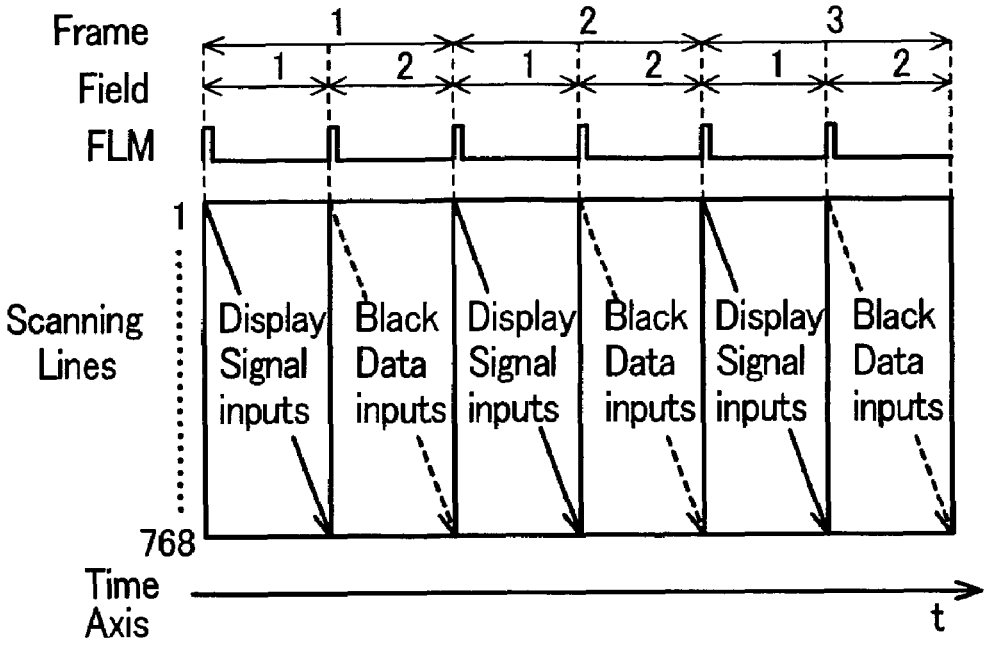
FIG. 5 is a diagram showing the display timing of the first embodiment of the display device of the present invention for every frame period.

In this embodiment, the liquid crystal display device is driven by any one of the above-mentioned methods in conjunction with FIG. 3 and FIG. 4, wherein, with respect to every frame period of the video data to be inputted to the liquid crystal display device, the image based on the video data is generated in the pixel array in the former half (the first field) of the frame period, and the image formed in the first field is masked, in a sense, by the blanking data in the latter half (the second field). The timing chart in FIG. 5 shows the summary of steps for generating images in respective frame periods and for masking the images by taking three continuous frame periods along a time axis (each frame period being indicated by a line having arrows attached to both ends thereof). For facilitating an understanding of the explanation, three respective frame periods shown in FIG. 5 are named as the first frame period, the second frame period and the third frame period from the left side of FIG. 5 corresponding to numbers given to the upper sides of the lines indicating respective frame periods.

Each one of the first frame period, the second frame period and the third frame period shown in FIG. 5 is further divided into a first field and a second field which follows the first field. Each one of the first field and the second field is indicated by a line having arrows attached to both ends thereof and is identified by the number given above the line. As can be clearly understood from FIG. 5, in response to a pulse (the first pulse) of the scanning starting signal FLM generated at the start of each frame period, the first field is started, and, in response to a pulse (second pulse) of the scanning starting signal FLM generated following the first pulse, the first field is finished and the second field is started. Further, in response to the pulse which is generated following the second pulse of the scanning starting signal FLM, the frame period is finished along with the second field thereof, and the next frame period is started along with the first field thereof. The changeover of the first field and the second field in response to every pulse FLM of the scanning starting signal is repeated for every frame period.

As previously mentioned, a series of steps for sequentially selecting the gate lines of the pixel array 101 are started in response to the pulse of the scanning starting signal FLM (period in which the waveform assumes the High-level in FIG. 5). Also in the driving example shown in FIG. 3, which sequentially selects the gate lines of the pixel array every two other lines, as well as in the driving example shown in FIG. 4, in which the gate lines of the pixel array are sequentially selected for every one line in response to the scanning clock having a frequency higher than that of the horizontal data clock CL1, the scanning of the whole pixel array region (inputting of the image for one screen into the pixel array) is completed within the time corresponding to ½ of one frame period (in both of the above-mentioned first field and second field). Accordingly, in the first field, which is started in response to the pulse of the scanning starting signal FLM, it is possible to perform a series of steps, in which the video data corresponding to the odd-numbered lines or the even-numbered lines are read out as driver data, and the gray scale voltage groups (indicated as the data driver output voltages in FIG. 3 and FIG. 4) corresponding to the driver data are sequentially outputted to respective signal lines of the pixel array, in response to the pulse of the horizontal data clock CL1, which correspond to or are synchronized with a series of steps which sequentially selects the gate lines of the pixel array by the driving examples shown in FIG. 3 and FIG. 4, whereby respective steps are completed at a point of time that the first field is finished. As mentioned above, since there may be a case in which the video data is inputted to the display device in such a manner that the video data is disconnected for every frame period by the vertical retracing periods, the finishing times of respective steps come earlier than the finishing time (determined as ½ of the frame period of the video data).

In this embodiment, the video data 120, which is inputted to the liquid crystal display device 100, is alternately stored in the memory circuits 105-1, 105-2 for every frame period. Further, for every frame period, in the first field, the video data corresponding to the odd-numbered lines or the even-numbered lines is read out from the memory circuit 105 in which the video data is stored by the timing controller 104 as driver data 106, and this data is transferred to the data driver 102; thereafter, the gray scale voltage groups corresponding to the driver data are sequentially outputted from the data driver 102 for every horizontal period. Outputting of the gray scale voltages is performed in response to the gate line selection step in the pixel array, as shown in FIG. 3 or FIG. 4 (often in synchronism with the driving example shown in FIG. 3). In this manner, inputting of the image into the pixel array in the first field is completed. The image is formed based on the image data inputted to the display device, as mentioned above. For facilitating an understanding of the explanation, the gray scale voltages which are supplied to respective pixels formed in the pixel array in the first field are referred to as "the first gray scale voltages", and the first gray scale voltages which are supplied to all pixels in the pixel array are referred to as "the first gray scale voltage group" collectively.

In the second field (the latter half of the frame period in this embodiment) which follows the first field, the gray scale voltage groups which are different from the first gray scale voltage groups are outputted from the data driver 102 for every horizontal period in response to the gate line selection step of the pixel array, as shown in FIG. 3 and FIG. 4. At least one of the gray scale voltages supplied to respective pixels of the pixel array in the second field (hereinafter referred to as "second gray scale voltage") is set to make the pixel darker than the corresponding first gray scale voltage (supplied to the pixel of the same address in the first field). For facilitating an understanding of the explanation, the second gray scale voltages which are supplied to all pixels in the pixel array in the second field are referred to as "the second gray scale voltage group" collectively. For example, the second gray scale voltages, which constitute the second gray scale voltage group, are set to a voltage value which displays the pixels in black (by minimizing the optical transmissivity of the liquid crystal layer in case of the liquid crystal display device) or a voltage value which displays the pixels in color lower than a given gray scale (gray close to black) (by suppressing the optical transmissivity of the liquid crystal layer to a given low value in case of the liquid crystal display device). The second gray scale voltage group in the former example is also referred to as "black data" or "black voltage", while the second gray scale voltage group in the latter example is also referred to as "gray data" or "gray voltage". The voltage values of the second gray scale voltages which constitute the second gray scale voltage group may take values other than the above-mentioned set value. For example, a portion of the second gray scale voltages may be set different from other second gray scale voltages depending on the pixels to which such voltages are supplied. In this case, corresponding to the content of the driver data read out from the first field period, the black voltage is applied to the pixels (or pixel group) which are displayed outstandingly brighter than other pixels in the first gray scale voltages as the second gray scale voltages, and the gray voltage is applied to other pixels as the second gray scale voltages. Further, the gray voltage is applied to the pixels (or pixel group) which are displayed dark in the first gray scale voltages as the second gray scale voltages, and the black voltage is applied to other pixels as the second gray scale voltages.

In this embodiment, the pixel array is scanned with the above-mentioned second gray scale voltage group so as to reduce the brightness of the whole region of the pixel array, and the image displayed on the pixel array with the first gray scale voltage group is covered with black or a color similar to black. Due to such a constitution, for every frame period, the image displayed using the first gray scale voltage group is cancelled from the screen using the second gray scale voltage group, and, hence, the image which changes for every frame period is formed ma state similar to that of the impulse display. Accordingly, the image formed by the pixel array using the second gray scale voltage group is also referred to as "a blanking image" and the data which makes the data driver 102 output the second gray scale voltage group is also referred to as "blanking data". The blanking data may be, in the same manner as the driver data corresponding to the first gray scale voltage group, formed in the timing controller 104 or in the vicinity of the timing controller 104 and may be transferred to the data driver 102. Further, the blanking data may be preliminarily stored in the data driver 102. For example, to make the data driver 102 output the second gray scale voltage group, which makes the pixel array uniformly black (for example, all of the second gray scale voltages indicating black voltage or gray voltage), in response to the pulse of the scanning starting signal FLM, which starts the second field, given second gray scale voltages may be continuously outputted from respective output terminals of the data driver 102 until the second field is finished. In this specification, to collectively express the above-mentioned various methods for outputting the second gray scale voltage group, the display operation of the pixel array in the second field in this embodiment is defined as the blanking image display or the image display based on blanking data, and the second gray scale voltage is defined as the gray scale voltage generated based on the blanking data.

In this embodiment, which uses a liquid crystal panel having a resolution of the XGA class as the pixel array 101, by performing an operation which follows the driving example shown in FIG. 3, using the horizontal data clock CL1 and the 384 pulses of the scanning clock CL3, the image display based on the video data in the first field and the blanking display based on the blanking data in the second field are respectively completed. Further, in this liquid crystal panel, due to an operation which follows the driving example shown in FIG. 4, using 384 pulses of the horizontal data clock CL1 and the 768 pulses of the scanning clock CL3, the image display in the first field and the blanking display in the second field are respectively completed.

The scanning of the pixel array corresponding to one screen using the first gray scale voltage group (generated based on the video data) in the first field and the scanning of the pixel array corresponding to one screen using the second gray scale voltage group (generated based on the blanking data) in the above-mentioned second field, which follows the first field, are repeated in the first frame period, the second frame period and the third frame period, as shown in FIG. 5. However, the generation of the first gray scale voltage group in the first field in these frame periods is alternately changed for every frame period. In the first frame period and the third frame period, corresponding to the first frame period or the third frame period, either one of the video data for odd-numbered lines and the video data for even-numbered lines, which are stored in one of two memory circuits 105-1, 105-2, are read out, and the first gray scale voltage group is generated. In the second frame period, corresponding to this frame period, another of the video data for odd-numbered lines and the video data for even-numbered lines, which are stored in another of two memory circuits 105-1, 105-2, are read out, and the first gray scale voltage group is generated.

With respect to the inputting of the first gray scale voltage group to the pixel array in the first field (Display signal input in FIG. 5) and the inputting of the second gray scale voltage group to the pixel array in the second field (black data inputting in FIG. 5), the response of the pixel array to brightness differs depending on the type of the pixel array. Contrary to the display device which is provided with an electroluminescence element or a light emitting diode for every pixel, in a liquid crystal display device which uses a liquid crystal panel as the pixel array 101, the optical transmissivity of the liquid crystal layer corresponding to respective pixels exhibits a logarithmic functional change based on a certain time constant with respect to the change of an electric field applied to the liquid crystal layer.

Figure 6:
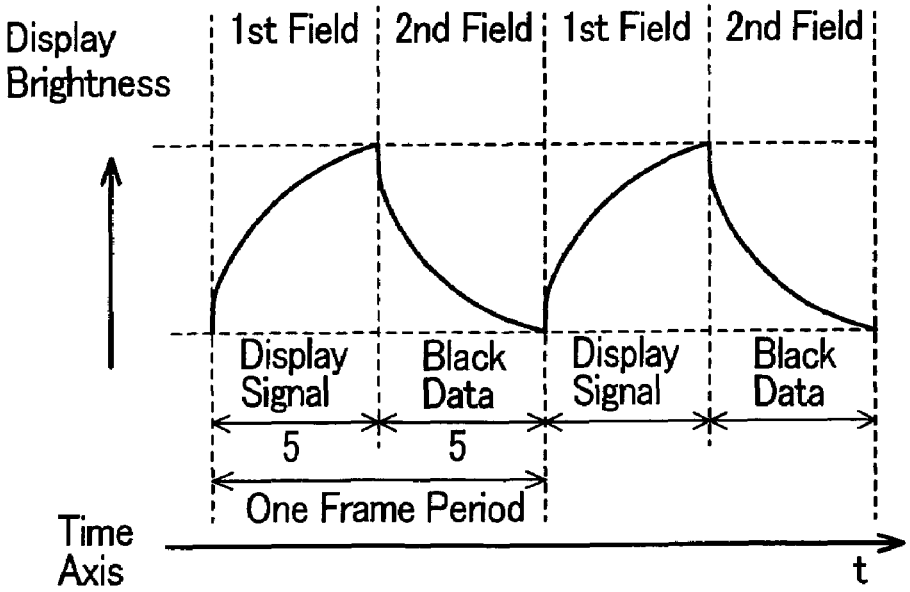
FIG. 6 is a diagram showing the brightness response corresponding to the display timing of the first embodiment of the display device of the present invention.

Accordingly, the response of the display brightness of the pixel in a series of display operations for every frame period shown in FIG. 5 is also expressed as shown in FIG. 6, for example.

The pixel array (liquid crystal panel) 101 used in this embodiment is operated in the normally black display mode, and, hence, when the difference between the gray scale voltage applied to the pixel (applied to the pixel electrode PX in FIG. 27) and the reference voltage (applied to the counter electrode CT in FIG. 27) becomes minimum (a so-called display OFF state), the pixel is displayed in black, and when the difference becomes maximum (a so-called display ON state), the pixel is displayed in white. When a current quantity supplied to the pixel electrode PX through the switching element SW is minimum, the pixel is displayed in black, and when the current quantity is maximum, the pixel is displayed in white; and, hence, the former display state corresponds to the display OFF data supplied to the pixel array, and the latter display state corresponds to the display ON data supplied to the pixel array. The electroluminescence type display device and the light emitting element array type display device also Function in the normally black display mode as mentioned previously. The response of display brightness according to the present embodiment shown in FIG. 6 is obtained by displaying, in two respective continuous frame periods, the display ON data on the pixels as the image data in the first field and the display OFF data on the pixels as the black data in the second field.

Although the display brightness exhibits a gentle logarithmic functional rise in the beginning of the first field, when the first gray scale voltage (the voltage corresponding to the display ON data) is applied to the pixel electrodes, the display brightness reaches a desired level by the time that the first field is finished. Further, although the display brightness exhibits a gentle logarithmic functional attenuation in the beginning of the second field, when the second gray scale voltage (the voltage corresponding to the display OFF data) is applied to the pixel electrodes, the display brightness reaches a level which makes the pixels exhibit black by the time that the second field is finished. In this manner, to describe the change of the display brightness of the pixels with respect to time, the level which makes the pixels produce a white display in the first field and the level which makes the pixels produce a black display in the second field are not formed in rectangular waves. However, the brightness of the pixels which is observed through one frame period is changed such that the brightness responds to the video data in the former half and responds to the black level in the latter half. Therefore, according to this embodiment, also in a hold-type display device, such as a liquid crystal display device, it is possible to perform a so-called impulse-type image display so that the blurring of animated images generated on the screen can be reduced. Here, in this embodiment, the display period for video data and the display period for blanking data in one frame period are respectively set to 50% of the frame period. However, by setting the frequency of the scanning clock CL3 in the display period for blanking data higher than the corresponding frequency in the display period for video data, or by allowing the selection of the gate lines in the display period for video data to correspond to a plurality of pulses of the scanning clock CL3, the rate of the display period for video data in one frame period can be increased, thus increasing the brightness of the display image.

Second Embodiment

Hereinafter, the second embodiment of the present invention will be explained in conjunction with FIG. 1, FIG. 3, FIG. 4 and FIG. 7 to FIG. 9.

In this embodiment, a display device corresponding substantially to the liquid crystal display device 100 of the first embodiment is used. However, as can be readily understood from the respective waveforms of an input signal to the timing controller 104 and an output signal from the timing controller 104 provided to the display device shown in a timing chart of FIG. 7, the horizontal retracing periods RET of driver data (display data read out from the memory circuit 105 as the output signal) are set to be shorter than horizontal retracing periods RET of the input data (video data inputted to the memory circuit 105 as the input signal). Due to such a constitution, the reading-out of the driver data and the transfer of the driver data to the data driver 102 in this embodiment can be completed within a time shorter than the time necessary for corresponding operations in the first embodiment, which was explained in conjunction with the timing chart shown in FIG. 2, and, hence, the first field described in the first embodiment is made shorter than ½ of one frame period in this embodiment. Accordingly, in this embodiment, even when the scanning of the pixel array using the blanking data in the second field is performed at the timing of the above-mentioned first embodiment, the display operation of the pixel array in the first field and the second field during one frame period is finished earlier than this one frame period. That is, according to this embodiment, there is an extra time which belongs to neither of the first field nor the second field for every frame period.

<Video Data Processing in Display Control Circuit>

In this embodiment, by providing the extra time with respect to the operation period of the display device consisting of the first field and the second field for every frame period, the image formed in the pixel array in the first field is held in the screen by this extra time before the second field is covered with the blanking image. Accordingly, in making the pixel array 101, that is formed of a liquid crystal panel having a resolution of the XGA class, operate while following the driving example of FIG. 3, the frequency of the horizontal data clock CL? and the scanning clock CL3 is set to a value 1.25 times larger than the frequency thereof in the first embodiment. Then, the first field is completed with respective 384 pulses of the horizontal data clock CL1 and scanning clock CL3. Thereafter, the scanning of the pixel array is stopped with respective 192 pulses of the horizontal data clock CL1 and the scanning clock CL3. Further, the second field is completed with respective 384 pulses of the horizontal data clock CL1 and scanning clock CL3. Accordingly, it is possible to respectively allocate 60% of one frame period to the display of video data and the remaining 40% of one frame period to the display of blanking data. In this embodiment, in the same manner as the first embodiment, the period in which the video data is inputted (written) into the pixel array in one frame period is defined as the first field. However, the period which follows the first field and in which the scanning of the pixel array is stopped is defined as the second field, and the period which is defined as the second field in the first embodiment and which inputs (writes) the blanking data into the pixel array is newly defined as the third field.

Figure 7:
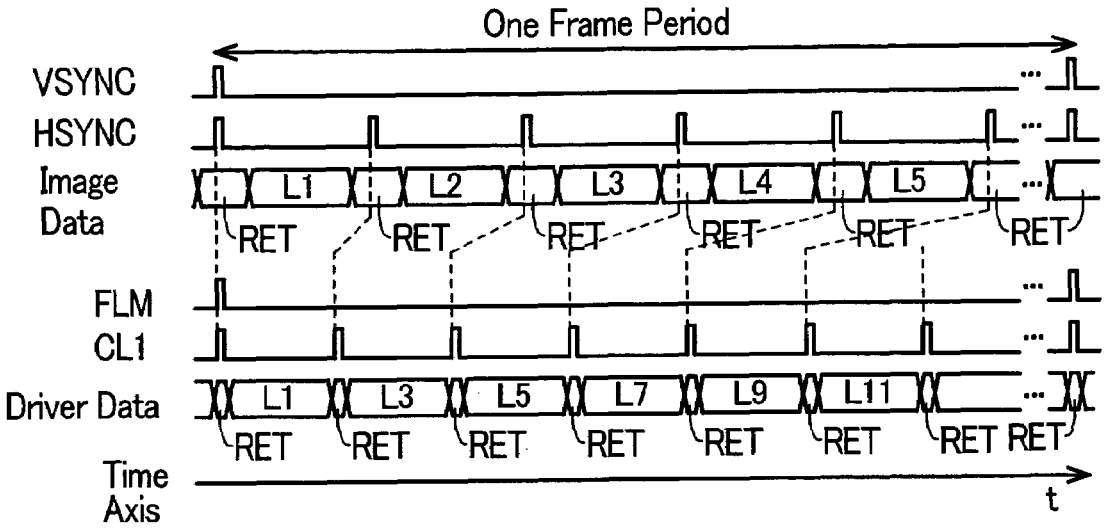
FIG. 7 is a diagram showing the timing of video data inputs to the display device of the present invention and display data outputs from the display device in the second embodiment.

In this embodiment, to set the finishing time of the frame period to be earlier by allocating portions of the retracing periods RET of the video data inputted to the display device in the above-mentioned manner to reading-out of the driver data for every frame period, the horizontal period in which the pixel array is scanned using the driver data is set to be shorter than the horizontal scanning period in which the video data is inputted to the display device. As shown in FIG. 7, in an example of processing to shorten the retracing periods RET of the driver data with respect to the retracing periods RET of the input data, the number of pulses of the dot clock CL2 which are transferred to the data driver 102 together with the driver data 106 (contained in a data driver driving signal group 107) corresponding to the retracting periods is set to be smaller than the number of pulses of the dot clock signal DOTCLK which are used for inputting the video data 120 to the display device (previously mentioned as one of video control signals 121) corresponding to the retracing period. This dot clock CL2 determines an interval between outputting of the gray scale voltage group from the data driver 102 during a certain horizontal period and outputting of the gray scale voltage group from the data driver 102 during a subsequent horizontal period in the pixel array including the retracing period inserted into the interval. Further, the pulse interval of the horizontal data clock CL1 is also determined in response to this interval. Still further, the pulse interval (selection timing of gate lines) of the scanning clock CL3 is also determined in response to this interval. Accordingly, when the liquid crystal display device used in the first embodiment is used in this embodiment, the timing controller 104 provided in such a liquid crystal display device performs timing control that is different from the timing control of the first embodiment. For example, in this embodiment, the respective frequencies of the horizontal data clock CL1 and the scanning clock CL3 with respect to the horizontal scanning period HSYNC for inputting the video data are set to be higher than the corresponding frequencies of the first embodiment in both a case in which the operation of the pixel array follows the driving example shown in FIG. 3 and a case in which the operation of the pixel array follows the driving examples shown in FIG. 4.

Further, in this embodiment, as mentioned above, one frame period is divided into three fields, wherein the video data is written in the pixel array in the first field, the image generated by the writing is held in the pixel array in the next second field, and finally the blanking data is written in the pixel array in the third field so as to cover the image with the blanking image.

When this embodiment uses a display device corresponding to the device used in the first embodiment, which is provided with the timing controller 104 having two memory circuits 105 which can independently perform writing and reading of the video data, the timing controller 104, for every frame period, writes the video data inputted to the display device to one of the memory circuits 105-1, 105-2 through the first port 109 or the second port 111; and, at the same time, reads out the video data written in another of the memory circuits 105-1, 105-2 in the first filed during the previous frame period. In this embodiment, which allocates 40% of one frame period to the display operation of the first field, the video data is read out as driver data for every other line with the time corresponding to about 40% of the time for writing the video data into the memory circuit 105 for every line. In this embodiment, in the same manner as the first embodiment, the step, in which the video data corresponding to the odd-numbered lines are read out during a certain frame period and the video data for even-numbered lines are read out in the next frame period, is repeated for every frame. Further, the gray scale voltage group (the driver output voltage to respective data lines) is generated one by one based on the driver data read out for every one line in the first field during each frame period, and each gray scale voltage group is outputted to two lines of the pixel array (two rows in the pixel rows) corresponding to the driving example shown in FIG. 3 or FIG. 4 in the same manner as the first embodiment. That is, also in this embodiment, the pixel array is subjected to so-called two line simultaneous selection driving. However, compared to the first embodiment, which allocates the period corresponding to 50% of one frame period to these operations (display operations for one screen of the pixel array), this embodiment allocates the period corresponding to 40% of one frame period to these operations.

In this embodiment, the image which is generated in the pixel array (liquid crystal panel) 101 during the period corresponding to 40% of one frame period is continuously displayed through the subsequent period (second field), which corresponds to 20% of one frame period, and the pixel array (liquid crystal panel) 101 is subjected to the blanking display during the period (the third field) which follows the second field and corresponds to 40% of one frame period. This blanking display operation may be performed by supplying the blanking data to the data driver 102 from the timing controller 104 in the same manner as the first embodiment, or it may be performed by generating the gray scale voltage group for blanking display in the data driver 102 per se in response to the pulse of the scanning starting signal FLM, which will be described later.

In this embodiment, not only with respect to the above-mentioned image display in the first field but also with respect to the image display (blanking display) in the third field, the retracing periods in each horizontal period of the pixel array are set to be shorter than the horizontal retracing period of the video data inputted to the display device, as shown in FIG. 7. That is, outputting of the gray scale voltages to the whole region of the pixel array from the data driver 102 in response to the blanking data in the third field is also performed within 40% of one frame period. Here, also in the third field, in the same manner as the first field, in accordance with the driving example shown in FIG. 3 or FIG. 4, so-called two line simultaneous selection driving is performed such that two lines out of the gate lines (scanning lines) (two rows in the pixel rows corresponding to these gate lines) of the pixel array are selected by the scanning driver 103 for every outputting of the gray scale voltages.

In the second field of this embodiment, to hold the image formed in the pixel array 101 in the first field, it is preferable to stop the selection of pixel rows by the scanning driver 103. As mentioned above, the selection of the gate lines (and the pixel rows corresponding to the gate lines) for one screen of the pixel array by the scanning driver 103 in response to the scanning clock CL3 is started in response to the pulse of the scanning starting signal FLM. Accordingly in this embodiment, this pulse is generated at the time of starting the first field and the third filed, respectively, or the pulse of the scanning starting signal FLM is generated for every period corresponding to 20% of one frame period, and the scanning driver 103 is made to respond to only the pulse which corresponds to starting of the first field and the third field. Therefore, in this embodiment, it is preferable that the pulse interval of the horizontal data clock CL1 that is supplied to the data driver 102 from the timing controller 104 is narrowed by an amount that the retracing period is made shorter than the horizontal synchronizing signal HSYNC, the pulse interval of the scanning clock supplied to the scanning driver 103 from the timing controller 104 is adjusted in conformity with the pulse interval of the horizontal data clock CL1, and, at the same time, the pulse interval of the scanning starting signals FLM supplied to the scanning drive 103 is also adjusted using a method different from the method used in the first embodiment.

<Image Display Timing and Control Thereof>

Figure 8:
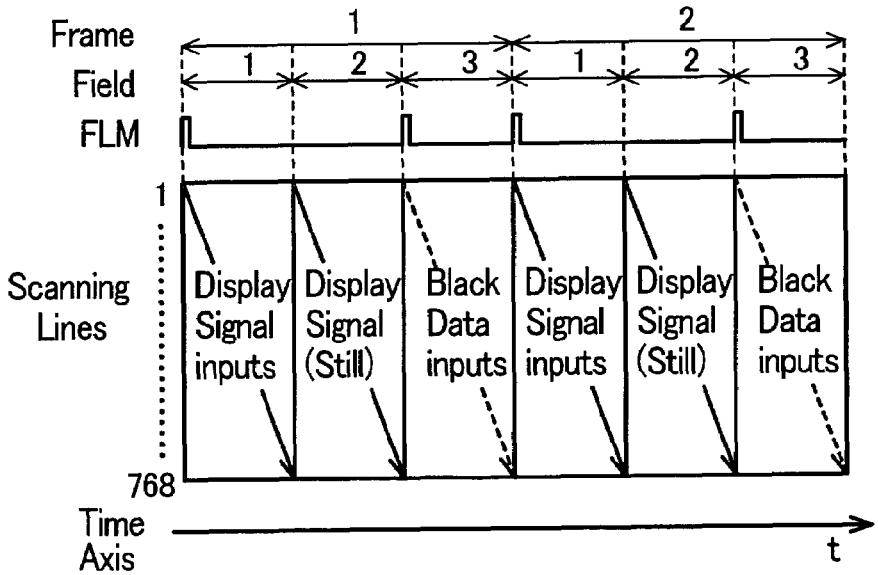
FIG. 8 is a diagram showing the display timing of the second embodiment of the display device according to the present invention for every frame period.
Figure 9:
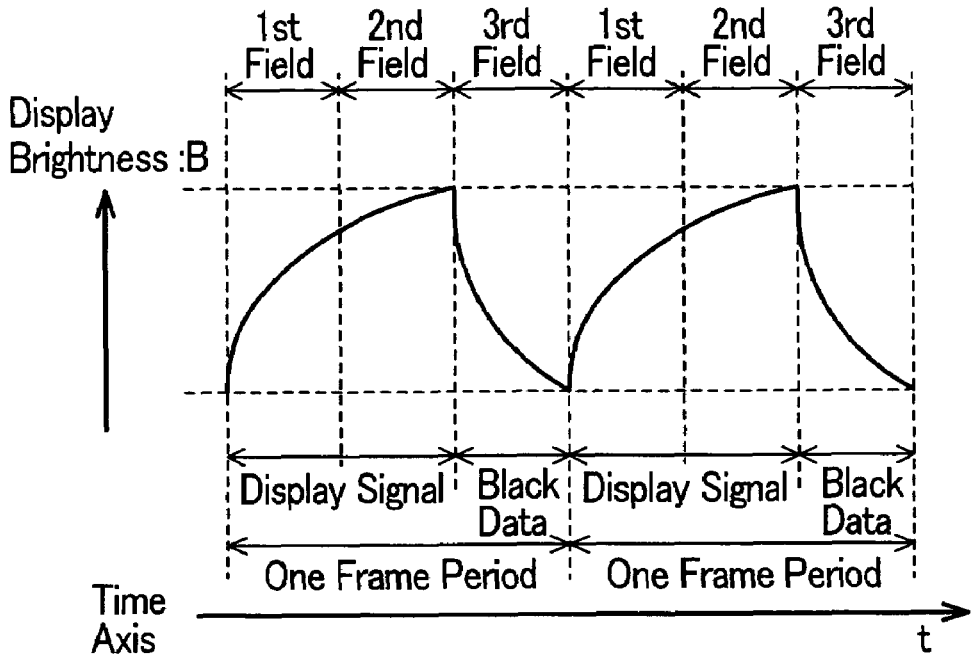
FIG. 9 is a diagram showing the brightness response corresponding to the display timing of the second embodiment of the display device of the present invention.

FIG. 8 is a view (timing chart) showing the display timing of the video data and the blanking data according to the pixel array 101 in this embodiment, and FIG. 9 is a view showing one example of the brightness response when the pixel array 101 is operated in response to the display timing shown in FIG. 8. In the timing chart shown in FIG. 8, each one of two continuous frame periods along a time axis (the first frame period and the second frame periods along a time axis (the first frame period and the second frame period following the first frame period which are respectively indicated by lines having arrows at both ends thereof) is sequentially divided into a first field, a second field and a third field along the time axis, wherein as mentioned above, the gray scale voltage group (the first gray scale voltage group described in the first embodiment) corresponding to the driver data are respectively supplied to the pixel group in the pixel array in the first field, the first gray scale voltage is held in respective pixel groups in the second field, and the gray scale voltage group (the second gray scale voltage group described in the first embodiment) corresponding to the blanking data are respectively supplied to the pixel groups of the pixel array in the third field.

Using the liquid crystal panel of the normally black display mode, having a resolution of the XGA cases, which has been described in the first embodiment as the pixel array, in the first frame period and the second frame period, respectively, the display ON data is displayed on the liquid crystal panel as image data in the first field, and the display OFF data is displayed on the liquid crystal panel as black data in the third field, so that it is possible to obtain a brightness response (change of the optical transmissivity of the liquid crystal layer in the liquid crystal panel) as seen in FIG. 9. In the second field of this embodiment, the gray scale voltages are not outputted to respective data lines provided to the pixel array 101, and, hence, the image formed in the pixel array in the first field is held in the still state for a certain time theoretically. However, particularly when a liquid crystal panel is used as the pixel array, the optical transmissivity of the liquid crystal layer responds to the change of intensity of an electric field generated inside of the liquid crystal layer with a delay, and, hence, the display brightness is continuously elevated with the first gray scale voltage even in the second field, as respectively shown in the first frame period and the second frame period in FIG. 9.

Assuming that the brightness of the pixel array observed by a user of the display device corresponds to an integrated value of display brightness at every time and there exists no large difference in the degree of blackness observed by the user even when the period in which the black data is displayed in the liquid crystal panel is reduced from 50% to 40% of one frame period, the driving method of the display device in this embodiment brings about the following advantage. In this embodiment, the image data is written in the pixel array within the first 40% of one frame period, and the image data is held in the pixel array within the next 20% of one frame period so that the image based on the image data can be displayed more brightly by the pixel array. That is, the time in which the electric field corresponding to the video data is applied to the liquid crystal layer is prolonged compared to that of the first embodiment, and, hence, the optical transmissivity (that is, the display brightness of the pixels) is made to approach a value corresponding to the video data or is made to respond to the value. Thereafter, the electric field applied to the liquid crystal layer is cancelled during the last 40% of one frame period, so as to drop the optical transmissivity, and, hence, an impression that the display brightness is changed with a higher contrast, compared to the first embodiment, through one frame period is given to the user.

On the other hand, in this embodiment, the pulses of the scanning starting signal FLM are generated in the first field and the third field in respective first frame and second frame periods, as shown in FIG. 8. Accordingly, the pulses of the scanning starting signal FLM are not generated at an equal interval different from the pulses of the scanning starting signal FLM of the first embodiment shown in FIG. 5. Such pulses of the scanning starting signal FLM are generated such that, in the timing controller 104, or a peripheral circuit thereof, for example, pulses of the generated scanning clock CL3 are counted, and respective starting times of the first field and the third field are detected along with the starting time for every frame period corresponding to the count numbers.

The scanning clock signal CL3 is generated as a signal including pulses of an equal interval by a pulse oscillator connected to the timing controller 104, and the liquid crystal panel of XGA class is operated in accordance with the display timing shown in FIG. 8. When this operation is performed following the driving example shown in FIG. 3, the display operation of one frame period is completed with the scanning clock signal CL3 of 960 pulses. On the other hand, when this operation is performed following the driving example shown in FIG. 4, the display operation of one frame period is completed with the scanning clock signal CL3 of 1920 pulses. Accordingly, when the pixel array is operated following the driving example shown in FIG. 3, in the frame period in which one pulse of the scanning starting signal FLM, which starts the pixel array scanning of the first field with the (+1)th (n being an arbitrary natural number) pulse of the scanning clock CL3, is generated, the next pulse of the scanning starting signal FLM, which starts the pixel array scanning in the third field of this frame period with the (n+576)th pulse of the scanning clock signal CL3, is generated, and the pulse after the next scanning starting signal FLM, which starts the pixel array scanning of the first field of the next frame period succeeding this frame period with the (n+960)th pulse of the scanning clock signal CL3, is generated. When the operation of the pixel array of every frame period is performed following the driving example shown in FIG. 4, one pulse of the scanning starting signal FLM, which starts the pixel array scanning of the first field in the frame period, is generated with the (n+1)th pulse of the scanning clock CL3, the next pulse of the scanning starting signal FLM, which starts the pixel array scanning of the third field in this frame period, is generated with the (n+1152)th pulse, and the pulse after the next scanning starting signal FLM, which starts the pixel array scanning of the first field in the next frame succeeding this frame period, is generated with the (n+1920)th pulse. Such pulses of the scanning starting signal FLM may be generated by counting the pulses of the horizontal data clock CL1 in place of the scanning clock CL3. In any cases in which pulses of the scanning starting signal FLM are generated, the scanning of the pixel array corresponding to pulses of the scanning starting signal FLM, which starts the first field for every frame period, is stopped until pulses of the next scanning starting signal FLM are received, when the writing of data for one screen is finished. In the above-mentioned example, in which the pixel array is operated following the driving examples shown in FIG. 3, the scanning driver 103 does not output gate selection pulse with respect to pulses ranging from the (n+385)th pulse to the (n+575)th pulse of the scanning clock signal CL3. Accordingly, the first gray scale voltages, which are inputted to respective pixels of the pixel array in response to the pulse group ranging from the (n+1)th pulse to the (n+384)th pulse of the scanning clock signal CL3, are held in respective pixels at least with respect to pulses ranging from the (n+385)th pulse to the (n=575)th pulse of the scanning clock signal CL3.

As mentioned above, in this embodiment, the pulse interval of the scanning starting signal FLM is alternately changed between the first interval and the second interval, which differs from the first interval for every frame period. However, in place of adopting such a scanning starting signal FLM, a Function to count the pulses of the scanning clock CL3 is added to the scanning driver 103; and, in response to the count number of pulses, the stopping of the gate selection pulse outputting operation in the second field and the starting of such an operation in the third field may be controlled. In this case, it is sufficient for the scanning starting signal FLM to generate pulses corresponding to the starting time for every frame period (that is, the pixel array scanning being started in the first field). On the other hand, it is not deniable that the constitution of the scanning driver 103 becomes complicated. A technique which generates the above-mentioned pulses of the scanning starting signal FLM at an unequal interval for every frame period is advantages in view of the fact that a commercially available integrated circuit element can be used as the scanning driver 103, and the design change of the display control or the periphery thereof can be restricted to a minimum.

Here, in the first field of the first frame period shown in FIG. 8, following the driving example shown in FIG. 3 or FIG. 4, the video data for the odd-numbered lines are written one time over the whole region of the pixel array. Then, in the second field, the image obtained by only the video data of the odd-numbered lines is held as it is in the pixel array. In the third field, the blanking data is written once over the whole region of the pixel array by scanning the pixel array using a technique corresponding to the technique used in the first field. Further, in the first field of the second frame period, which follows the first frame period, in the same manner as the first field of the first frame period, following the driving example shown in FIG. 3 or FIG. 4, the video data for even-numbered lines are written once over the whole region of the pixel array. Further, in the second field, the image obtained by only the video data of the even-numbered lines is held as it is in the pixel array. Then, in the third field, the blanking data is written once over the whole region of the pixel array by scanning the pixel array using a technique which corresponds to the technique used in the first field. A series of such pixel array operations is repeated for every frame period. Further, it may be possible that the video data for even-numbered lines is written in the pixel array in the first field of the first frame period, and the video data for the odd-numbered lines is written in the pixel array in the first field of the second time period.

In this embodiment, in the third field of each frame period, so-called black data, which approximates the brightness of respective pixels of the pixels of the pixel array to the minimum value, are written in the pixel array as the blanking data, and, hence, the screen which displays image responding to the brightness corresponding to the video data obtained through the first field and the second field of each frame period is changed to pitch dark as soon as the field is changed to the third field. Accordingly, when a so-called animated image, in which the display images are changed through a plurality of continuous frame periods, is formed on the pixel array, the blurring of the animated image (blurring of a profile of a display object) which is generated on the screen can be reduced.

Here, in this embodiment, the display period of the video data and the display period of the blanking data are respectively set to 60% and 40% of the frame period. However, depending on the brightness of the pixel array, the above-mentioned second field (cease period of the gate selection pulse outputting) and the third field (black data writing period to the pixel array) may be exchanged along the time axis. In this case, as soon as writing of the video data to the pixel array within the beginning 40% of one frame period is finished, writing of black data to the pixel array is started within the next 40% of one frame period, and the pixel array is held in the blanking image display state within the last 20% of one frame period. Due to such a constitution, the ratio between the display period of the video data and the display period of the blanking data during one frame period is reversed to 40%:60%.

Third Embodiment

The third embodiment of the present invention will be explained in conjunction with FIG. 1 to FIG. 4 and FIG. 10 to FIG. 13 hereinafter.

In this embodiment, the writing of the blanking data to the pixel array is performed by sequentially selecting the scanning lines (gate lines) for every four of the lines, or, during the period for outputting the gray scale voltage group corresponding to the blanking data, by supplying the gray scale voltage group to the pixel rows which are controlled respectively by these four scanning lines. Accordingly, for every frame period of the video data which is inputted to the display device, the video data and the blanking data are sequentially displayed on the pixel array such that the video data is displayed using 75% of the frame period and the blanking data is displayed using 25% of the frame period. Accordingly, compared to the first embodiment, which sequentially displays the video data and the blanking data on the pixel array for every frame period such that the video data assumes 50% of the frame period and the blanking data assumes 50% of the frame period, this embodiment can increase the ratio of the image display period corresponding to the video data for every frame period. Further, in this embodiment, as described in conjunction with the second embodiment, the video display data is written in the pixel array in the beginning of each frame period, and the video data is held in the pixel array for a certain time after finishing the writing of the video data. Accordingly, as shown in a timing chart of FIG. 10, each frame period (the first frame period and the second frame period which follows the first frame period shown in FIG. 10) is divided into three fields, wherein the video data is written in the pixel array in the first field and the video display is held in the pixel array in the second field, which follows the first field. In this embodiment, the video display on the pixel array is performed over a time corresponding to 75% of one frame period which is constituted of the first field and the second field. Further, in this embodiment, the blanking data is written in the pixel array in the third field (corresponding to 25% of one frame period), which follows the second field, thus producing a blanking display on the pixel array. In this embodiment, the video data is written in the pixel array in the first field and the video display is held in the pixel array in the second field, which follows the first field. In this embodiment, 75% of one frame period is allocated to the first field and 25% of one frame period is allocated to the second field, so that the application time of the gray scale voltages to respective pixels arranged on the pixel array can be prolonged compared to the gray scale voltage application time of the second embodiment. Accordingly, when an image based on certain video data is displayed on the pixel array at the same brightness, this embodiment can reduce the load applied to the data driver 102.

<Generation of Display Data and Display Control Signals>

In the same manner as the first embodiment and the second embodiment, this embodiment uses a display device on which a liquid crystal panel, which has a resolution of the XGA class and displays images in a normally black display mode is mounted as a pixel array. The constitution and Function of the display device are substantially equal to those of the display device of the first embodiment described in conjunction with FIG. 1. Also, according to this embodiment, as in the case of the first embodiment, in the same manner as the input data shown in FIG. 2, the video data is inputted to the display device for every one line in synchronism with the horizontal synchronizing signal HSYNC. The video data which is inputted to the display device is temporarily stored in either one of two memory circuits 105 connected to the timing controller 104 alternately for every frame period. After the completion of the frame period in which the video data is stored in either one of two memory circuits 105, the video data to be inputted to the display device is stored in another memory circuit 105 in the next frame period, and, at the same time, the video data is read out from one memory circuit 105 for every other line as display data and is transferred to the data driver 102 as the driver data 106. A series of such operations are repeated for every frame period. Reading out of the video data from the memory circuit 105 is performed by reading video data for odd-numbered lines or the video data for even-numbered lines alternately for every other frame period. For example, the video data is sequentially read out from the memory circuits 105 such that, in FIG. 10, the video data for odd-numbered lines is read out in the first frame period, the video data for even-numbered lines is read out in the second frame period, and the video data for odd-numbered lines is read out in a frame period next to the second frame period. Remaining video data, which is not read out in each frame period, is discarded. In this manner, for every frame period, the video data is read out from the memory circuit 105 in the first field, the video data is transferred to the data driver 102 as display data, the data driver 102 generates the gray scale voltage groups (the first gray scale voltage groups described in the first embodiment) which constitute the display signals based on the display data, and the data driver 102 outputs the gray scale voltage groups to 3072 respective data lines, which are juxtaposed in the pixel array for displaying color images with a resolution of the XGA class. The respective first gray scale voltages included in the first gray scale voltage groups are supplied to the pixels corresponding to 3072 respective data lines. The pixels which receive these first gray scale voltages are arranged along the gate lines to which the gate selection pulses (pulses of the scanning signals), to be described later, are applied and constitute the pixel rows. With respect to the video data for odd-numbered lines or even-numbered lines transferred to the data driver 102 as display data, the data driver 102 outputs the first gray scale voltage groups into the first field 384 times.

On the other hand, when the pixel array is operated following the driving example shown in FIG. 3, for every outputting of the first gray scale voltage groups by the data driver 102, the gate selection pulses are sequentially applied to every two lines of the gate lines of the pixel array from the scanning driver 103. When the pixel array is operated following the driving example shown in FIG. 4, at an interval which is ½ of the outputting cycle of the first gray scale voltage groups by the data driver 102, the gate selection pulses are applied sequentially from the scanning driver 103 for every one line of the gate lines of the pixel array. When the pixel array displaying color images with a resolution of the XGA class is operated following the driving example shown in FIG. 3, the scanning driver 103 outputs the gate selection pulses 384 times in the first field, Further, when this pixel array is operated following the driving example shown in FIG. 4, the scanning driver 103 outputs the gate selection pulses 768 times in the first field.

Due to the above-mentioned steps, in the first field of each frame period, 768 pixel rows, which are arranged in the vertical direction of the pixel array, are sequentially selected in response to the gate selection pulses, and the first gray scale voltages are supplied to 3072 pixels included in each pixel row. Outputting of the first gray scale voltage groups from the data driver 102 corresponds to (for example, is synchronized with>the pulses of the horizontal data clock CL1 transmitted to the data driver 102 from the timing controller 104, while outputting of the gate selection pulses (scanning signal pulses) from the scanning driver 103 corresponds to (for example, is synchronized with) pulses of the scanning clock CL3 transmitted to the scanning driver 103 from the timing controller 104. Further, a series of steps for supplying the first gray scale voltages to respective pixels (for generating images on the pixel array) is started with the pulses of the scanning starting signal FLM, which are supplied to the scanning driver 103 and the data driver 102 when necessary from the timing controller 104. That is, the data driver 102 outputs the first gray scale voltage group in response to the frequency of the horizontal data clock CL1 and the scanning driver 103 outputs the gate selection pulses in response to the frequency of the scanning clock CL3. In this embodiment, the pulses of the horizontal data clock CL1 are generated at a cycle which is equal to the cycle of the horizontal synchronizing signal HSYNC inputted to the display device together with the video data.

Figure 10:
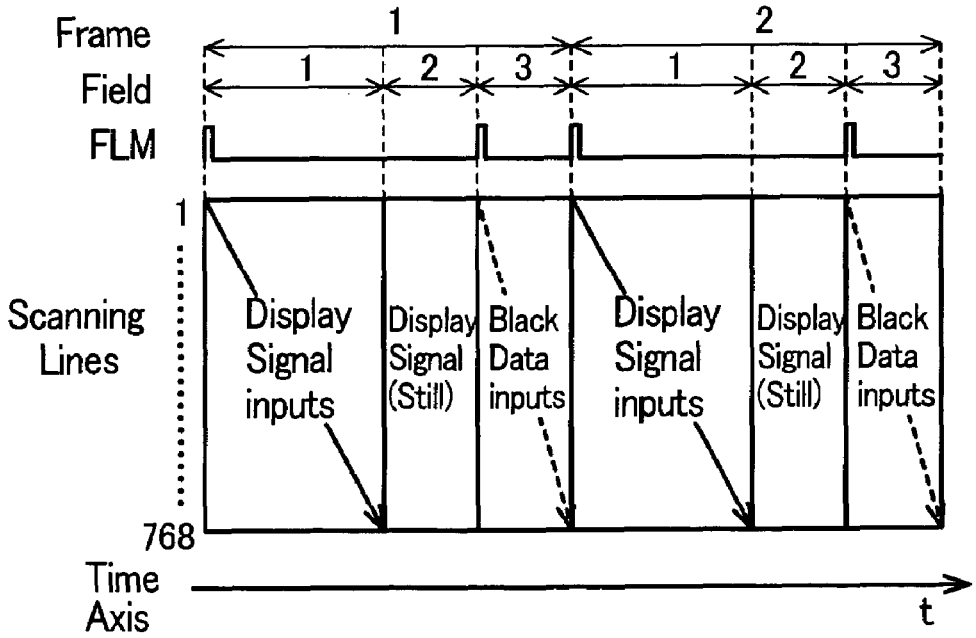
FIG. 10 is a diagram showing the display timing of the third embodiment of the display device according to the present invention for every frame period.

In this embodiment, as shown in the timing chart of FIG. 10, for every frame period, the period which amounts to 25% of one frame period following the first field is allocated to the second field for holding the first gray scale voltages which are supplied in the first field in respective pixels. In the second field, outputting of gate selection pulses (scanning signal pulses) from the scanning driver 103 is stopped with respect to one half of the number of pulses of the scanning clock CL3, which are used for scanning the pixel array in the first field, for example. Further, in the second field, outputting of gray scale voltage groups from the data driver 102 is stopped with respect to one half of the number of pulses of the horizontal data clock CL1, which are used for outputting the first gray scale voltage groups in the first field, for example. As explained in conjunction with the embodiment 2, even when the scanning of the gate lines (pixel rows) for one screen of the pixel array is finished, or even when the first gray scale voltages corresponding to the display data for one frame period inputted to the data driver 102 are completely outputted, unless the pulse of the scanning starting signal FLM is newly generated, the data driver 102 and the scanning driver 103 do not start outputting the gray scale voltages to the next pixel array and scanning the pixel array, and, hence, outputting of the gate selection pulses and the gray scale voltage groups is stopped.

Further, in this embodiment, as shown in the timing chart of FIG. 10, for every frame period, the period which amounts to 25% of one frame period following the second field is allocated to the third field for supplying the second gray scale voltages to respective pixels. The display brightness of respective pixels which receive the second gray scale voltages becomes lower than the display brightness of the pixels when the pixels receive the first gray scale voltages. The pixels, which are displayed in black with the first gray scale voltage are displayed in black or a color close to black, the display brightness of other pixels (particularly pixels which are displayed in white or color close to white with the first gray scale voltages) is reduced along with starting of the third field. Accordingly, also in this embodiment, in the same manner as the second embodiment, the blanking image is displayed on the pixel array in the third frame of each frame period, wherein the period is shorter than those of the first embodiment and the second embodiment. To compensate for such a shortened blanking display period, in this embodiment, the number of gate lines, to which the gate selection pulses (scanning signal pulses) which are outputted for every pulse (every horizontal period of the pixel array operation) of the scanning clock C13 in the third field (period for writing the blanking data to the pixel array), is increased more than the corresponding number of gate lines in the first field (period for writing the display data to the pixel array). This technique is suitable for the display device adopting the scanning driver 103, which is used in the driving example shown in FIG. 3. Further, with respect to the display device which employs the scanning driver 103 that is used in the driving example shown in FIG. 4, which cannot select a plurality of gate lines for one pulse of the scanning clock CL3, by setting the frequency of the scanning clock 0L3 in the third field higher than the frequency of the scanning clock CL3 in the first field, the inputting of the blanking data into the whole region of the pixel array can be completed within the shortened blanking display period.

Figure 11:
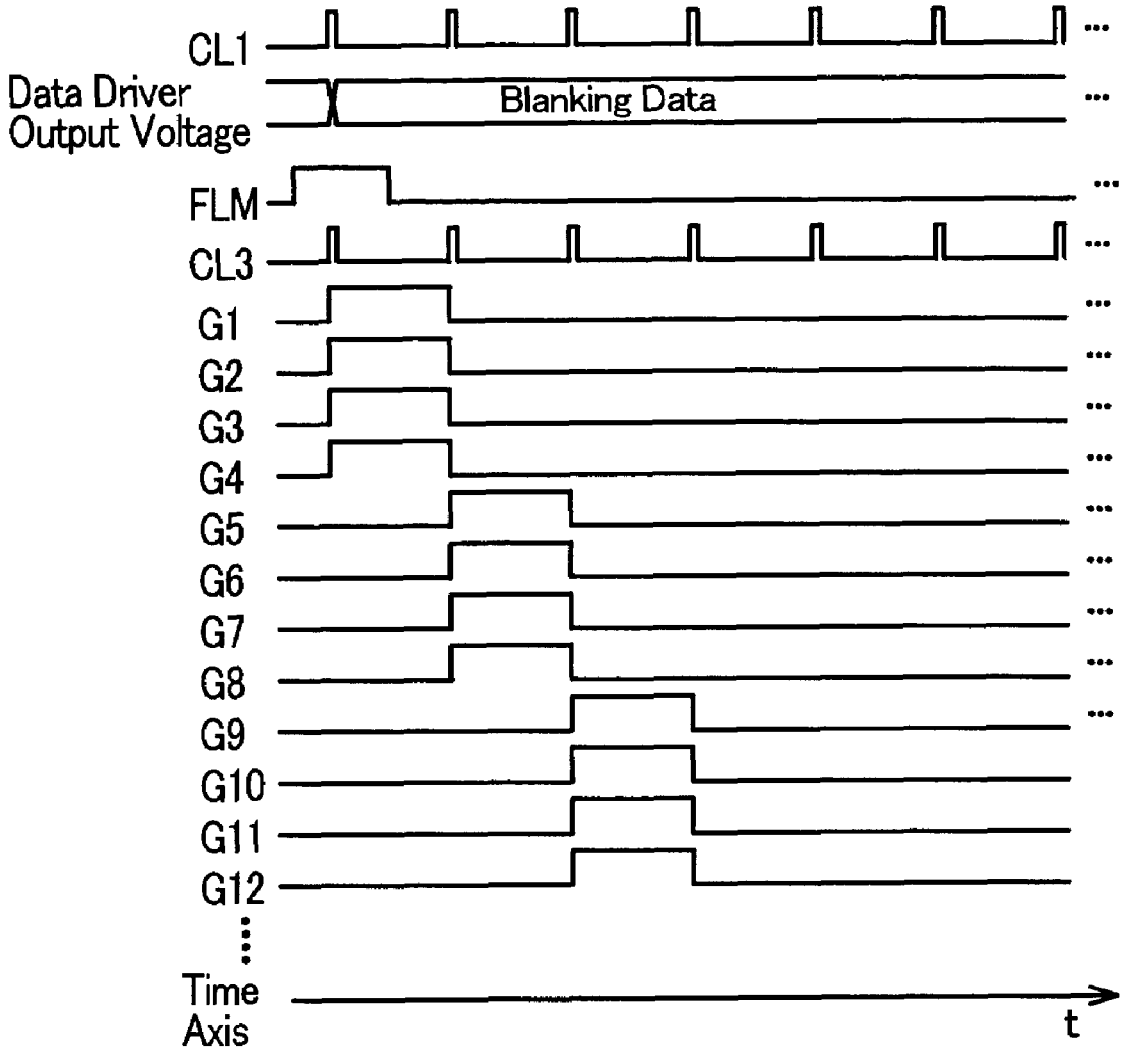
FIG. 11 is a timing chart for selecting the scanning lines of the pixel array according to the present invention for every 4 lines.

The example in which the pixel array is operated by increasing the number of gate lines to which the gate selection pulses are applied for every horizontal period in the third field to a number greater than the number of gate lines in the first field will be explained in conjunction with FIG. 11. This example uses the scanning driver 103 which can apply gate selection pulses not only to two lines of the gate lines of the pixel array, but also to four of the gate lines of the pixel array (corresponding to so-called four line simultaneous selection) in response to one pulse of the scanning clock CL3. For every outputting of the second gray scale voltage groups from the data driver 102 (every horizontal period of pixel array operation), the scanning driver 103 sequentially selects four gate lines every four other pieces in the order of one gate line group consisting of G1, G2, G3, G4, and a next gate line group consisting of G5, G6, G7, G8, and the second gray scale voltage group is sequentially applied to respective pixel rows corresponding to the selected gate line groups (four gate lines). Accordingly, inputting of the blanking data to the pixel array in the third field according to the timing chart shown in FIG. 11 is completed by 192-times of outputting of the second gray scale voltages from the data driver 102 in response to the pulses of the horizontal data clock CL1 and by 192-times of outputting of the gate selection pulses from the data driver 102 in response to the pulses of the horizontal data clock CL3. Accordingly, when the pulses of the horizontal data clock CL1 are generated at the same cycle as the cycle of the horizontal synchronizing signal HSYNC also in the third field, the blanking image is formed over the whole region of the pixel array within a time corresponding to 25% of one frame period.

On the other hand, an example, in which the frequency of the scanning clock CL3 in the third field is set higher than the corresponding frequency in the first field, the pulses of the scanning clock CL3 are generated a plural number of times for every horizontal period, and the gate selection pulses, which are generated in response to the pulses, are sequentially applied to every line of the gate lines of the pixel array, will be explained in conjunction with FIG. 12. In this example, the pulses of the scanning clock CL3 in the third field is to be set four times as large as the corresponding pulses in the first field, and, hence, the pulses are generated four times for every horizontal period of the pixel array. Accordingly, in the third field (period for inputting the blanking data into the pixel array) according to the timing chart shown in FIG. 12, although outputting of the second gray scale voltages from the data driver 102 is repeated 192 times in the same manner as the second gray scale voltages in the timing chart shown in FIG. 11, outputting of the gate selection pulses from the data driver 102 in response to the pulses of the scanning clock CL3 are repeated 768 times. Accordingly, when the pulses of the horizontal data clock CL1 are generated at the cycle equal to the cycle of the horizontal synchronizing signal HSYNC also in the third field, the second gray scale voltages are supplied to all pixel rows corresponding to 768 gate lines, which are juxtaposed in the pixel array within a time corresponding to 25% of one frame period.

To collectively explain the above, the display device and the driving method of this embodiment are characterized in that, between the period for inputting the display data to the pixel array (display operation using the first gray scale voltages) and the period for inputting the blanking data into the pixel array (display operation using the second gray scale voltages) for every frame period, at least one of the number of gate lines selected in response to the pulses of the scanning clock CL3 (the number of pixel rows to which the scanning signal pulses are supplied) and the frequency (pulse interval) of the scanning clock CL3 is changed.

Figure 12:
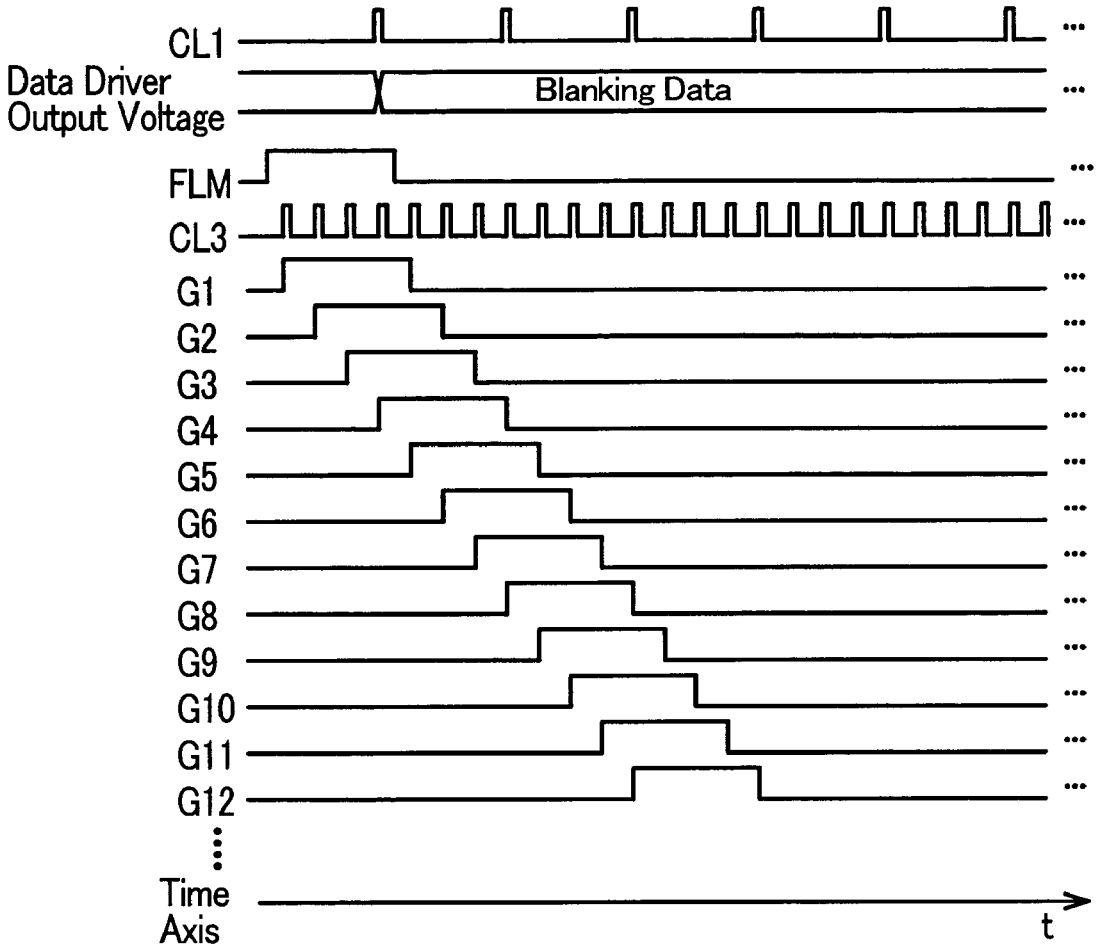
FIG. 12 is a timing chart for selecting 4 lines out of the scanning lines of the pixel array for every outputting of the display signal to the pixel array according to the present invention.

Also, with respect to the inputting of blanking data into the pixel array (pixel array operation in the third field) according to the timing charts shown in both of FIG. 11 and FIG. 12, the outputting pattern of the gate selection pulse (scanning signal pulse) from the scanning driver 103 differs from the corresponding outputting pattern used in the inputting of display data into the pixel array (pixel array operation in the first field). As an example for changing over the outputting pattern of the gate selection pulse corresponding to the field, the pulses of the scanning starting signal FLM, which respectively starts pixel array scanning in the first field and the third field, are recognized by the scanning driver 103, and the selected number of gate lines for every pulse of the scanning clock CL3 based on the recognition is changed over by changing the transmission path of enable signals in the scanning driver 103. This technique is suitable for driving the pixel array shown in FIG. 11. Further, as another example of a technique for changing over the output pattern of the gate selection pulses corresponding to the field, the frequency (pulse interval) of the scanning clock CL3 may be changed over by the adjustment of a pulse oscillator or a circuit similar to the pulse oscillator, while using the timing controller 104 in response to the pulses of the scanning starting signal FLM. This technique is suitable for driving the pixel array shown in FIG. 12.

In the method for inputting the display data into the pixel array shown in FIG. 4 and in the method for inputting the blanking data into the pixel array shown in FIG. 12, the pulse interval of the scanning clock CL3 is shorter than the pulse interval of the horizontal data clock. Accordingly, the gate selection pulse applied to a certain gate line is made to rise at a certain pulse of the scanning clock CL3 and then is made to fall at a pulse of the scanning clock CL3 (hereinafter, referred to as (n+1)th pulse) which follows the pulse (hereinafter, referred to as (n)th pulse), and the gray scale voltage supply time for the pixel row corresponding to the gate line also becomes short. For example, when the liquid crystal panel is used as the pixel array, the possibility that the potentials of the pixel electrodes of respective pixels which constitute the pixel row do not reach values corresponding to the display data or the blanking data is not deniable. On the contrary, by incorporating a shift register or a circuit having a Function similar to that of the shift register into the scanning driver 103, for example, and by making the gate selection pulse which rises at the (n)th pulse of the scanning clock CL3 fall at the (n+m)th pulse (m being a natural number of 2 or more), the gray scale voltage supply time for the pixel row selected by the gate selection pulse is prolonged. That is, compared to the conventional technique which selects the pixel row for every one pulse interval of the scanning clock CL3 and in which the gray scale voltages are supplied to the pixels of the pixel row selected within the time, in the driving example of the pixel array shown in FIG. 4 and FIG. 1, the pixel row is selected using the time which corresponds to a plurality of pulse intervals of the scanning clock CL3 and the gray scale voltages are supplied to the pixels which constitute the pixel row.

The technique in which the control of the rise and/or fall of a scanning signal pulse, which is performed by the scanning driver 103, is not performed sequentially for every pulse of the scanning clock CL3, but is performed by making the scanning driver 103 recognize the specified pulses, may be modified in the following manner in this embodiment. For example, the frequency of the scanning clock CL3 is set to the above-mentioned value in the third field throughout one frame period (the frequency which is four times as large as the frequency of the horizontal data clock). In this case, during the period in which the display data is inputted to the pixel array in the first field, the scanning clock CL3 generates the pulses 1536 times, and, hence, the scanning of the pixel array along the vertical direction is completed at a point of time that the first gray scale voltage group to be supplied to the pixel row positioned halfway along the vertical direction of the pixel array is outputted. Accordingly, the image to be displayed on the pixel array is extended in the vertical direction compared to the original image. Then, the rising of the scanning signal pulse with respect to respective gate lines by the scanning driver 103 in the first field is performed for every other pulse of the scanning clock CL3. Further, the falling of the scanning signal pulse is performed in response to the fourth pulse counted from the pulse of the scanning clock CL3 corresponding to the rising operation of each scanning signal pulse. That is, also in the first field, in the same manner as the third field, the gray scale voltages are supplied to the pixel rows using a time which is four times as long as the pulse interval of the scanning clock CL3. This driving example of the pixel array is characterized in that, in response to the ratio between times allocated respectively to the first field and the third field, the frequency of the scanning clock CL3 is changed to the magnitude with respect to the frequency of the horizontal data clock CL1, and the rise of the scanning signal pulse (outputting of gate selection pulse) in the first field is performed for every plurality of pulses of the scanning clock CL3.

<Image Display Timing>

In this embodiment, in accordance with the timing chart shown in FIG. 10, the pixel array is sequentially scanned using the display signal based on the display data and the blanking data for every frame period. With respect to the display data, as explained in the first embodiment and the second embodiment, either one of the video data for odd-numbered lines and the video data for even-numbered lines, which are inputted to the display device, are read out alternately for every other frame period and are transferred to the data driver 102 as the driver data 106. For example, in FIG. 10, in the first field of the first frame, the first gray scale voltage group, based on a group of video data corresponding to odd-numbered lines inputted from the display device within a certain frame period, is inputted to the whole region of the pixel array 101 from the data driver 102; while, in the first field of the second frame, the first gray scale voltage group, based on a group of video data corresponding to even-numbered lines inputted to the display device within a frame period next to the certain frame period, is inputted to the whole region of the pixel array 101 from the data driver 102. In all frame periods, two rows out of the pixel rows of the pixel array are selected with respect to the outputting of the first gray scale voltages.

In any frame period, in the second field which follows the first field, the first gray scale voltage group inputted to the first field is held by the whole region of the pixel array. In the second field, although the gray scale voltages to be held in the pixels may decrease due to leaking of charges from the pixel electrodes formed in the pixels of the liquid crystal panel, for example, this does not hamper the image display by the pixel array. Accordingly, by also taking such a situation into consideration, the second field is defined as the period for holding the first gray scale voltages due to respective pixels formed in the pixel array.

In any frame period, in the third field which follows the second field, the first gray scale voltage group based on the blanking data is inputted to the whole region of the pixel array 101 from the data driver 102. In this embodiment, four of the pixel rows of the pixel array are selected with respect to the outputting of the first gray scale voltages from the data driver 102 corresponding to one pulse of the horizontal data clock CL1 (every horizontal period). That is, the number of pixel rows which are selected with respect to the outputting of the gray scale voltages (a certain gray scale voltage being supplied) once is increased at the time of performing the blanking image display, compared to the time that the image display is performed based on display data, and, hence, the resolution of the blanking image in the pixel array is degraded compared to the image due to the display data. However, when the blanking image is formed in a state in which the screen of the display device is displayed in black or in a color close to black uniformly, the reduction of the resolution does not cause any serious problem. Further, when the brightness of the specified area of the image (pixels) due to the display data is selectively lowered in the third field, by lowering the display brightness of one portion of the blanking image, including the specified area than other portions, it is possible to cancel the influence derived from the above-mentioned difference in resolution.

Figure 13:
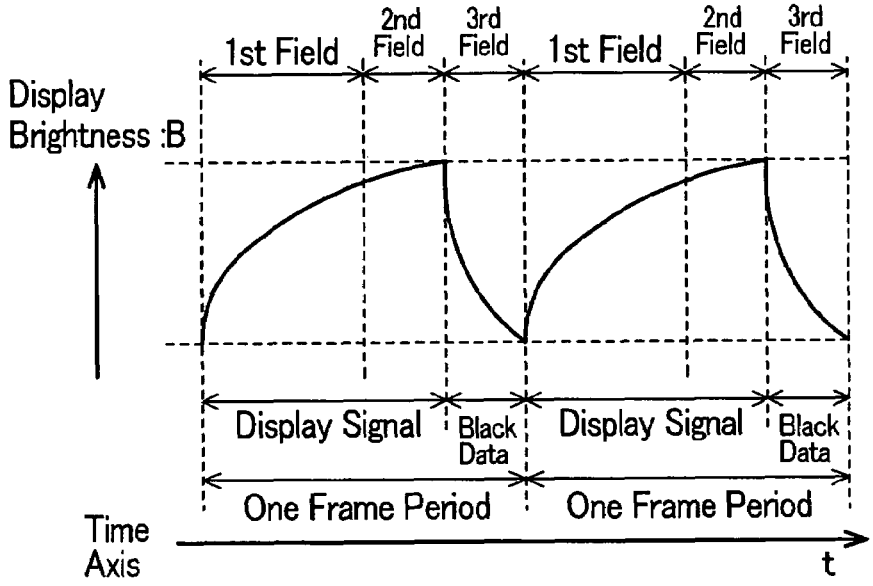
FIG. 13 is a diagram showing the brightness response corresponding to the display timing of the third embodiment of the display device of the present invention.
Figure 14:
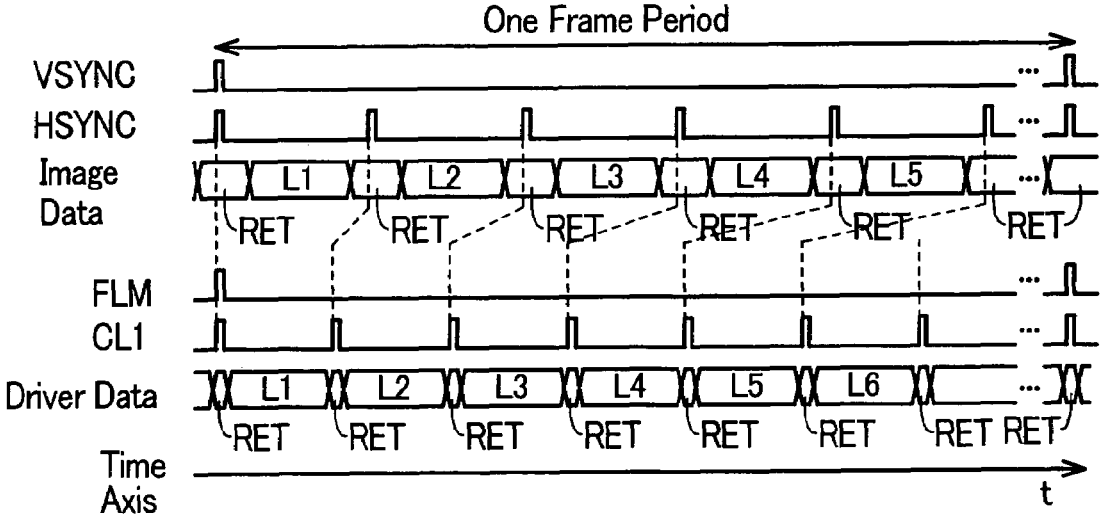
FIG. 14 is a diagram showing the timing of video data inputs to the display device of the present invention and display data outputs from the display device in the fourth embodiment.

FIG. 13 is a graph showing the brightness response (change of optical transmissivity of the liquid crystal layer in the liquid crystal panel) of the pixel array (liquid crystal panel) obtained by inputting the display ON data to the first field as image data and the display OFF data to the third field as black data in the first frame period and the second frame period, respectively, in the liquid crystal panel of a normally black display mode having a resolution of the XGA class which is used as the pixel array (also used in the first embodiment and the second embodiment). Also, in the second field of this embodiment, in the same manner as the second embodiment, the gray scale voltages are not outputted to respective data lines formed on the pixel array 101, and, hence, the image formed on the pixel array 101 in the first field is considered to be held in the second field in a still state theoretically. However, when the liquid crystal panel is used as the pixel array, the optical transmissivity of the liquid crystal layer responds to the change of the intensity of the electric field generated inside of the liquid crystal layer with a delay, and, hence, the display brightness of the pixel array is continuously increased also in the second field. Accordingly, also in this embodiment, in the same manner as the second embodiment, the time that the electric field corresponding to the video data is applied to the liquid crystal layer in one frame period is prolonged, so that it is possible to approximate the display brightness of the pixels to a value corresponding to the video image or to make the display brightness of the pixels assume the value. The image formed on the pixel array in this manner weakens the electric field that is applied to the liquid crystal layer in the final 25% (third field) of one frame period and decreases the optical transmissivity of the liquid crystal layer. Accordingly, the image formed on the pixel array is replaced with an image which is displayed in black or in a color close to black uniformly, and, hence, it is possible to give an impression to users that the display brightness is changed with a higher contrast than the first embodiment throughout one frame period.

In this embodiment, as described above, in addition to the advantage brought about by the display device and the driving method of the second embodiment, it is possible to lower the brightness of the pixel array (screen of the display device) within a time shorter than the third field of the second embodiment. This advantageous effect is attributed to the fact that the gray scale voltages corresponding to the blanking data are outputted to the pixel array in accordance with the data driver output waveforms shown in FIG. 11 and FIG. 12, and the gate selection pulses are outputted to respective gate lines G1, G2, G3, . . . . Accordingly, although the above-mentioned systems, such as the frequency modulation of the above mentioned scanning clock CL3, the gate selection pulse control, and the like are to be added to the display device of the second embodiment, the display device according to this embodiment can obtain the following advantageous effects compared to the advantageous effects obtained by the second embodiment. One advantageous effect is the enhancement of the display brightness of the image based on the video data. This is because, in this embodiment, the time for writing the display signals to the pixel array in the first field can be easily prolonged or extended and the image display time extending over the first field and the second field can be also easily prolonged. Another advantageous effect is the further reduction of the smear (blurring) of a profile of a moving object, which is particularly generated in the animated image display using the pixel array. This is because, due to this embodiment, the image (based on the video data) which is formed with high display brightness for every frame period is replaced with the blanking image within the short time of the third field, and, hence, the image formed by the pixel array is approximated to the image formed by an impulse-type display device.

Here, although the display period for video data and the display period for blanking data are respectively set to 75% and 25% of the frame period, depending on the brightness of the pixel array, the above-mentioned second field (cease period of gate selection pulse outputting) and the third field (black data writing period to pixel array) may be exchanged along a time axis. In this case, as soon as writing of the video data into the pixel array is finished within the first 50% of one frame period, writing of the black data to the pixel array is started in the next 25% of one frame period, and the pixel array is held in the blanking image display state in the final 25% of one frame period. Accordingly, both the display period for video data and the display period for blanking data using the pixel array can be set to 50% of one frame period.

Fourth Embodiment

The fourth embodiment of the present invention will be explained in conjunction with FIG. 1, FIG. 11, FIG. 12 and FIG. 14 to FIG. 16. Also, in this embodiment, using the display device shown in FIG. 1, the video data which is inputted to the display device shown in FIG. 1 is alternately stored in either one of the memory circuits 105 for every frame period. The video data for one frame period, which is stored in one memory circuit 105, is read out from this memory circuit 105 as soon as the video data for the next frame period is stored in another memory circuit 105 and is transferred to the data driver 102 as the driver data 106. However, in this embodiment, in the step to read out the display data from the memory circuit 105, in contrast to the above-mentioned embodiments, the data groups in the horizontal direction which constitute the video data are read out for every one line. Accordingly, as indicated by the driver data waveforms of the timing chart shown in FIG. 14, the video data for odd-numbered lines (L1, L3, L5, . . . ) and the video data for even-numbered lines (L2, L4, L6, . . . ) are read out together as the display data for every frame period.

Further, in this embodiment, one frame period of the display operation due to the pixel array is divided into two fields, wherein the image is displayed by writing the display data (obtained by reading the video data for every one line as mentioned above) in the pixel array in the first field and the blanking image is displayed by writing the blanking data in the pixel array in the second field, which follows the first field. Accordingly, in this embodiment, the retracing periods (horizontal retracing periods or vertical retracing periods) included in the display operation in one frame period due to the pixel array are shortened so as to allocate at least portions of the retracing periods included in the video data 120 that is inputted into the display device to the blanking image display in the second field. Due to such a constitution, according to this embodiment, 75% of one frame period is allocated to the image display period based on the video data and the remaining 25% of one frame period is allocated to the blanking image display period. To conform with such image display timing, in this embodiment, the timing control performed by the liquid crystal timing controller 104 provided to the display device is different from the corresponding timing control in the above-mentioned respective embodiments.

<Video Data Processing in Display Control Circuit>

In this embodiment, to input the generated video data by reading out the video data inputted to the display device for every one line in the first field, the frequency of the horizontal data clock CL1 and the frequency of the scanning clock CL3 are set higher than the frequency of the horizontal synchronizing signal HSYNC of the video data. When the horizontal retracing periods in the display operation of the pixel array are shortened, the pulse intervals of the horizontal data clock CL1 and the scanning clock CL3 become short compared to the pulse interval of the horizontal synchronizing signal HSYNC corresponding to the difference between the horizontal retracing periods of the video data and the horizontal retracing period of the display operation of the pixel array. On the other hand, in this embodiment, to allocate the portion of the horizontal retracing period of the video data to the second field, the time for the blanking image display by the horizontal retracing period is limited compared to the above-mentioned respective embodiments. Accordingly, it is desirable that a larger number of pixel rows are selected with respect to one outputting of the second gray scale voltages from the data driver 102 and the second gray scale voltages are collectively supplied to these pixel rows.

Figure 15:
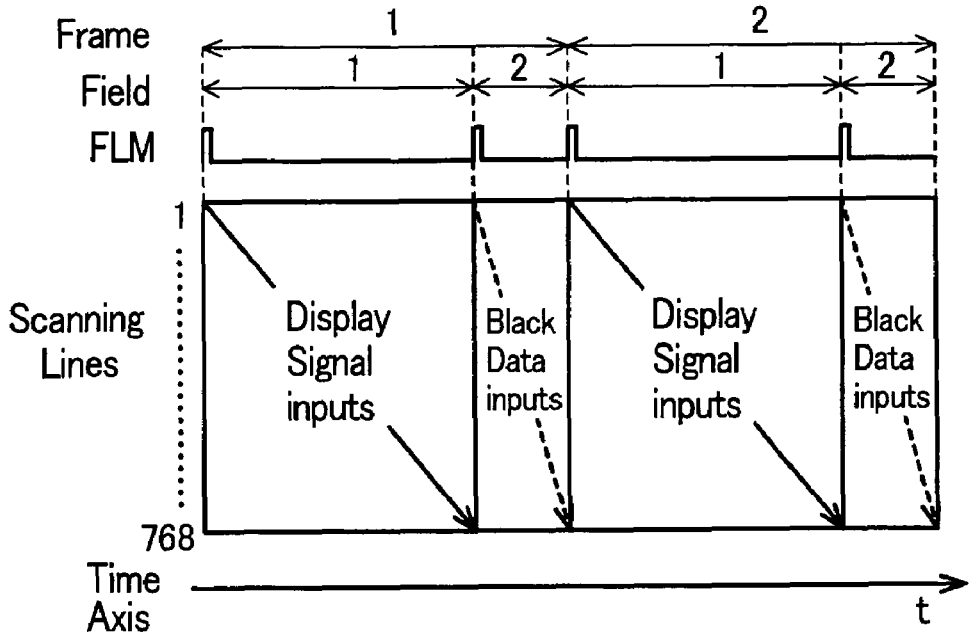
FIG. 15 is a diagram showing the display timing of the fourth embodiment of the. display device according to the present invention for every frame period.

The operation of the pixel array in the second field in respective frame period in FIG. 15 maybe performed by following, for example, the corresponding operation in the third field of the third embodiment. In the display operation of the pixel array having a resolution of the XGA class of this embodiment, when the blanking image display in the second field is performed in accordance with the timing chart shown in FIG. 11, the scanning of the pixel array in the first field is completed with 768 pulses of the horizontal data clock CL1 and the scanning clock CL3, while the scanning of the pixel array in the second field is completed with 192 pulses of the horizontal data clock CL1 and the scanning clock CL3. Further, to perform the blanking image display in the second field in the pixel array in accordance with the timing chart shown in FIG. 12, respective numbers of pulses of the horizontal data clock CL1 required for pixel array scanning in the first field and the second field, and the numbers of pulses of the scanning clock CL3 required for pixel array scanning in the first field are equal to those of the case performed in accordance with the timing chart shown in FIG. 11. However, the pulses of the scanning clock CL3, which are necessary for completing the pixel array scanning in the second field are generated 768 times by reducing the pulse interval to ¼ of the pulse interval in the first field. In both cases of performing the pixel array scanning in the second field in accordance with the timing chart shown in FIG. 11 and in accordance with the timing chart shown in FIG. 12, the pixel array produces an image display based on the video data using 80% of one frame period and performs the blanking image display using 20% of one frame period. Accordingly, it is necessary for managing the time corresponding to 20% of one frame period from at least one of the horizontal retracing periods or the vertical retracing periods of the video data.

As mentioned above, in this embodiment, using a pixel array (liquid crystal panel) having a resolution of the XGA class, 75% of one frame period is allocated to the display of an image based on the video data and the remaining 25% of one frame period is allocated to the display of a blanking image. Accordingly, the image display based on the video data is completed with 768 pulses of the horizontal data clocks CL1 and the blanking image display is completed with 256 pulses of the horizontal data clocks CL1.

<Image Display Timing>

In this embodiment, in both of the first frame period and the second frame period shown in FIG. 15, in the first field, the video data which is stored in either one of the memory circuits 105 is read out for every one line (irrespective of video data for odd-numbered line and video data for even-numbered line) corresponding to respective frame periods, and the first gray scale voltages generated by this operation are sequentially supplied for every pixel row of the pixel array, thus writing the video data in the whole screen (the whole region of the pixel array). Further, in respective second fields of the first frame period and the second frame period, the blanking data is written in the whole region (the whole screen) of the pixel array in accordance with the timing charts shown in FIG. 11 and FIG. 12. The blanking data is supplied to respective pixels arranged two-dimensionally in an effective display area (an area which contributes to the image display) of the pixel array as the second gray scale voltages by the data driver 102. In this embodiment, in respective frame periods, to allocate 75% of the frame period to the first field and the remaining 25% of the frame period to the second field, the inputting of the blanking data into the pixel array in the second field in accordance with the method shown in FIG. 11 sequentially outputs the gate selection pulses for every three lines of gate lines and for every three other lines. On the other hand, inputting of the blanking data into the pixel array in the second field in accordance with the method shown in FIG. 12 is performed by increasing the frequency of the scanning clock CL3, such that the frequency becomes three times as high as the frequency of the horizontal data clock CL1.

Figure 16:
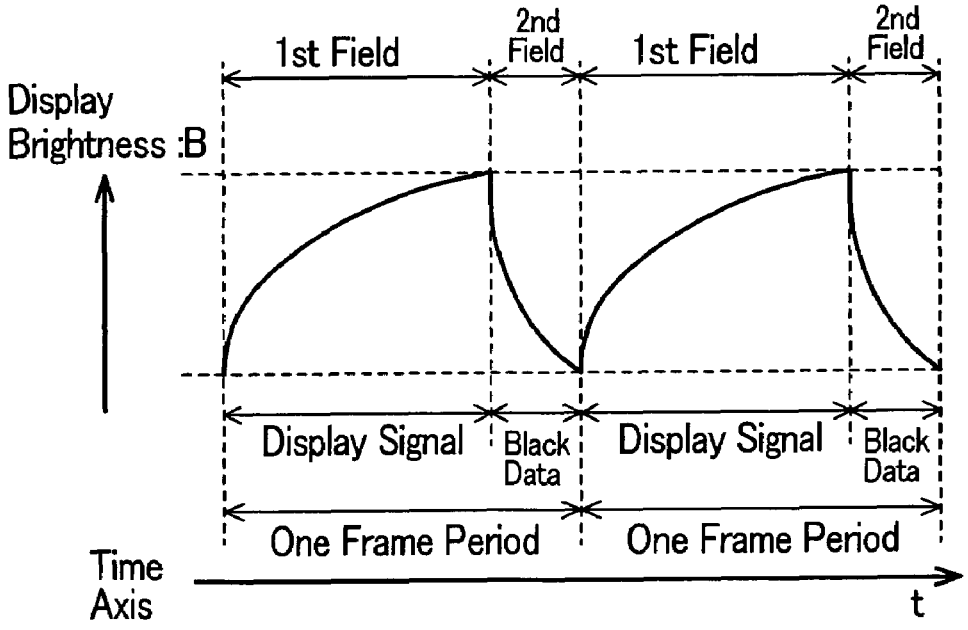
FIG. 16 is a diagram showing the brightness response corresponding to the display timing of the fourth embodiment of the display device of the present invention.

The brightness response of the pixels when the liquid crystal panel of the normally black display mode is operated in accordance with such image display timing is shown in FIG. 16. In respective first and second frame periods, the display ON data which displays the pixels in white is written to the pixels of the liquid crystal panel in the first field, and the display OFF data (blanking data) which displays the pixels in black is written to the pixels of the liquid crystal panel in the second field. As shown in FIG. 16, for every frame period, the pixels of the liquid crystal panel show a brightness change of a so-called impulse-type display device, in which the pixels respond to the brightness corresponding to the video data in the first field, and, thereafter, the pixels respond to the black brightness in the second field. Accordingly, when the display image is changed over the continuous frame periods, the display image is cancelled from the screen for every frame period. Due to such a constitution, the animated image blurring which occurs on a profile of a moving object displayed when an animated image is displayed on the pixel array can be reduced.

Fifth Embodiment

The video data is inputted to the display device for every frame period in synchronism with the vertical synchronizing signal VSYNC, for every one line (for every data in the horizontal direction) of each frame period in synchronism with the horizontal synchronizing signal HSYNC having a frequency higher than the frequency of the vertical synchronizing signal, and for every dot (for every pixel) in synchronism with the dot clock DOTCLK having a frequency higher than the frequency of the horizontal synchronizing signal HSYNC. The vertical synchronizing signal VSYNC, the horizontal synchronizing signal HSYNC and the dot clock DOTCLK are inputted to the display device together with the video data as video control signals, as mentioned previously. When the display data is read out from the video data inputted to the display device using the video control signals, the read-out speed of elements of the display data supplied for every pixel row of the pixel array is determined by the dot clock DOTCLK, which regulates the inputting speed of elements which constitute the data for every line of the video data corresponding to the read-out speed to the display device. Accordingly, in the above-mentioned embodiment, as can be readily understood by a comparison of input data waveforms, and the driver data waveforms which are respectively shown in FIG. 2, FIG. 7 and FIG. 14, it is not possible to make the time for reading the video data for one line as the display data corresponding to one gate selection pulse (respective lengths along a time axis of hexagonal shapes L1, L3, L5, . . . of the driver data shown in FIG. 2) shorter than the time necessary for inputting the video data for one line (respective lengths along a time axis of hexagonal shapes L1, L2, L3, . . . of the input data shown in FIG. 2). Accordingly, in the first embodiment, the second embodiment and the third embodiment, the video data is partially read out for every other line; and, in the second embodiment and the fourth embodiment, the sum of the retracing periods in the display operation of the pixel array is to be set smaller than the sum of the retracing periods in the step for inputting the video data into the display device, thus managing the time for performing the blanking image for every frame period.

In this embodiment, the display device is made to generate clock signals having a frequency higher than that of the above-mentioned dot clock DOTCLK, so that the video data for one line stored in the memory circuit can be read out using a time shorter than the time required at the time of inputting, so as to suppress the ratio of time allocated to the first field in one frame period to a greater extent than the above-mentioned embodiments. Accordingly, the image which is formed based on the video data for every one frame period can be cancelled within the frame period using the blanking image, and, hence, the blurring of an animated image can be further reduced. Further, in the method of driving the display device, which temporarily holds the video data inputted to the pixel array in the pixel array as described in the second embodiment, the period for holding the video data in the pixel array can be extended or prolonged so that the brightness of the display imaged can be enhanced. The display device of this embodiment, which brings about such advantages, has the following constitutional features, and functional features corresponding to the constitutional features.

<Constitution of Display Device>

Figure 17:
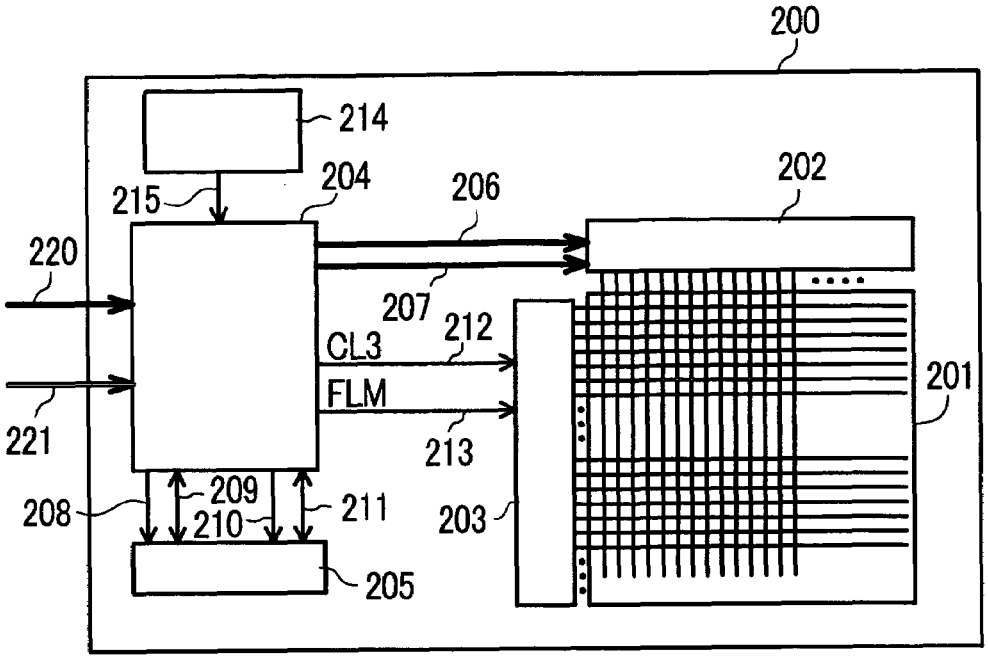
FIG. 17 is a block diagram showing the basic structural features of the fifth embodiment and the sixth embodiment of the display device (liquid crystal display device) according to the present invention.

The basic structure of the display device according to this embodiment is shown in a block diagram in FIG. 17. Although the display device of this embodiment has a constitution which substantially corresponds to the constitution which has been described in conjunction with the first embodiment shown in FIG. 1, a clock generating circuit 214, which is connected to a timing controller 204, is newly added. The display device 200 includes the timing controller 204, which receives video data 220 from a video signal source, such as a television receiver set, a personal computer, a DVD player or the like, and video control signals 221 (including vertical synchronizing signals VSYNC, horizontal synchronizing signals HSYNC, a dot clock DOTCLK and the like), as well as a pixel array 201, which receives display data and display control signals from the timing controller 204. As the pixel array 201, for example, a liquid crystal panel having a resolution of the XGA class can be used.

A memory circuit 205, which stores video data 220 that is inputted to the display device 200 for every frame period is connected to the timing controller 204. The memory circuit 205 includes a first portion (corresponding to the memory circuit 105-1 in FIG. 1) to which the video data 220 is inputted from a first port 209 in response to control signals 208 (not shown in the drawing) and a second portion (corresponding to the memory circuit 105-2 in FIG. 1) to which the video data 220 is inputted from a second port 211 in response to control signals 210. The video data which is stored in the first portion of the memory circuit 205 can be read out even during the period in which other video data is stored in the second portion, and the video data stored in the second portion can be also read out in parallel to the storing of the video data into the first portion.

Figure 18:
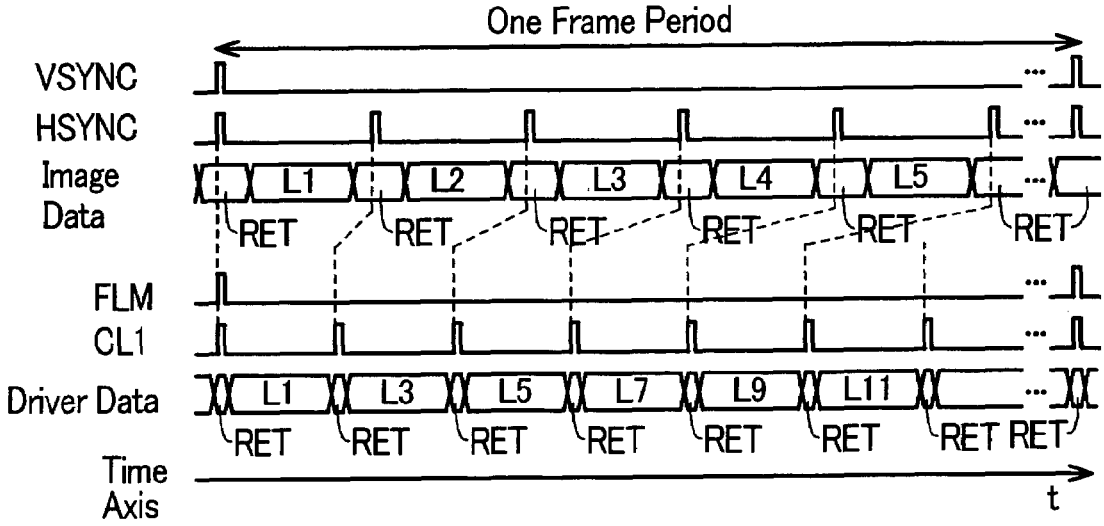
FIG. 18 is a diagram showing the timing of video data inputs to the display device of the present invention and display data outputs from the display device in the fifth embodiment.

In this embodiment, reading out of the display data from the video data stored in the memory circuit 205 is performed in response to (in synchronism with) a display clock 215 which is generated as a reference clock in the clock generating circuit 214. By generating the display clock 215 having a frequency higher than frequency of an input clock which inputs the video data 220 to the display device 200 and by reading out the video data 220 for one line from the memory circuit 205 in response to the display clock 215, the time necessary for reading out the video data 220 for one line from the memory circuit 205 becomes shorter than the time necessary for storing the video data 220 for one line to the memory circuit 205. Accordingly, in a timing chart showing the inputting of signals and the outputting of signals at the timing controller 204 of this embodiment, as shown in FIG. 18, respective lengths along a time axis of hexagonal shapes L1, L3, L5, . . . corresponding to every video data for one line which is read out from the memory circuit 205 as the driver data (display data) will become shorter than the respective lengths along a time axis of hexagonal shapes L1, L2, L3, . . . corresponding to every video data for one line which is stored in the memory circuit 205 as the input data.

In this embodiment, the video data is read out from the memory circuit 205 for every other line as the display data which corresponds to every gate selection pulse and the retracing period RET (indicated by waveform of the drive data in FIG. 18) included in the horizontal period of the pixel array which corresponds to the read-out period is made shorter than the retracing period RET (indicated by waveform of the input data in FIG. 18) in the input to the memory circuit 205 of the video data, whereby the horizontal period of the pixel array is shortened. Accordingly, in this embodiment, it is possible to shorten the video data inputting time in every frame period to 30% or less than 30% of one frame period.

In this manner, the video data is read out in response to the display clock 215 generated by the clock generating circuit 214, and the video data is transferred to the data driver 202 provided to the pixel array (liquid crystal panel) 201 as the driver data (display data) 206. In this embodiment, as the data driver control signal group 207, a horizontal data clock CL1 and a dot clock CL2 supplied to the data driver 202 from the timing controller 204, a scanning clock 212 (CL3) which is supplied to the scanning driver 203 provided to the pixel array 201 from the timing controller 204 and the scanning starting signal 213 (FLM) are also generated by dividing the frequency of the display clock 215.

<Function of Display Device and Image Display Operation>

Figure 19:
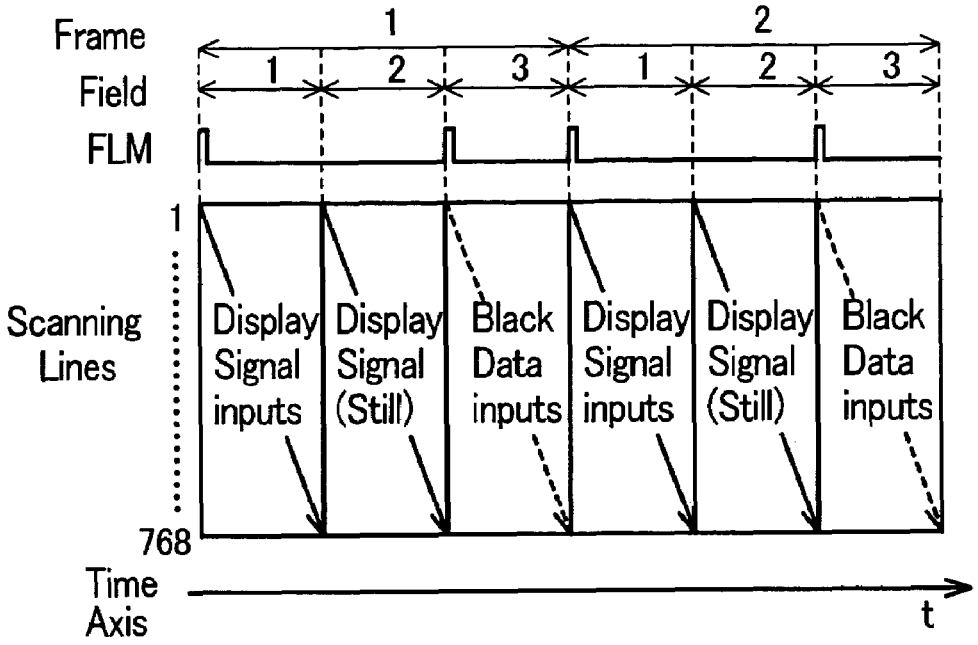
FIG. 19 is a diagram showing the display timing of the fifth embodiment of the display device according to the present invention for every frame period.

In this embodiment, in the same manner as the second embodiment and the third embodiment, the display device shown in FIG. 17 is configured such that one frame period of the video data which is inputted to the display device is divided into three fields, consisting of a first field in which the video data (the display data) is written into the pixel array, a second field in which the video data written into the pixel array is held, and a third field in which blanking data is written into the pixel array. FIG. 19 shows the timing of the image display and the blanking image display based on the video data for every frame period by taking the first frame period and the second frame period, which follows the first frame period, as an example. In the first frame period and the second frame period, respectively, the image based on the video data is displayed through the first field in which the display data (or the driver data) 206, which is obtained by reading out the video data for every other line, is transmitted to the data driver 202, and the data driver 202 sequentially inputs the display signal that is generated based on the received display data 206 and through the second field in which the display signals are held in the pixel array (a still image is temporarily generated based on the display data). Further, in the first frame period and the second frame period, respectively, the blanking image is displayed in the pixel array in the third field in which the black data, which displays the pixel in black, (minimize the display brightness) is inputted into the pixel array.

As has been explained in conjunction with FIG. 17 and FIG. 18, in this embodiment, in response to the pulses of the display clock 215 generated by the clock generating circuit 214, the video data which is inputted to the display device for every frame period is read out in the first field of each frame period for every other line. In an example of the display timing of the pixel array according to the embodiment shown in FIG. 19, steps in which the video data for odd-numbered lines is read out as display data corresponding to the gate selection pulse output in the first field of the first frame period, the video data for even-numbered lines is read out as display data corresponding to the gate selection pulse output in the first field of the second frame period, and further, the video data for odd-numbered lines is read out as display data corresponding to the gate selection pulse output in the first field of a frame period (not shown in FIG. 19) which succeeds the second frame period, are repeated along a time axis. The display data (driver data) 206 is transferred to the data driver 202 for every frame period, and the images based on the video data for every frame period are formed in the pixel array.

As mentioned above, in this embodiment, the frequency of the display clock 215 is set higher than the frequency of the dot clock DOTCLK (the reference clock of the video control signals), or the horizontal retracing period which is inserted into the time for reading out the video data for one line from the memory circuit 205 is set shorter than the horizontal retracing period which is inserted into the time for storing the video data for one line into the memory circuit 205. Accordingly, it is desirable that the horizontal data clock CL1, which determines the timing for supplying the first gray scale voltage group generated based on the display date from the data driver 202 to the pixel array 201, is made to match a period at which the video data for one line is read out from the memory circuit 205. Further, in this embodiment, it is also desirable that the scanning clock CL3, which determines the timing for outputting the gate selection pulse (the scanning signal pulse) from the scanning driver 203 in response to outputting of the first gray scale voltage group from the data driver 202, is also generated based on the reference clock used for the generation of the horizontal data clock CL1.

In this embodiment, the horizontal clock CL1 and the scanning clock CL3 are generated based on the display clock 215, and the horizontal period of the pixel array operation in the first field is shortened corresponding to the cycle for reading out the video data from the memory circuit 205. Accordingly, as shown in FIG. 18, the pulse interval of the horizontal data clock CL1 is set shorter than the pulse interval of the horizontal synchronizing signal HSYNC, which constitutes one of the video control signals inputted to the display device together with the video data. Accordingly, writing of the display signals into the pixel array is completed within 35% of one frame period in the first field. Here, the pulses of the scanning clock CL3, in the same manner as the previous embodiments, are generated at an interval equal to the interval of the pulses of the horizontal data clock CL1 with respect to the pixel array operation which follows the driving example of FIG. 3 and at an interval which is ½ of the interval of pulses of the horizontal data clock CL1 with respect to the pixel array operation which follows the driving example of FIG. 4.

In the first field, either one of video data for odd-numbered lines and video data for even-numbered lines are alternately read out for every other frame period, and the first gray scale voltages which constitute the display signals are outputted from the data driver 202 based on the display data (driver data) 206 obtained by such reading, and the first gray scale voltages are supplied to respective pixels of the pixel array following the driving example shown in FIG. 3 or the driving example shown in FIG. 4. The holding time of the display signals (generated based on the video data for the odd-numbered lines or for even-numbered lines and the display data) in the pixel array in the second field, which follows the first field, is prolonged by an amount by which the first field is shortened. In this embodiment, 30% of one frame period is allocated to the second field. Accordingly, the remaining 35% of one frame period is allocated to the blanking image display in the third field. In the third field, the second gray scale voltages corresponding to the blanking data are outputted from the data driver 202 and are supplied to respective pixels of the pixel array by following the driving example shown in FIG. 3 or the driving example shown in FIG. 4. The second gray scale voltages may be generated in the same manner as the first embodiment, such that the blanking data generated by the timing controller 204 is transferred to the data driver 202, and the second gray scale voltages are generated based on the blanking data, using the data driver 202 or the data driver 202, to recognize the pulses of the scanning starting signal FLM which starts the third field and the preset gray scale voltages for blanking image display may be outputted (In the latter method, the generation of the blanking data using the timing controller 204 may not be performed.). Due to the above-mentioned steps, according to the present invention, 65% of one frame period is allocated to the display period of the display signals by the pixel array and 35% of one frame period is allocated to the display period of the blanking data by the pixel array. Here, also in this embodiment, the pulses of the scanning starting signal FLM for driving the pixel array, in the same manner as the corresponding pulses of the second embodiment and the third embodiment, are generated in response to the time for starting writing of display data to the pixel array in the first field and the time for starting writing of blanking data (black data in FIG. 19) to the pixel array in the third field. That is, for every other pulse of the scanning starting signal FLM, the display period of display signals and the display period for blanking data by the pixel array are alternately changed over. The pulses of the scanning starting signal FLM, in the same manner as the second embodiment and the third embodiment, are not generated at the time of starting the second field, which holds the data inputted to the pixel array in the same pixel array. The pulse interval of the scanning starting signal FLM in the driving example of the display device shown in this embodiment, in the same manner as the second embodiment, the third embodiment and the fourth embodiment, alternately exhibits two different values (times respectively corresponding to 65% and 35% of one frame period) every other time.

As described above, to shorten the rate of the first field period in the first frame period compared to the corresponding rate of respective previous embodiments, in this embodiment, the frequency of the display clock (the liquid crystal display clock when the pixel array is the liquid crystal panel) 215 is increased to a value which is 1.14 times as high as the frequency of the dot clock DOTCLK inputted to the display device as the video control signal 221. On the other hand, as shown in FIG. 18, the horizontal retracing periods (RET having a driver data waveform) which are inserted into the time necessary for reading out the video data for one line from the memory circuit 205 (horizontal period of the pixel array operation) are set shorter than the horizontal retracing periods (RET having an input data waveform) which are inserted into the time for storing the video data for one line to the memory circuit 205 (horizontal scanning period of the video data), whereby the horizontal period for pixel array operation is shortened to 80% of the horizontal scanning period of the video data. Here, the horizontal scanning period of the video data and the horizontal period of the pixel array operation are compared using the dot clock DOTCLK of the video data as a reference. Accordingly, when the pixel array operation during the horizontal period, which is shortened to 80% of the horizontal scanning period of the video data, is performed in response to the above-mentioned display clock 215, the time necessary for the pixel array operation is shortened to 70% of the horizontal scanning period of the video data. This value of 70% is obtained by dividing the ratio: 80% of the horizontal period of the pixel array operation with respect to the horizontal scanning period of the video data in comparison using the dot clock DOTCLK as a reference with the magnification: 1.14 which the frequency of the display clock 215 takes with respect to the frequency of the dot clock DOTCLK. Accordingly, the cycle in which the video data for one line is read out from the memory circuit 205 in response to the display clock 215 is reduced to 70% of the cycle (input horizontal cycle) for writing the video data for one line to the memory circuit 205 in response to the dot clock DOTCLK. Accordingly, the pulse interval of the horizontal data clock CL1, which determines the output timing of the gray scale voltages from the data driver 202, becomes, for example, 70% of the pulse interval of the horizontal synchronizing signal HSYNC, which determines the cycle of inputting the video data to the display device for every one line (horizontal scanning period of the video data). Further, in this embodiment, the video data stored in the memory circuit 205 is read out for every other line (either one of odd-numbered line or the even-numbered line) as the display data, and, hence, the step for reading out the display data to be written in the whole region of the pixel array 201 from the memory circuit 205 and for inputting the display data to the pixel array can be completed within 35% of the one frame period.

Figure 20:
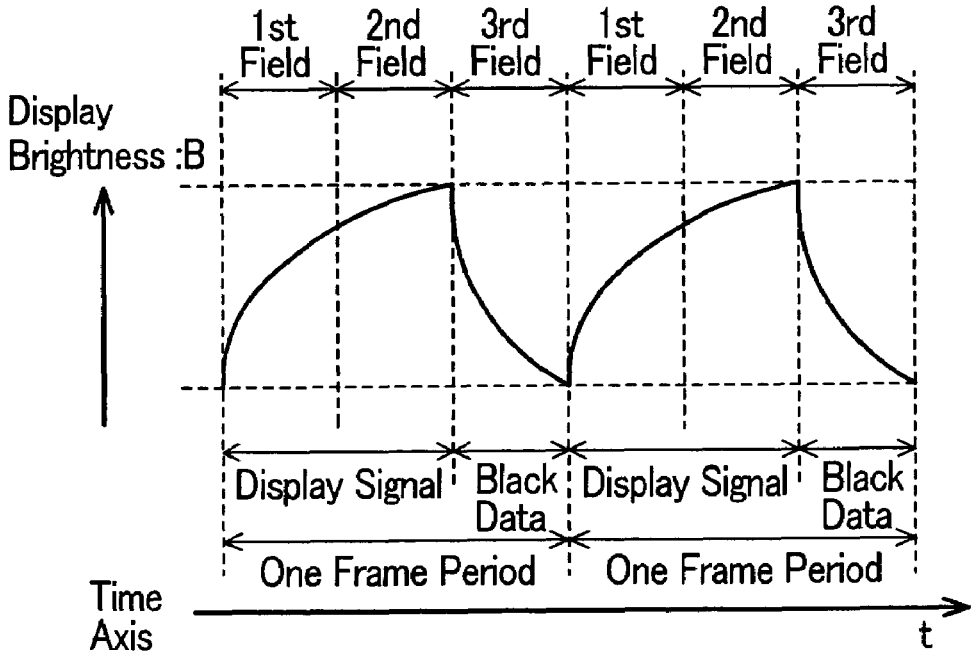
FIG. 20 is a diagram showing the brightness response corresponding to the display timing of the fifth embodiment of the display device of the present invention.

The brightness response of the liquid crystal layer, when the display device having the liquid crystal panel of the normally black display mode as the pixel array 201 is operated in accordance with the image display timing shown in FIG. 19 under the above mentioned condition, is shown in FIG. 20. To the pixels formed in the liquid crystal panel, the gray scale voltages corresponding to the display ON data, which displays the pixels in white as image data, are supplied in the first field, and the gray scale voltages corresponding to the display OFF data (black data), which displays the pixels in black as the blanking data, are supplied in the third field. The liquid crystal layer of the liquid crystal panel which corresponds to the pixels responds with a brightness corresponding to the video data in the first 65% of one frame period, and, thereafter, it responds to the black brightness in the remaining 35% of one frame period, as shown in FIG. 20. Accordingly, in respective frame periods, the display brightness of the pixel indicates a response similar to the response of the impulse-type display device. Due to such a constitution, also in driving the display device according to this embodiment, it is possible to reduce the animated image blurring which occurs on a profile of an object which moves in the screen over the frame period at the time of displaying an animated image.

In the embodiment described above, for every frame period, 65% of the frame period is allocated to the display period of the display signals and 35% of the frame period is allocated to the display period of the blanking data. However, this ratio can be suitably adjusted by changing the ratios of respective fields with respect to one frame period. For example, by setting the second field for holding the video data in the pixel array to 0% of one frame period, for every frame period, 35% of the frame period may be allocated to the display period of the video data and 65% of the frame period may be allocated to the display period of the blanking data. Further, the sequence or the order of the second field and the third field may be exchanged along a time axis so as to hold the blanking data inputted in the pixel array in the third field in the pixel array in the second field, 35% of one frame period may be allocated to the display period of the video data and 65% of one frame period may be allocated to the display period of the blanking data.

Sixth Embodiment

Figure 21:
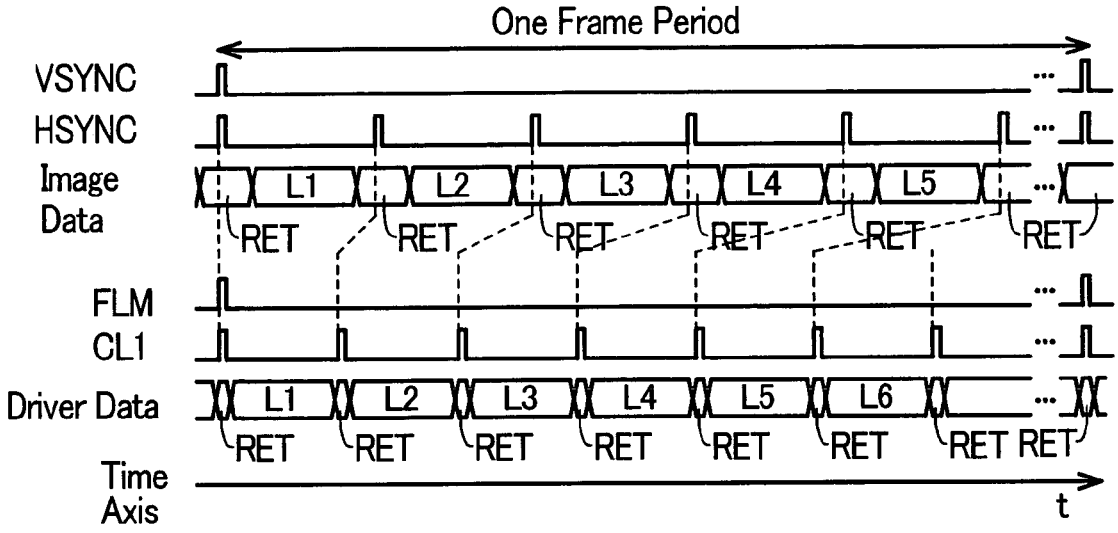
FIG. 21 is a diagram showing the timing of video data inputs to the display device of the present invention and display data outputs from the display device in the sixth embodiment.
Figure 22:
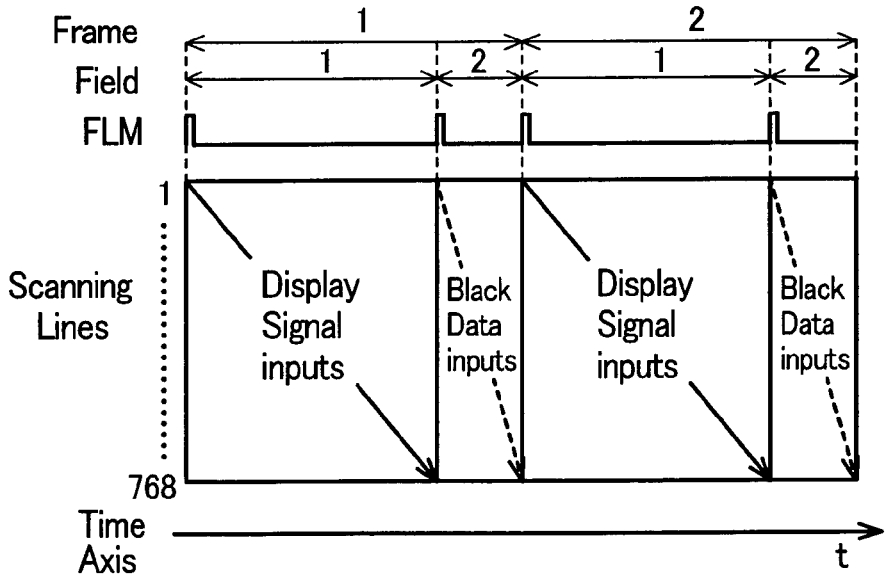
FIG. 22 is a diagram showing the display timing of the sixth embodiment of the display device according to the present invention for every frame period.

In this embodiment, using the display device provided with the clock generating circuit 214 shown in FIG. 17, the video data 220 (see waveforms of input data), which is inputted to the timing controller 204 of the display device 200 at the timing shown in FIG. 21, is read out as the display data (see waveforms of driver data), and the display signals are displayed on the pixel array 201 at the timing shown in FIG. 22. As can be readily understood from FIG. 21, also in this embodiment, in the same manner as the previous fourth embodiment, the video data for one frame period, which is stored in the memory circuit 205 connected to the timing controller 204, is read out as display data for every line (irrelevant to whether the video data is video data for odd-numbered lines or video data for even-numbered lines). Further, in the same manner as the fourth embodiment, also in this embodiment, the first frame period is divided into a first field and a second field, which follows the first field. In the first field, the display data which is obtained by reading out the video data is written in the pixel array 201 as a display signal, and the image corresponding to the display signals is displayed on the pixel array. In the second field, the blanking data is written in the pixel array 201 so as to display the blanking image on the pixel array.

On the other hand, in this embodiment, in the same manner as the fifth embodiment, the video data inputted in the display device 200 and stored in the memory circuit 205 through the timing controller 204 is read out as display data from the memory circuit 205 in response to the pulse of the display clock 215 (the reference clock of the display device) generated by the clock generating circuit 214. Further, in the same manner as the fifth embodiment, the frequency of the display clock 215 is set higher than the frequency of the dot clock DOTCLK (the reference clock included in the video control signals 221) of the video data. Further, as can be readily understood from respective waveforms of the input data and the driver data shown in FIG. 21, also in this embodiment, in the same manner as the fifth embodiment, the horizontal retracing period RET, which is included in the time (the horizontal period) read out from the video data for one line stored in the memory circuit 205, is shorter than the horizontal retracing period RET included in the time for storing the video data for one line in the memory circuit 205. Also in this embodiment, by setting the frequency of the display clock 215 to a value which is 1.14 times higher than the frequency of the dot clock DOTCLK and also setting the horizontal period (using the dot clock DOTCLK as the reference) of the pixel array operation to 80% of the longitudinal scanning period of the video data by shortening the retracing period thereof, the horizontal scanning period of the pixel array, which uses the display clock 215 as a reference, can be shortened to 70% of the horizontal scanning period of the video data in the same manner as the fifth embodiment. When the outputting of the gray scale voltages due to the data driver 202 in the first field and the second field is performed for every pulse of the horizontal data clock CL1, the frequency of the horizontal data clock CL1 assumes a value which is about 1.43 times as large as the frequency of the horizontal synchronizing signal HSYNC of the video data.

In this manner, also in the driving method of the display device according to this embodiment, in the same manner as the driving method of the fifth embodiment, the display data (driver data 206) which corresponds to one gate selection pulse is read out from the memory circuit 205 during the horizontal period, including retracing periods that are shorter than the retracing periods included in the horizontal scanning period of the video data and at the timing of a clock for liquid crystal display which is different from an input clock of the video signals. However, in this embodiment, as indicated by the display timing shown in FIG. 22, 70% of one frame period is allocated to the display period of the display signals based on the video data, and the remaining 30% of the one frame period is allocated to the display period of the blanking data.

Although the driving of the pixel array of this embodiment in accordance with the display timing shown in FIG. 22 is substantially performed in the same manner as the driving of the pixel array in the fifth embodiment, this embodiment differs from the fifth embodiment in the driving of the pixel array with respect to the fact that this driving of the display device uses the display clock 215 as a reference. That is, for every frame period, in the first field, the video data is read out as display data regardless of whether the video data is for odd-numbered lines or for even-numbered lines, and the video data is transferred to the data driver 202 as the driver data 206. The reading out of the video data from the memory circuit 205 is started simultaneously with the start of storage of the next video data into the memory circuit 205 in the next frame period, which follows the frame period in which the video data is stored in the memory circuit 205. The data driver 202 sequentially generates the first gray scale voltage group, which respectively corresponds to a plurality of data lines (signal lines) juxtaposed in the pixel array for every one line of the video data received as the driver data 206, and supplies the first gray scale voltage group to a plurality of pixel rows juxtaposed in the pixel array for every row. Accordingly, in the first field, the gate selection pulses (the scanning signal pulses) are sequentially outputted from the scanning driver 203 for every one of a plurality of gate lines (scanning signal lines) juxtaposed in the pixel array. That is, a plurality of gate lines are sequentially selected for every one line, and, hence, the first gray scale voltage group is supplied to every pixel row corresponding to one line of the gate lines. When the resolution of the pixel array is XGA class, in the first field, the first gray scale voltage group is outputted 768 times from the data driver 202 and the gate selection pulse is outputted 768 times from the scanning driver 203. As mentioned previously, the above-mentioned operation is completed within the beginning 70% of one frame period.

In the driving of the pixel array in this embodiment, within 30% of one frame period, the blanking data is inputted to the pixel array in accordance with the timing charts shown in FIG. 11 and FIG. 12. Any one of the gray scale voltage generation methods described in the previous embodiments may be applicable to the generation of the second gray scale voltage corresponding to the blanking data due to the data driver 202. In the blanking image display according to the timing chart shown in FIG. 11, the gate selection pulse is outputted to four lines out of a plurality of gate lines from the scanning driver 203 with respect to the second gray scale voltages from the data driver 202. Accordingly, a plurality of pixel rows, which are juxtaposed in the pixel array, are selected for every four lines and every four other lines out of a plurality of gates lines corresponding to the respective pixel rows, and the second gray scale voltages are applied to the pixel rows. In the blanking image display according to the timing chart shown in FIG. 12, for every outputting period of the second gray scale voltages from the data driver 202, the gate selection pulses are sequentially outputted to four lines out of a plurality of gate lines from the scanning driver 203. Accordingly, the pulse interval of the scanning clock CL3 in the second field becomes ¼ of the period (the horizontal period in the pixel array operation) in which the second gray scale voltages are outputted once. Also, in this blanking image display, with respect to the outputting of the second gray scale voltages at a certain time, the pixel rows which correspond to four lines out of the gate lines are selected in response to the gate selection pulses and the second gray scale voltages are applied to the pixel rows. Accordingly, in the blanking image display in the second field, when the second gray scale voltage group are outputted 192 times from the data driver 202, the gate selection pulse is outputted 192 times from the scanning driver 203 in accordance with the timing chart shown in FIG. 11, and the gate selection pulse is outputted 768 times from the scanning driver 203 in accordance with the timing chart shown in FIG. 12. As described above, when the beginning 70% of one frame period is allocated to the image display based on the video data in the first field and the remaining 30% of one frame period is allocated to the blanking image display in the second field, the frequency of the horizontal data clock CL1 in the second field is set lower than the corresponding frequency in the second field, and the frequency of the scanning clock CL3 is adjusted in accordance with the change of frequency of the horizontal data clock CL1. In this case, due to the above-mentioned clock generating circuit 214 or the pulse oscillator and the like, which are newly provided in the periphery of the timing controller 204, reference clock (the second reference clock) for the second field, having a frequency lower than the frequency of the display clock 215, is generated, and the horizontal data clock CL1 and the scanning clock CL3 for the second field may be generated based on the reference clock. Further, the frequency of the horizontal data clock CL1 in the second field is held to a value of the frequency thereof in the first field and only the beginning 192 pulses out of 330 pulses of the horizontal data clock CL1 that are generated in the second field may be used for supplying the second gray scale voltage group to the pixel array. In the latter pixel array operation, the pulse interval of the scanning starting signal FLM is adjusted, and outputting of the gate selection pulses from the scanning driver 203 is set as mentioned above in accordance with the timing chart shown in FIG. 11 or FIG. 12. That is, the writing of the blanking data to the pixel array in the second field is completed within a period which is ¼ of the first field (17.5% of one frame period) and the blanking data is held in the pixel array in the remaining period.

Figure 23:
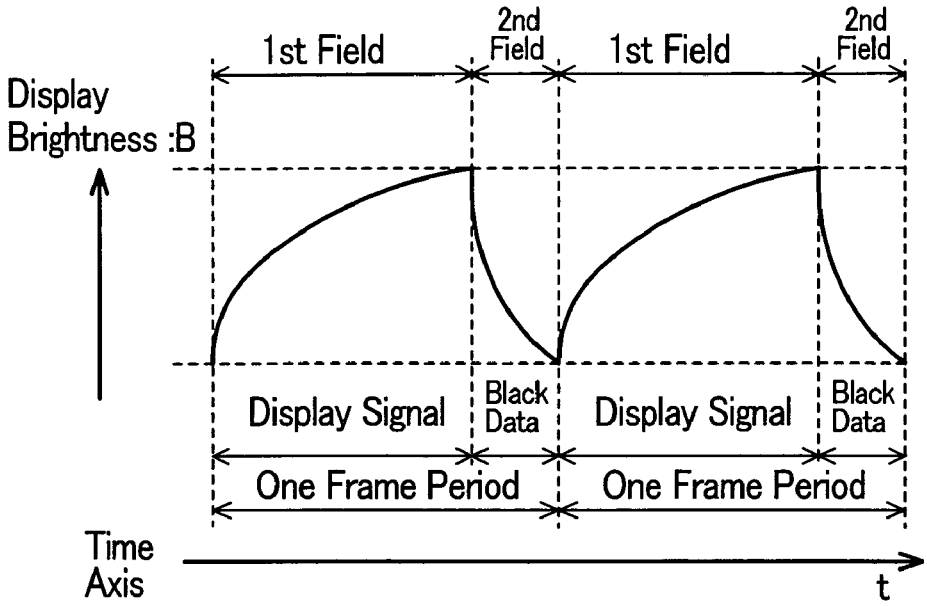
FIG. 23 is a diagram showing the brightness response corresponding to the display timing of the sixth embodiment of the display device of the present invention.

In the liquid crystal panel of the normally black display mode, having a resolution of the XGA class, the brightness response of the liquid crystal layer corresponding to the pixels of the liquid crystal panel, when the liquid crystal panel is operated at the display timing shown in FIG. 22 according to this embodiment, is shown in FIG. 23. The gray scale voltages corresponding to the display ON data, which make the pixels display in a white image as the pixel data, are applied to the pixels in the first field, and the gray scale voltages corresponding to the display OFF data (the black data), which make the pixels display a black image as the blanking data, are applied to the pixels in the second field. The liquid crystal layer of the liquid crystal panel corresponding to these pixels, as shown in FIG. 23, responds to a brightness corresponding to the video data in the beginning 70% of one frame period, and, thereafter, responds to a black brightness in the remaining 30% of the one frame period. Accordingly, in respective frame periods, the display brightness of the pixels exhibit a response close to an response of the impulse-type display device. Accordingly, also in the driving of the display device of this embodiment, at the time of displaying an animated image, it is possible to reduce the animated image blurring, which is generated on the profile of an object which moves within the screen over the frame period. In this embodiment, although the display period of the display data and the display period of the blanking data are respectively set to 70% and 30% of one frame period, the ratio can be suitably changed by the adjustment of the above-mentioned horizontal data clock CL1, the scanning clock CL3, the scanning starting signal FLM and the like.

Seventh Embodiment

Combination with Blinking Operation of Lighting Device

Hereinafter, the seventh embodiment of the present invention will be explained in conjunction with FIG. 24 and FIG. 25. The display device 300 shown in FIG. 24 has a constitution substantially equal to the constitution shown in FIG. 1. However, this embodiment differs from other embodiments in that, since a transmitting-type liquid crystal panel is provided as a pixel array 301, the display device 300 is provided with a backlight (a lighting device not shown in FIG. 24), which irradiates light to the pixel array 301, and a driving circuit 315. Further, this embodiment is characterized in that the backlight driving circuit 315 is controlled in response to backlight control signals 316 transmitted from a liquid crystal timing controller 304. Accordingly, the backlight intermittently irradiates light to the liquid crystal panel. A backlight which performs a flickering operation or a blinking operation is referred to as a "blink backlight". Further, a control which modulates the brightness of the backlight periodically is referred to as "blink control". FIG. 25 shows the driving timing of the display device according to this embodiment in which the blinking operation of the blink backlight is combined with the brightness response of the liquid crystal panel (pixels thereof) in the display device (liquid crystal display device) according to the present invention, as explained in conjunction with FIG. 6, FIG. 9, FIG. 13, FIG. 16, FIG. 20 or FIG. 22. That is, in this embodiment, the animated image blurring reduction effect obtained by driving the display device provided with the liquid crystal panel as the pixel array in any one of the methods explained in the first embodiment to the sixth embodiment can be further enhanced by employing the blink operation of the lighting device provided to the display device. Here, the liquid crystal panel used in this embodiment has a resolution of the XGA class and the liquid crystal layer is modulated in the so-called normally black display mode, in which the weaker the electric field that is applied to the liquid crystal layer is, the more the optical transmissivity is reduced.

Figure 24:
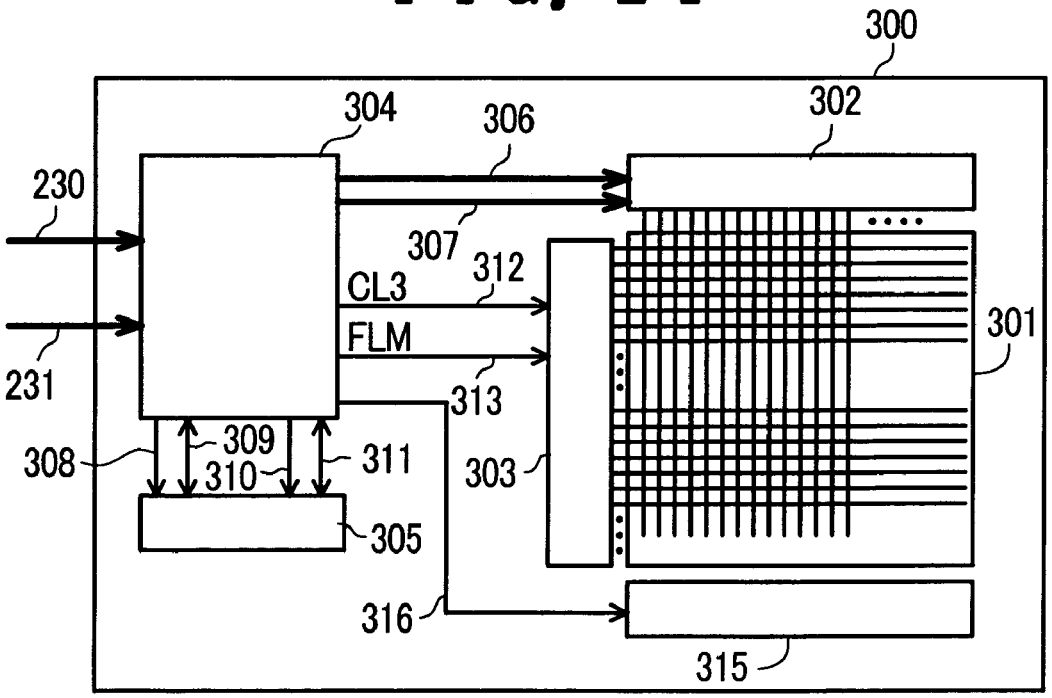
FIG. 24 is a block diagram showing the basic structural features of the seventh embodiment of the display device (liquid crystal display device) according to the present invention.
Figure 25:
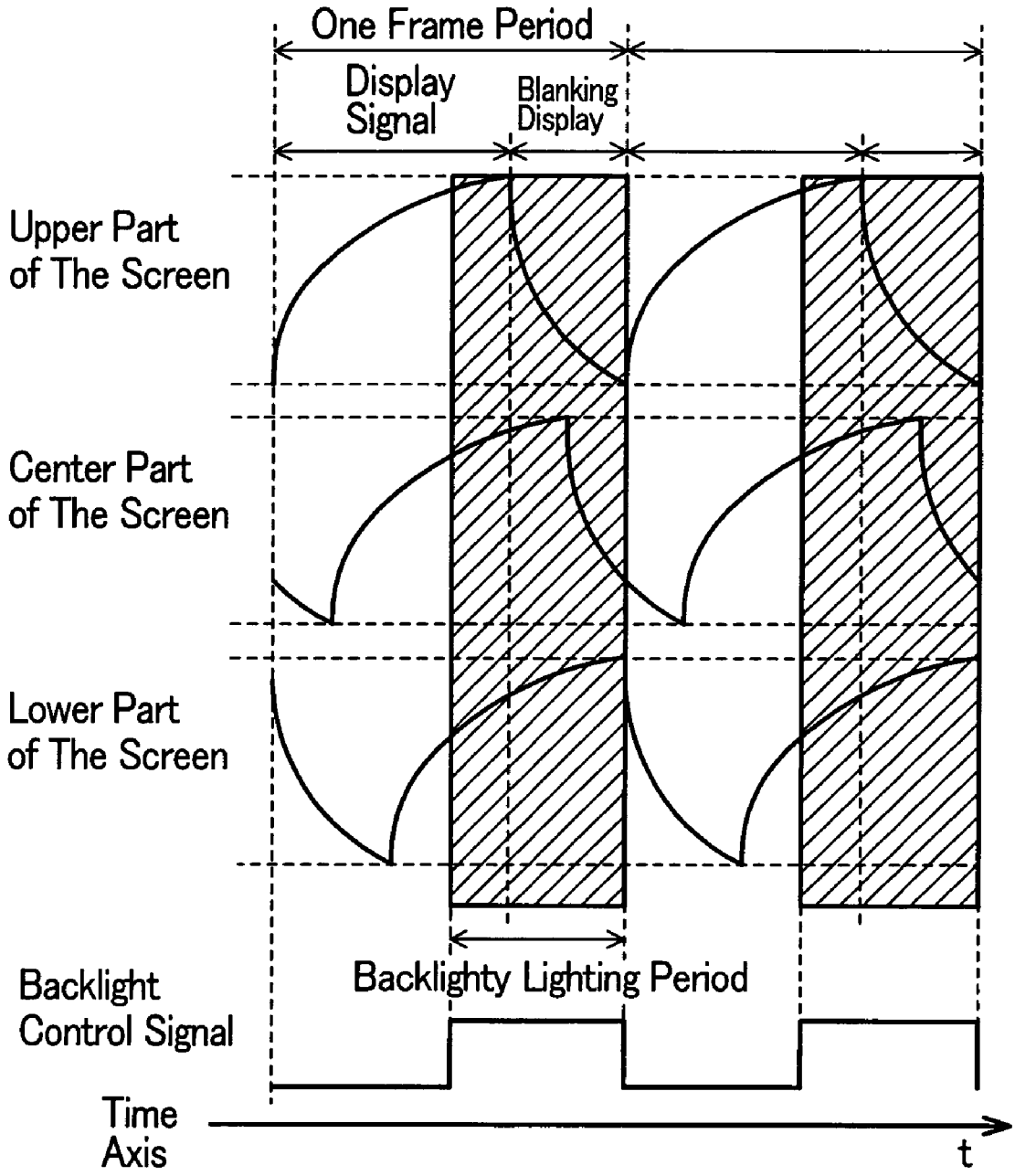
FIG. 25 is a diagram showing the blink control timing of a lighting device (a backlight) corresponding to the brightness response in the seventh embodiment of the display device (liquid crystal display device) according to the present invention.

A display device (liquid crystal display device) 300 shown in FIG. 24 includes a timing controller 304 which receives video data 320 from a video signal source, such as a television receiver set, a personal computer, a DVD player and the like (outside the display device) and video control signals 321 (defined previously in the first embodiment and the fifth embodiment), and a pixel array (liquid crystal panel) 301 which receives the display data and the display control signals from the timing controller 304. A memory circuit 305 which stores the video data 320 for every frame period is connected to the timing controller 304. The constitution of the memory circuit 305 substantially corresponds to the memory circuits 105-1, 105-2 shown in FIG. 1, wherein the memory circuit 305 is shown ma simplified form in FIG. 24 in the same manner as FIG. 17. That is, the memory circuit 305 includes a first portion to which the video data 320 is inputted from a first port 309 in response to a control signal 308 and a second portion to which the video data 320 is inputted from a second port 311 in response to a control signal 310. The video data stored in the first portion is also read out In parallel to the storing of other video data to the second portion. Further, the video data stored in the second portion also can be read out in parallel to the storing of other video data to the first portion. The video data stored in the memory circuit 305 is read out as the driver data 306 by any one of the methods described in the previous embodiments, and it is transferred to a data driver (an image signal driving circuit) 302 provided to a pixel array (a liquid crystal panel) 301. The clock generating circuit and other similar parts which have been explained in conjunction with the fifth embodiment and the sixth embodiment are connected to the display control circuit 304. Further, by newly incorporating such control circuits into the timing controller 304, the reading out of the driver data 306 from the memory circuit 305 may be accelerated.

The timing controller 304 supplies a horizontal data clock CL1, a dot clock (CL2) and the like, together with the driver data 306, to the data driver 202 as the data driver control signal group 207, and it supplies a scanning clock 312 (CL3) and a scanning starting signal 313 (FLM) to a scanning driver (a scanning signal driving circuit) 303 provided to the pixel array 301.

A backlight control signal 316, that is transmitted to the back light driving circuits 315 from the timing controller 304, controls the backlight driving circuit 315 such that, as indicated by waveforms thereof shown in FIG. 25, the backlight driving circuit 315 turns on (brightens) the backlight when the backlight control signal 316 assumes the High level and turns off (darkens) the backlight when the backlight control signal 316 assumes the Low level.

On the other hand, in this embodiment, the pixel array (liquid crystal panel) 301 is sequentially scanned from the upper side to the lower side in FIG. 24 along the data lines (signal lines) for every frame period (this operation being referred to as "whole vision scanning" for the sake of convenience). In the previous respective embodiments, such a whole vision scanning is performed twice during one frame period, wherein the display data (video data) is written in the pixel array 301 in the first time and the blanking data is written in the pixel array 301 in the second time. When the display ON data (first gray scale voltage corresponding to the display ON data), which displays the pixels in white, is written in the pixel rows of the pixel array 301 formed of the liquid crystal panel of the normally black display mode, and the display OFF data (second gray scale voltage corresponding to the display OFF data), which displays the pixels in black as the blanking data, is written in such pixel rows, the timing of the brightness change of the liquid crystal layer corresponding to respective pixel rows in the frame period is displaced along the data lines (in the vertical direction) of the pixel array 301. In FIG. 25, the displacement of the brightness change between the pixel rows is shown as graphs of brightness response of respective pixel rows at an upper portion of the screen, a center portion of the screen (in the vicinity of (N/2)th gate line from the upper side of the pixel array having N pieces of gate lines) and a lower portion of the screen.

The optical transmissivity of the liquid crystal layer corresponding to respective pixel rows responds to a value corresponding to the data which is written when several ms (millisecond) to several tens of ms lapses after writing the display data or the blanking data in the pixel rows (after supplying corresponding gray scale voltages to the pixel rows). On the contrary, when the above-mentioned whole vision scanning is performed using the display data and the blanking data for every frame period, corresponding gray scale voltages are sequentially supplied to the respective pixel rows from an upper portion to a lower portion of the screen of the pixel array. Accordingly, when the whole vision scanning is performed on the pixel array using the display ON data, at a point of time that the gray scale voltages are supplied to the pixel rows at the lower portion of the screen (a minimum point where from which the graph of brightness response turns from the decrease to the increase), the brightness of the liquid crystal layer corresponding to the pixel rows at the upper portion of the screen considerably approaches the brightness corresponding to the display ON data. In this manner, when the image based on the display data for every frame period cannot be sufficiently cancelled from the vision of a user of the display device due to the irregularities of brightness response along a time axis generated inside of the liquid crystal panel (pixel array), it is difficult to make the user perceive that the images which are formed one after another on the pixel array over a plurality of frame periods are displayed as if they are impulse-type images. In this embodiment, corresponding to the timing of the image display and the blanking image display based on the video data for every frame period by the liquid crystal display device (liquid crystal panel provided to the liquid crystal display device), the blinking operation of the backlight is performed, and, hence, the images formed on the liquid crystal panel are displayed in an impulse manner for every frame period. It is desirable that this blinking operation of the backlight is performed using portions of the control signals for forming images or in response to (or in synchronism with) the control signals.

The blinking control of the backlight according to this embodiment gives rise to lowering of the display brightness of the liquid crystal panel due to the turning-off of the backlight. However, by adjusting the periods in which the blanking display period (for example, black display timing of respective pixel rows) in the frame period and the turning-off periods of the backlight overlap each other, the lowering of the display brightness of the liquid crystal panel, which the user of the display device perceives, can be suppressed to a minimum value. This is attributed to a tendency that the vision of the user is liable to be focused on the center portion of the pixel array when an animated image is displayed on the display device. Accordingly, the backlight turn-on time is started after the display data is written in the pixel rows positioned at the center portion of the pixel array, as indicated by a hatched region overlapped to the graph of brightness response in FIG. 25, and is finished after completion of writing of the blanking data to the pixel rows. As a light source of the backlight, a fluorescent lamp, such as a cold cathode fluorescent lamp, a lamp which seals a gas like xenon therein, a light emitting diode or the like, is provided. It is preferable that the light emitting characteristics of the light source is such that the light source obtains the desired brightness in a short period after starting the supply of electric current (also referred to as a ramp current or a tube current) to the light source and becomes dark when the supply of the electric current is stopped (after-glow is small). However, many light sources require about several ms to obtain light emission from the supply of the ramp current and the after-grow time (the time necessary for the light source to obtain the sufficient attenuation after stopping the supply of the ramp current) also requires several ms. In view of the characteristics of the light source, it is desirable that the backlight turn-on time is started before writing the blanking data to the pixel rows to which the gray scale voltages are first supplied in the whole vision scanning (pixel rows at the uppermost stage in the pixel array in the case of FIG. 25). Further, it is desirable that the backlight turn-on time is finished before writing the blanking data to the pixel rows to which the gray scale voltages are lastly supplied in the whole vision scanning (pixel rows at the lowermost stage in the pixel array in the case of FIG. 25).

On the other hand, when the blinking control of the backlight is stopped (the backlight is continuously turned on) in response to the image formed on the display device, an electric current supplied to the light source (a tubular bulb such as a cold cathode fluorescent lamp) provided to the backlight is increased at the time of performing the blinking control, than at the time of continuously turning on the light source, so as to compensate for the lowering of brightness of the display image during the blinking control and to enhance the contrast of the display image. When an excessively large ramp current is supplied to the above-mentioned various lamps which, are used as light sources, their lifetime is shortened. However, as shown in FIG. 25, by setting the turn-on time (the turn-on time in which the ramp current is increased) during the blinking control time of the backlight to 30-70% (preferably 50%) of one frame period and by performing the blinking operation of the backlight once during the frame period such that the blinking operation is started after the lapse of ½ of the first field from the starting time of one frame period, it is possible to prolong the lifetime of the light source and to suppress the lowering of brightness of the display image.

In case a sufficient light emission brightness is obtained even when the ramp current is increased, it is desirable that the ramp current is increased so as to further shorten the turn-on period of the backlight. Accordingly, during the backlight turn-off period, the liquid crystal panel is displayed in substantially complete black. Further, by performing the blinking control of the backlight at the timing of FIG. 25, the backlight is turned on in a state such that the pixel rows at the center of the screen of the liquid crystal panel sufficiently respond to the video data, and, hence, the clarity of the display image is increased and, at the same time, the light emitting efficiency of the lamp is also enhanced.

According to the driving method of the display device (liquid crystal display device) of this embodiment, by adjusting the optical response speed of the liquid crystal sealed in the liquid crystal panel, the turn-on period of the backlight corresponding to the rate of the blanking display period and the like, it is possible to optimize the display operation of an animated image. Further, since the overheating of the lamp can be suppressed during the turn-off period of the backlight, the lowering of brightness attributed to the temperature elevation also can be prevented.

In this manner, by taking the blanking display period for every frame period in the driving of the display device (liquid crystal display device) in the above-mentioned respective embodiments into consideration and by combining the ON-OFF control of the backlight to such driving of the display device, it is possible to realize a display device which exhibits an excellent light emitting efficiency, as well as excellent animated image display characteristics.

Eighth Embodiment

Separation of Display Data Generating Circuit from Display Device

Figure 26:
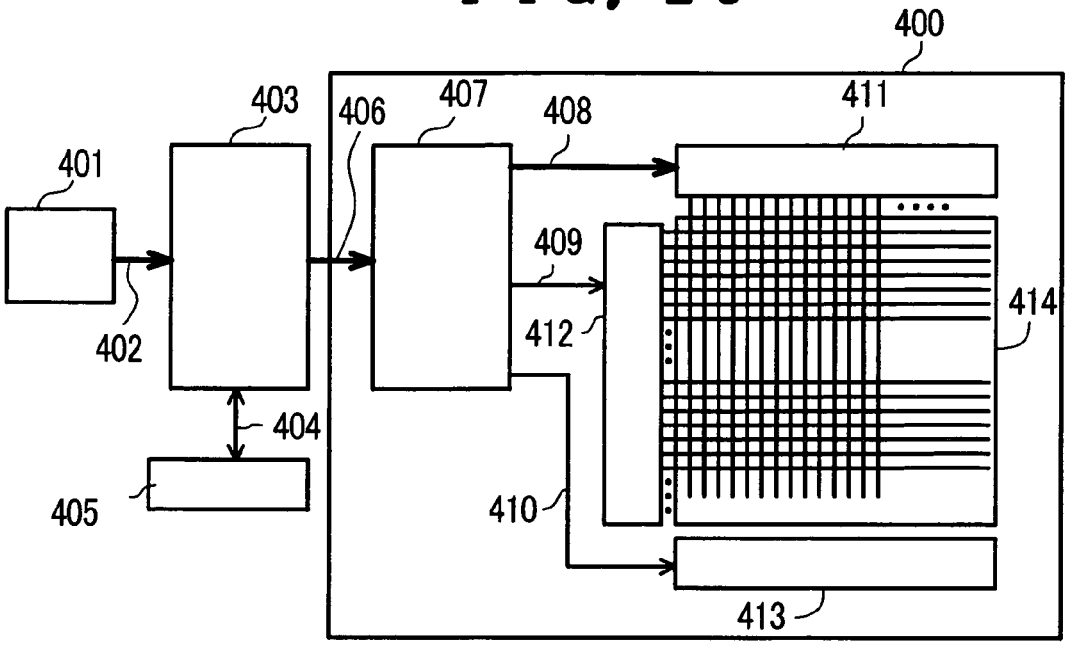
FIG. 26 is a block diagram showing the basic structural features of the eighth embodiment of the display device (liquid crystal display device) according to the present invention.

FIG. 26 shows the constitution of the display device (liquid crystal display device) of this embodiment. This embodiment is characterized in that the display data generating Function which is incorporated in the display device in the above-mentioned respective embodiments is separated from the display device. For example, in case of a television receiver, video data (video signals) received by a television receiver set is temporarily stored in a memory circuit (a frame memory) together with video control signals (including a vertical synchronizing signal VSYNC, a dot clock DOTCLK and the like) received with the video data, and the data is processed into display data suitable for image display by the display device. Accordingly, an image signal source 401, a scanning data generation circuit 403 which receives video data 402 and video control signals transmitted from the image signal source 401 and generates the display data 406, and a memory circuit 405 to which the video data 402 received by the scanning data generation circuit 403 is stored through a port 404 constitute external circuits with respect to the display device 400. The video data stored in the memory circuit 405 is read out as the display data 406 through a port 404 using the scanning data generation circuit 403.

The scanning data generation circuit 403 reads out the video data 402 as the display data 406 for every other line in the first embodiment, the second embodiment, the third embodiment and the fifth embodiment. Then, the display data 406 is written in the pixel array (for example, a TFT-type liquid crystal panel) 414 provided to the display device 400 for every two pixel rows. Further, in the second embodiment, the fourth embodiment, the fifth embodiment and the sixth embodiment, the scanning data generation circuit 403 performs the reading out of the display data for one line within a horizontal period shorter than the horizontal scanning period of the video data 402. Further, in the fifth embodiment and the sixth embodiment, the scanning data generating circuit 403 generates a display clock having a frequency higher than the frequency of a dot clock DOTCLK of the video data 402 inside thereof, or in a circuit such as a pulse oscillator which is provided in a periphery thereof, and reads out the display data 406 in response to the display clock. Accordingly, the display data 406 is intermittently inputted to the display device 400 for every frame period of the video data 402, and there arises a period in which the transfer of the display data 406 is disconnected for every frame period.

The timing controller 407 provided to the display device 400 receives the display data 406 and also receives the vertical synchronizing signal, the horizontal synchronizing signal and the dot clock (or the above-mentioned display clock) which are inputted to the display device 400 together with the display data 406, and it generates the scanning starting signal FLM, the horizontal data clock CL1, the dot clock CL2 and the scanning clock CL3 suitable for the display operation of the pixel array 401 performed by any one of the above-mentioned embodiments. The display data 406, which already has been generated outside the display device 400, can shorten the transfer period thereof to the display control circuit 407 with respect to one frame period defined by the pulse interval of the vertical synchronizing signal of the video data 402. Accordingly, when this embodiment is applied to the first embodiment, the display control circuit 407 receives the horizontal synchronizing signal and the dot clock (including the above-mentioned display clock), which are generated by the scanning data generation circuit 403 or a peripheral circuit thereof, and they are used for reading out the display data 406, and this horizontal synchronizing signal is transferred as the horizontal data clock CL1 together with the display data 406 to the data driver 411 through the driver data bus 408, and the scanning clock CL3 is generated based on the horizontal synchronizing signal (driving example in FIG. 3) or based on the horizontal synchronizing signal and the dot clock (driving example shown in FIG. 4), and the scanning clock CL3 is transmitted to the scanning driver 412 through the scanning data bus 409. Further, the vertical synchronizing signal of the video data 402 is inputted to the display device 400 and the video data 402 has the frequency thereof divided by the display control circuit 407 or the peripheral circuit so as to generate pulses of the scanning starting signal FLM which correspond to the starting times of the first field and the second field.

In the above-mentioned embodiments, other than the first embodiment, the pulse interval of the scanning starting signal FLM is changeable alternately, and, hence, the display control circuit 407 generates the scanning starting signal FLM by taking the horizontal synchronizing signal and the dot clock inputted to the display control circuit 407 together with the display data 406 as a reference. Accordingly, the display control circuit 407 counts the pulses of the horizontal synchronizing signal and the dot clock, generates pulses of the scanning starting signal FLM by detecting the starting timings of the second field and the third field in response to the pulses, and, as described in the previous embodiments, the horizontal data clock CL1 and the scanning clock CL3 of the pixel array operation are adjusted in conformity with the writing condition of the blanking data into the pixel array.

Here, FIG. 26 shows a constitution which is suitable for applying the display device according to the present invention to the liquid crystal display device in accordance with the display device of the seventh embodiment. The display device of this embodiment is not limited to a liquid crystal display device and is applicable to a display device which uses an electroluminescence array or a light emitting diode array as the pixel array. When the pixel array in which the pixels per se have a light emitting function is used, it is unnecessary to use the backlight driving circuit 413 and the backlight control signal bus 410 in FIG. 26.

According to the present invention, by effectively masking the image based on the video data for one frame period generated on the screen of the display device with the dark image (black image) based on the blanking data within one frame period, the image based on the video data for every frame period is perceived as the impulse display by the user of the display device. Accordingly, the user of the display device does not perceive the image based on the video data which has been already displayed on the screen before one frame period or more, so that the blurring of the profile of the moving object in the screen, which is attributed to the fact that the latest display image slightly overlaps these images is no longer perceived by the user. Accordingly, the animated image blurring in the animated image display by the display device driven by the hold-type operation principle and the degradation of image quality attributed to such animated image blurring can be suppressed.

Further, in accordance with the present invention, the lowering of the display brightness of the image attributed to the video data generated by the insertion of the blanking image display period for every frame period can be suppressed by optimizing the ratio between the video data writing time and the blanking data writing time to the pixel array during one frame period and by inserting the period for holding the video data in the pixel array.

Further, with respect to the liquid crystal display device of the present invention, due to the combination of the timing of the image display based on the video data and the blanking image display in one frame period and the blink control timing of the backlight, the brightness and the contrast of the display image can be enhanced.

What is claimed is:

1. A display device comprising:

a pixel array comprising a plurality of pixels;

a plurality of gate lines;

a plurality of video signal lines;

a scanning driver outputting a plurality of scanning signals to the plurality of gate signal lines; and a data driver outputting a plurality of display signals to the plurality of video signal lines;

wherein the pixel array displays images in a normally black mode, wherein the scanning driver outputs to the plurality of gate signal lines in a first pixel row selection step and in a second pixel row selection step, wherein the data driver outputs the plurality of display signals in response to the selection of respective pixel rows in the first pixel row selection step which is performed every frame period and outputs display signals which display the pixel array darker than the first selection step to respective selected pixel rows in the second selection step of the pixel row, and wherein the total period of the first pixel row selection step in one frame period is longer than the total period of the second pixel row selection step in one frame period.

2. A display device according to claim 1, wherein the scanning driver sequentially outputs the scanning signal which selects N lines (N being a natural number of 2 or more) which are arranged close to each other out of the plurality of gate signal lines in response to a first clock signal for every N other lines of the plurality of gate signal lines.

3. A display device according to claim 1, wherein the data driver outputs the display signal at an interval shorter than a horizontal scanning period of a video data which a display control circuit receives.

* * * * *